US010969723B2

(12) United States Patent
Tomii et al.

(10) Patent No.: US 10,969,723 B2
(45) Date of Patent: Apr. 6, 2021

(54) METHOD FOR DETECTING FAULT LOCATION OF IMAGE FORMING APPARATUS

(71) Applicant: CANON KABUSHIKI KAISHA, Tokyo (JP)

(72) Inventors: Hiroshi Tomii, Kashiwa (JP); Hidekazu Nakashio, Warabi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/371,773

(22) Filed: Apr. 1, 2019

(65) Prior Publication Data

US 2019/0310576 A1 Oct. 10, 2019

(30) Foreign Application Priority Data

Apr. 6, 2018 (JP) ..... JP2018-074041
Apr. 16, 2018 (JP) ..... JP2018-078624

(51) Int. Cl.
*G03G 15/00* (2006.01)
*G03G 15/01* (2006.01)
*G03G 21/00* (2006.01)

(52) U.S. Cl.
CPC ..... *G03G 15/5041* (2013.01); *G03G 15/0131* (2013.01); *G03G 21/0058* (2013.01)

(58) Field of Classification Search
USPC ..... 399/71
See application file for complete search history.

(56) References Cited

U.S. PATENT DOCUMENTS 4,335,952 A * 6/1982 Conly ..... G03G 15/55 399/11
8,712,265 B2 * 4/2014 Watanabe ..... G03G 15/5058 399/49
9,942,445 B2 4/2018 Matsuzaki
10,185,268 B2 * 1/2019 Kurosu ..... G03G 15/553
2009/0220286 A1 * 9/2009 Kurihara ..... G03G 21/0011 399/264
2011/0058823 A1 * 3/2011 Hirai ..... G03G 15/5058 399/15
2015/0192884 A1 * 7/2015 Sone ..... G03G 15/50 399/49

(Continued)

FOREIGN PATENT DOCUMENTS

JP 2014-134673 A 7/2014
JP 2017-040758 A 2/2017
JP 2017-194573 A 10/2017

*Primary Examiner* — Q Grainger
(74) *Attorney, Agent, or Firm* — Venable LLP

(57) ABSTRACT

An image forming unit forms a toner image on an image carrier using toner. A transfer unit transfers the toner image to a sheet. A cleaner removes, from the image carrier, residual toner that was not transferred to the sheet by the transfer unit. In a detection mode for detecting a part of the image forming apparatus causing a streak, a controller may control the image forming unit to form a pattern on the image carrier, control the transfer unit so that the pattern passes through a transfer position without transferring the pattern to the sheet, control the cleaner to remove the pattern on the image carrier, and control the transfer unit to transfer a residual streak from the image carrier to the sheet. The residual streak occurs from the pattern image by causing an error of the cleaner.

13 Claims, 43 Drawing Sheets

(56) References Cited

U.S. PATENT DOCUMENTS

| | | | |
|---|---|---|---|
| 2017/0308017 | A1 | 10/2017 | Tomii |
| 2018/0239290 | A1 | 8/2018 | Tomii |
| 2019/0041784 | A1 | 2/2019 | Yago et al. |
| 2019/0041785 | A1 | 2/2019 | Tomii et al. |
| 2019/0045068 | A1 | 2/2019 | Tanaka et al. |

* cited by examiner

FIG. 7A

| FIG. 6 | PRIMARY TRANSFER VOLTAGE [V] | TONER AMOUNT | CONDITION |
|---|---|---|---|
| DASHED-DOTTED LINE | 1Tr_D | LOW | MAXIMUM AMOUNT OF TONER SUPPLIED TO DRUM CLEANER IN NORMAL IMAGE FORMATION |
| DOTTED LINE | 1Tr_PD | MEDIUM | |
| SOLID LINE | 0 | HIGH | MAXIMUM AMOUNT OF TONER SUPPLIED TO DRUM CLEANER IN JAM PROCESSING |

FIG. 7B

| FIG. 8 | PRIMARY TRANSFER VOLTAGE [V] | TONER AMOUNT | CONDITION |
|---|---|---|---|
| DASHED-DOTTED LINE | 2Tr_D | LOW | MAXIMUM AMOUNT OF TONER SUPPLIED TO BELT CLEANER IN NORMAL IMAGE FORMATION |
| DOTTED LINE | 0 | MEDIUM | |
| SOLID LINE | 2Tr_PD | HIGH | MAXIMUM AMOUNT OF TONER SUPPLIED TO BELT CLEANER IN JAM PROCESSING |

FIG. 9

| STREAK TYPE | REPLACEMENT PART | BLANK PORTION W | PATTERN WHERE STREAK OCCURS | DIGITAL PATTERN | ANALOG PATTERN (WITH CHARGING) | ANALOG PATTERN (NO CHARGING) |
|---|---|---|---|---|---|---|
| DEVELOPING COAT DEFECT STREAK | DEVELOPING DEVICE FOR COLOR OF OCCURRENCE | NO STREAK | ONLY COLOR OF OCCURRENCE | STREAK PRESENT | STREAK PRESENT | STREAK PRESENT |
| EXPOSURE DEFECT WHITE STREAK | EXPOSURE APPARATUS FOR COLOR OF OCCURRENCE (CLEANING MAINTENANCE) | NO STREAK | ONLY COLOR OF OCCURRENCE | STREAK PRESENT | NO STREAK | NO STREAK |
| CHARGE DEFECT STREAK | PROCESS CARTRIDGE FOR COLOR OF OCCURRENCE | NO STREAK | ONLY COLOR OF OCCURRENCE | STREAK PRESENT | STREAK PRESENT | NO STREAK |
| TRANSFER BELT PLASTICITY DEFORMATION STREAK | INTERMEDIATE TRANSFER UNIT | NO STREAK | ALL COLORS | STREAK PRESENT | STREAK PRESENT | STREAK PRESENT |
| DRUM CLEANING DEFECT STREAK | PROCESS CARTRIDGE FOR COLOR OF OCCURRENCE | STREAK PRESENT (MONOCHROME) | ALL COLORS | STREAK PRESENT | STREAK PRESENT | STREAK PRESENT |
| TRANSFER BELT CLEANING DEFECT STREAK | TRANSFER BELT CLEANER | STREAK PRESENT (MIXED COLOR) | ALL COLORS | STREAK PRESENT | STREAK PRESENT | STREAK PRESENT |

FIG. 18

IMAGE DIAGNOSIS

DIAGNOSIS RESULT: IMAGE QUALITY PROBLEM HAS OCCURRED!
STREAK HAS OCCURRED IN SUB-SCANNING DIRECTION

CODE: ○○○○
REPLACEMENT UNIT: △△△△

OK

FIG. 20

| REPLACEMENT PART | $WD_Y$ | $WD_M$ | $WD_C$ | $WD_{Bk}$ | WT |
|---|---|---|---|---|---|
| DRUM CLEANER FOR YELLOW | STREAK | NO STREAK | NO STREAK | NO STREAK | NO STREAK |
| DRUM CLEANER FOR MAGENTA | NO STREAK | STREAK | NO STREAK | NO STREAK | NO STREAK |
| DRUM CLEANER FOR CYAN | NO STREAK | NO STREAK | STREAK | NO STREAK | NO STREAK |
| DRUM CLEANER FOR BLACK | NO STREAK | NO STREAK | NO STREAK | STREAK | NO STREAK |
| BELT CLEANER | NO STREAK | NO STREAK | NO STREAK | NO STREAK | STREAK |

FIG. 29

901

IMAGE DIAGNOSIS RESULT

IMAGE DIAGNOSIS HAS BEEN EXECUTED.
REPLACEMENT OF THE FOLLOWING PART IS NOW NECESSARY.

| 902 REPLACEMENT PART | 903 IDENTIFICATION ACCURACY |
|---|---|
| INTERMEDIATE TRANSFER MEMBER | 75% |
| PHOTOSENSITIVE MEMBER (CYAN) | 25% |

METHOD FOR DETECTING FAULT LOCATION OF IMAGE FORMING APPARATUS

BACKGROUND OF THE INVENTION

Field of the Invention

The present invention relates to a method for detecting a fault location of an image forming apparatus.

Description of the Related Art

An electrophotographic image forming apparatus has various parts that can be replaced, such as a charging unit, an exposure unit, and a developing unit. A user or a service person visually observes an output image to determine which replacement part to replace, but this determination is difficult. If it takes time to make the replacement part assessment, the time in which a user cannot form an image (so-called downtime) becomes longer.

Japanese Patent Laid-Open No. 2017-194573 proposes a test chart that enables the identification of which of a charging unit and a developing unit should be replaced, by using different charging potentials to form two types of toner images without exposure being performed. "Test chart" means a sheet on which a test image has been formed.

Japanese Patent Laid-Open No. 2017-194573 also proposes determining that a belt cleaner or a drum cleaner should be replaced based on whether or not there is a streak in a blank portion on a test chart where a toner image has not been formed. When a cleaner suffers wear, it ceases to be able to sufficiently clean toner, and remaining toner is transferred to a sheet. A determination regarding replacement of a cleaner is made by using this principle in Japanese Patent Laid-Open No. 2017-194573. However, if toner is not sufficiently supplied to a cleaner, a streak will not be transferred to a sheet in the first place.

SUMMARY OF THE INVENTION

An embodiment provides an image forming apparatus comprising the following element. An image forming unit is configured to form a toner image on an image carrier using toner, wherein the image carrier rotates. A transfer unit is configured to transfer the toner image from the image carrier to a sheet. A cleaner is configured to remove, from the image carrier, residual toner that was not transferred to the sheet by the transfer unit. A controller is configured to: in a detection mode for detecting a part of the image forming apparatus causing a streak which is a straight line, control the image forming unit to form a pattern image on the image carrier; control the transfer unit so that the pattern image passes through a transfer position on which the toner image is transferred by the transfer unit from the image carrier to the sheet without transferring the pattern image to the sheet; control the cleaner to remove the pattern image on the image carrier; and control the transfer unit to transfer a residual streak from the image carrier to the sheet. The residual streak occurs from the pattern image by causing an error of the cleaner.

Further features of the present invention will become apparent from the following description of exemplary embodiments (with reference to the attached drawings).

BRIEF DESCRIPTION OF THE DRAWINGS

FIGS. 7A and 7B are each views illustrating relationships between supplied toner amount and primary transfer voltage in a toner patch for making a cleaner defect be apparent.

FIG. 9 is a view for illustrating a relationship between streak types and replacement parts.

FIG. 18 is a view illustrating an example of a message that indicates a replacement part.

FIG. 20 is a view illustrating a method of identifying a replacement part in a second embodiment.

FIG. 29 is a view illustrating an example of an image diagnosis result.

DESCRIPTION OF THE EMBODIMENTS

First Embodiment

[Image Forming Apparatus]

Figure 1:
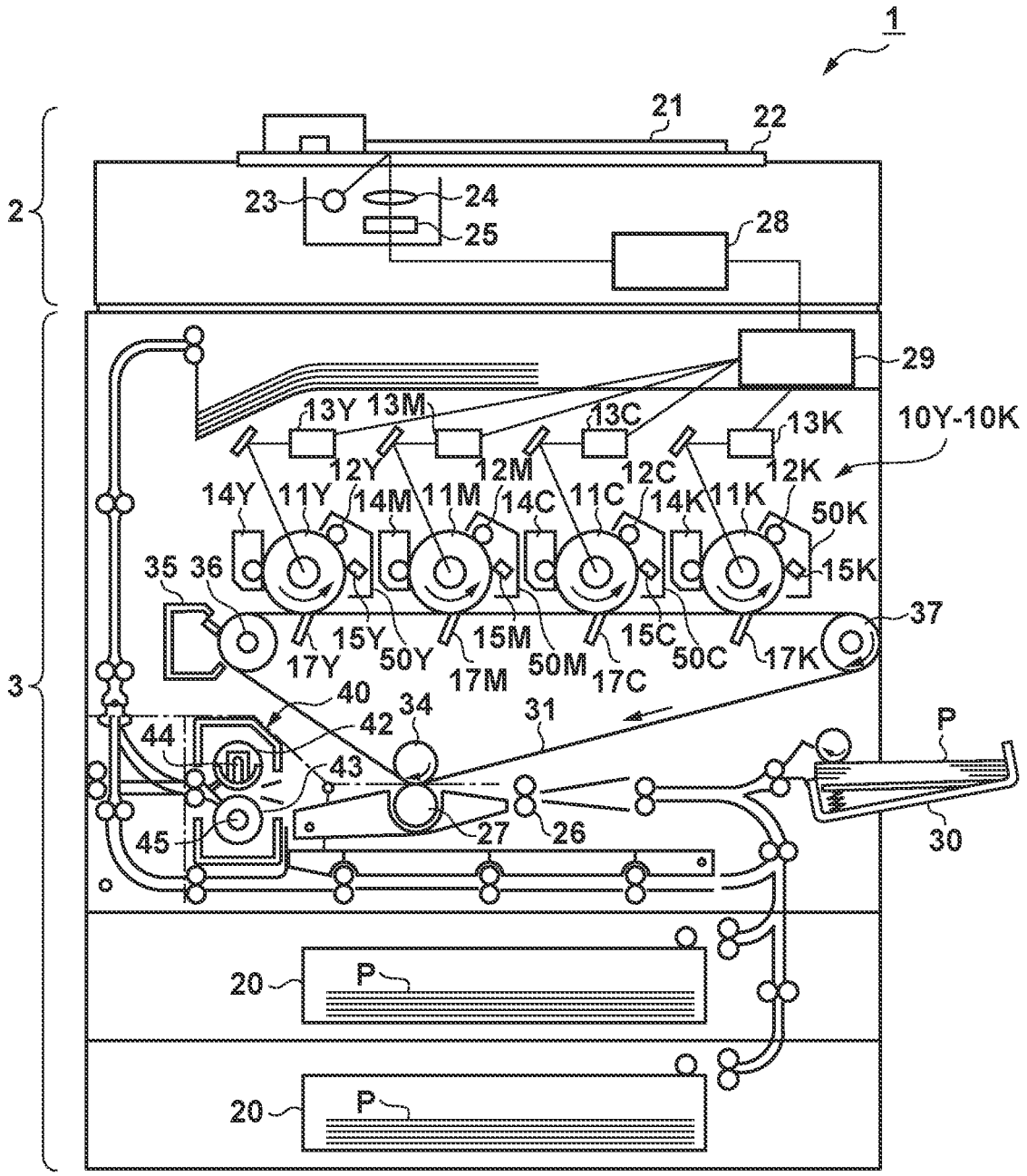
FIG. 1 is a view illustrating an image forming apparatus.

FIG. 1 is a cross-section view illustrating an image forming apparatus 1. The image forming apparatus 1 has an image reader 2 and a printer 3. The image reader 2 is a reading unit for reading an original, a test chart or the like. A light source 23 emits light on an original 21 placed on a platen glass 22. An optical system 24 guides light reflected from the original 21 to a CCD sensor 25, causing an image to be formed. CCD is an abbreviation for charge-coupled device. The CCD sensor 25 has red, green, and blue line sensors, and generates red, green, and blue color component signals. An image processing unit 28 executes image processing (for example, a shading correction) on image data obtained by the CCD sensor 25, and outputs a result to a printer control unit 29 of the printer 3.

An image forming unit 10 of the printer 3 is an electrophotographic image forming engine that forms a toner image in accordance with image information on a sheet P. The image forming unit 10 has four stations (image forming unit/station 10Y, 10M, 10C, and 10K) that form toner images of each of Y (yellow), M (magenta), C (cyan), and Bk (black) colors. Bk may be simply denoted as K. When description is given by distinguishing each part by color, a letter of Y, M, C, and Bk (K) is added to the end of the reference numeral.

Note that the present invention can be applied to a monochrome printer that forms a solid color image. As FIG. 1 illustrates, the image forming unit 10 comprises four photosensitive drums 11 corresponding to each of the colors Y, M, C, and Bk in order from the left side to the right. In the periphery of each photosensitive drum 11 are arranged a roller shape charging device 12, an exposure device 13, a developing device 14, a primary transfer device 17, a drum cleaner 15 and the like. Here, the photosensitive drum 11, the charging device 12, and the drum cleaner 15 are integrated as a process cartridge 50. The process cartridge 50 can be attached to and detached from the image forming apparatus 1. In addition, the image forming apparatus 1 is provided with an intermediate transfer belt 31 on which a toner image is formed, a secondary transfer device 27 for transferring the toner image on the intermediate transfer belt 31 to a sheet P, and a fixing device 40 for fixing the toner image to the sheet P. The fixing device 40 has a fixing roller 42 and a pressure roller 43, and applies heat and pressure to the toner image transferred to the sheet P to fix the toner image to the sheet P. The fixing roller 42 and the pressure roller 43 are each formed to be hollow, and respectively have a heater 44 and a heater 45. Note that the intermediate transfer belt 31 is wound around three rollers 34, 36, and 37, and rotates in a predetermined direction by the roller 37 rotating in the arrow direction. A belt cleaner 35 is provided for the intermediate transfer belt 31.

Here, a configuration of each unit of the image forming apparatus 1 is described. The photosensitive drum 11 is an aluminum cylinder on the surface of which a photosensitive layer has been formed. The photosensitive drum 11 functions as a photosensitive member. The charging device 12 has a metal wire, a charging roller, or a charging brush to which a charging voltage is supplied, for example. The exposure device 13 may be configured to have a light source that emits a laser beam and a rotating polygonal mirror that deflects the laser beam from the light source, or the exposure device 13 may be configured such that a plurality of light sources that emit laser beams are arranged to be lined up in an axial direction of the photosensitive drum 11. The axial direction is a direction parallel to the axis of rotation of the photosensitive drum 11. The axial direction is simply written as an X direction below. A laser beam from the exposure device 13 scans the photosensitive drum 11. The developing device 14 contains developer. The developing device 14 has a developing roller for supplying developer to the photosensitive drum 11. A magnet 141 provided inside the developing roller carries developer to the surface of the developing roller. Note that the developer recited in the present embodiment is a two-component developer that includes a nonmagnetic toner and a magnetic carrier. The developer may be a single component developer configured from magnetic toner, for example. The primary transfer device 17 is a transfer blade or a transfer roller to which a primary transfer voltage is supplied, for example. A nip portion (a primary transfer nip portion N1) is formed between the photosensitive drum 11 and the intermediate transfer belt 31 by the primary transfer device 17 pressing the intermediate transfer belt 31 toward the photosensitive drum 11. The drum cleaner 15 is, for example, a cleaning blade comprising elastic material that comes into contact with the surface of the photosensitive drum 11, or a fur brush that touches the surface of the photosensitive drum 11 to recover toner. The secondary transfer device 27 is, for example, a transfer roller to which a secondary transfer voltage is supplied, or a transfer belt wound around a plurality of rollers. A nip portion (a secondary transfer nip portion N2) is formed between the secondary transfer device 27 and the intermediate transfer belt 31 by the secondary transfer device 27 pressing the intermediate transfer belt 31. The belt cleaner 35 is, for example, a cleaning blade that comes into contact with the surface of the intermediate transfer belt 31, or a fur brush that touches the surface of the intermediate transfer belt 31.

Description is given below of a procedure for forming a black toner image, representative of the four colors. Note that, because a procedure for forming a toner image of other colors is similar to the procedure for forming a black toner image, detailed description thereof is omitted. When image forming is started, the photosensitive drum 11 is driven and rotates in a predetermined direction (the arrow direction). The charging device 12 causes the surface of the photosensitive drum 11 to be charged uniformly. The exposure device 13 exposes the surface of the photosensitive drum 11 in accordance with image information outputted from the printer control unit 29 to form an electrostatic latent image. The developing device 14 forms a toner image by causing toner to adhere to the electrostatic latent image, and developing the toner. The primary transfer device 17 primary transfers the toner image, which is carried to the photosensitive drum 11, to the intermediate transfer belt 31. The drum cleaner 15 removes residual toner from the photosensitive drum 11 that was not transferred to the intermediate transfer belt 31 at the primary transfer nip portion N1.

A feeding cassette 20 contains sheets P. Sheets P are stacked in a multi-feed tray 30. A sheet P fed from the feeding cassette 20 or the multi-feed tray 30 is conveyed toward a registration roller pair 26. The registration roller pair 26 temporarily stops the sheet P fed from the feeding cassette 20 or the multi-feed tray 30, and then conveys the sheet P to a secondary transfer nip portion N2 so that the toner image on the intermediate transfer belt 31 is transferred to a desired location on the sheet P. A secondary transfer voltage is applied to the secondary transfer device 27 while the sheet P is passing through the secondary transfer nip portion N2. By this, the secondary transfer device 27 secondarily transfers the toner image on the intermediate transfer belt 31 to the sheet P. Note that the belt cleaner 35 removes toner that remains on the intermediate transfer belt 31 and was not transferred to the sheet P at the secondary transfer nip portion N2. The sheet P, to which the toner image has been transferred, is conveyed to the fixing device 40. The fixing device 40 causes the toner image to be fixed to the sheet P.

[Charging Method]

Typically, there are two types of charging methods for the charging device 12: a non-contact charging method and a contact charging method. The non-contact charging method is a method for charging the photosensitive drum 11 by a corona discharge generated from a non-contact charging member (a metal wire) by the application of high voltages to the photosensitive drum 11 and the charging member. However, the corona discharge causes a discharge product such as ozone, nitrogen oxide (NOx) or the like to be generated, and becomes the cause of degradation of the photosensitive drum 11 and image blurring. In addition, if a discharge product adheres to the charging member (the metal wire), non-uniform discharge can occur, and a charge defect can occur in an image. Accordingly, there needs to be a cleaner member for cleaning the charging member (the metal wire). A contact charging method is a method in which a charging member (a charging roller) of the charging device 12 is caused to be in contact with the photosensitive drum 11 to charge the photosensitive drum 11. In general, the applied voltage in the contact charging method is lower than in the non-contact charging method, and the occurrence of a discharge product such as ozone or nitrogen oxide (NOx) is very low. However, when toner that has slipped past the drum cleaner 15 or an additive agent of the toner attaches or fuses to the charging member (the charging roller), a charge defect can occur.

[Replacement Part]

In the image forming apparatus 1 recited in the present embodiment, the photosensitive drum 11, the charging device 12, and the drum cleaner 15 are integrated in one process cartridge 50. By replacing the process cartridge 50, it is possible to quickly replace the photosensitive drum 11, the charging device 12, and the drum cleaner 15. In addition, in the image forming apparatus 1, the developing device 14 can also be attached to and removed from the image forming apparatus 1. Furthermore, in the image forming apparatus 1, the primary transfer device 17 and the intermediate transfer belt 31 form a transfer unit. The transfer unit can also be attached to and removed from the image forming apparatus 1. By replacing the transfer unit, it is possible to quickly replace the primary transfer device 17 and the intermediate transfer belt 31. Furthermore, the belt cleaner 35 can also be attached to and removed from the image forming apparatus 1. In this way, by making the process cartridge 50, the developing device 14, the transfer unit, and the belt cleaner 35 be replacement parts, simplification of maintenance for a user and a service person as well as shortening of maintenance time is realized.

[Control System]

Figure 2:
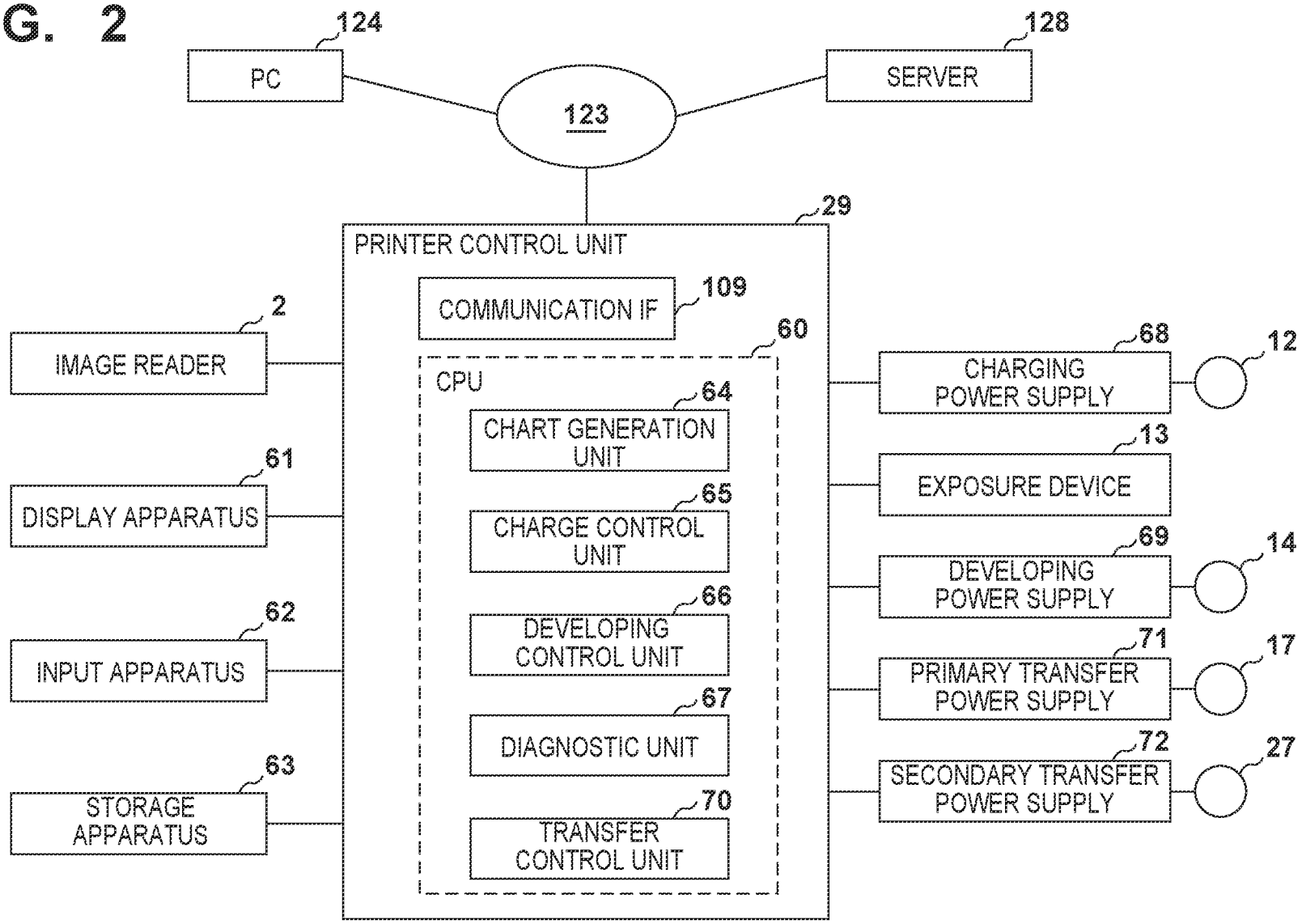
FIG. 2 is a view illustrating a control system.

FIG. 2 illustrates a control system of the image forming apparatus 1. The image forming apparatus 1 is connected to a network device such as a PC 124 or a server 128 via a network 123. PC is an abbreviation for personal computer. The server 128 is a computer, a mail server or the like of a service company that is responsible for the maintenance of the image forming apparatus 1, for example. The printer control unit 29 is a controller that controls the image reader 2 and the printer 3. The printer control unit 29 may be divided into a printer controller responsible for image processing or the like, and an engine control unit for controlling the image forming unit 10 or the like. A communication IF 109 is a communication circuit that, for example, receives print data from a PC 124 or the like, and transmits information from the image forming apparatus 1 to the PC 124 or a server 128. IF is an abbreviation of interface. A CPU 60 is a control circuit and a computation circuit that comprehensively controls each unit of the image forming apparatus 1. The CPU 60 realizes various functions by executing control programs stored in a storage apparatus 63. Note that some or all of the functions of the CPU 60 may be realized by hardware such as an ASIC, an FPGA or the like. ASIC is an abbreviation of application specific integrated circuit. FPGA is an abbreviation of field-programmable gate array. A display apparatus 61 is provided with a liquid crystal screen for displaying various information. An input apparatus 62 is provided with a numeric keypad or a button for the input of a command. The storage apparatus 63 is a memory such as a ROM or a RAM, and encompasses a high-capacity storage apparatus such as a hard disk drive. The CPU 60 converts image data transferred from the image reader 2 or the like to the image data that can be printed by the printer 3. The CPU 60 further executes a tone correction. A tone correction is processing for converting an image signal value included in the image data based on a lookup table, so that tone characteristics of an image to be formed by a printer engine become ideal tone characteristics. Next, the CPU 60 generates, based on the image data on which the tone correction has been executed, a laser control signal for controlling a laser beam emitted from the exposure device 13, and outputs the laser control signal to the exposure device 13.

The CPU 60 realizes various functions, but description is given regarding representative functions here. A chart generation unit 64 controls the printer 3 to form a test image for identifying a replacement part (a fault location) on a sheet P. A test image itself or a sheet P onto which the test image has been formed is referred to as a test chart. A charge control unit 65 controls a charging voltage to be applied to the charging device 12 from a charging power supply 68. A developing control unit 66 controls a developing voltage to be applied to the developing device 14 from a developing power supply 69. A transfer control unit 70 controls a primary transfer voltage to be applied to the primary transfer device 17 from a primary transfer power supply 71, and a secondary transfer voltage to be applied to the secondary transfer device 27 from a secondary transfer power supply 72. A diagnostic unit 67 obtains a read result (read data) of a test chart from a reading apparatus connected to the image reader 2 or the image forming apparatus 1, and selects a replacement part based on the read data. In addition, configuration may be taken such that the image forming apparatus 1 transfers the read data of the test chart read by the image reader 2 to the server 128 through the communication IF 109, and the replacement part (the fault location) is decided in the server 128. With this configuration, the diagnostic unit 67 may be omitted. Note that the diagnostic unit 67 may also be omitted in a case where a user or a service person visually observes the test chart to identify a replacement part (a fault location).

[Test Chart]

When a timing at which a replacement part should be replaced is reached, a vertical streak may occur in an output image. Also, when a fault occurs in a replacement part, a vertical streak may occur in an output image. A vertical streak is an image of a straight line form that extends in parallel to a conveyance direction of the sheet P. If a fault occurs in the belt cleaner 35, toner that should be removed by the belt cleaner 35 slips past a fault location of the belt cleaner 35, and is transferred to the sheet P at the secondary transfer nip portion N2. By this, a vertical streak appears on the sheet P. Even if a fault occurs in the drum cleaner 15, toner that should be removed by the drum cleaner 15 similarly slips past a fault location of the drum cleaner 15, and is transferred to the sheet P, and a vertical streak appears on the sheet P. However, if the cause for the occurrence of a vertical streak is a fault of the belt cleaner 35 or the drum cleaner 15, a vertical streak does not necessarily occur each time an output image is formed on a sheet P. If a state where a large amount of toner has been recovered by the belt cleaner 35 and the drum cleaner 15 has not been entered, only a very small amount of toner will slip past the belt cleaner 35 or the drum cleaner 15. Accordingly, a vertical streak only occurs on output images for a few pages after an image for detection that is not transferred to a sheet P is formed, or after a high density image which consumes a large amount of toner is formed. Consequently, even if there is a cause for the occurrence of a vertical streak in the belt cleaner 35 or the drum cleaner 15, if sufficient toner has not been supplied to the belt cleaner 35 and the drum cleaner 15, a vertical streak will not be apparent on a test chart. Accordingly, a method for controlling the image forming apparatus 1 in order to determine whether the belt cleaner 35 or the drum cleaner 15 should be replaced is proposed. In particular, the image forming apparatus 1 is controlled to make it easier for a vertical streak due to the belt cleaner 35 or the drum cleaner 15 to be apparent on a test chart. A replacement part (a fault location) is identified by a user or a service person visually observing this test chart, or by causing the image reader 2 to read this test chart.

In addition, the test chart may include a plurality of pattern images (hereinafter recited as analog patterns) that each have a respectively different charging potential for the image carrier, and are formed without exposure being applied. By this, it is possible to distinguish whether to replace an exposure device 13, a developing device 14, and a charging device 12, in addition to the belt cleaner 35 or a drum cleaner 15.

An A4 size (a widthwise length of 297 mm, and a conveyance-direction length of 210 mm) is employed as the size of a test chart, but this is merely an example. When a maximum feedable size for the image forming apparatus 1 is selected, for example, it should also be possible to detect a streak that occurs at an end portion in the X direction at the charging device 12 or the developing device 14. In this way, if the maximum size sheet that can be printed in the image forming apparatus 1 is employed, it should be possible to identify the replacement part with good accuracy. Note that a number of sheets for a test chart may be one or a plurality. Various types of test charts are exemplified in the present embodiment, but it is not the case that all of them are always necessary. In other words, a user or a maintenance person will increase or decrease the number of test charts in accordance with types of replacement part for which identification is desired.

Figure 3:
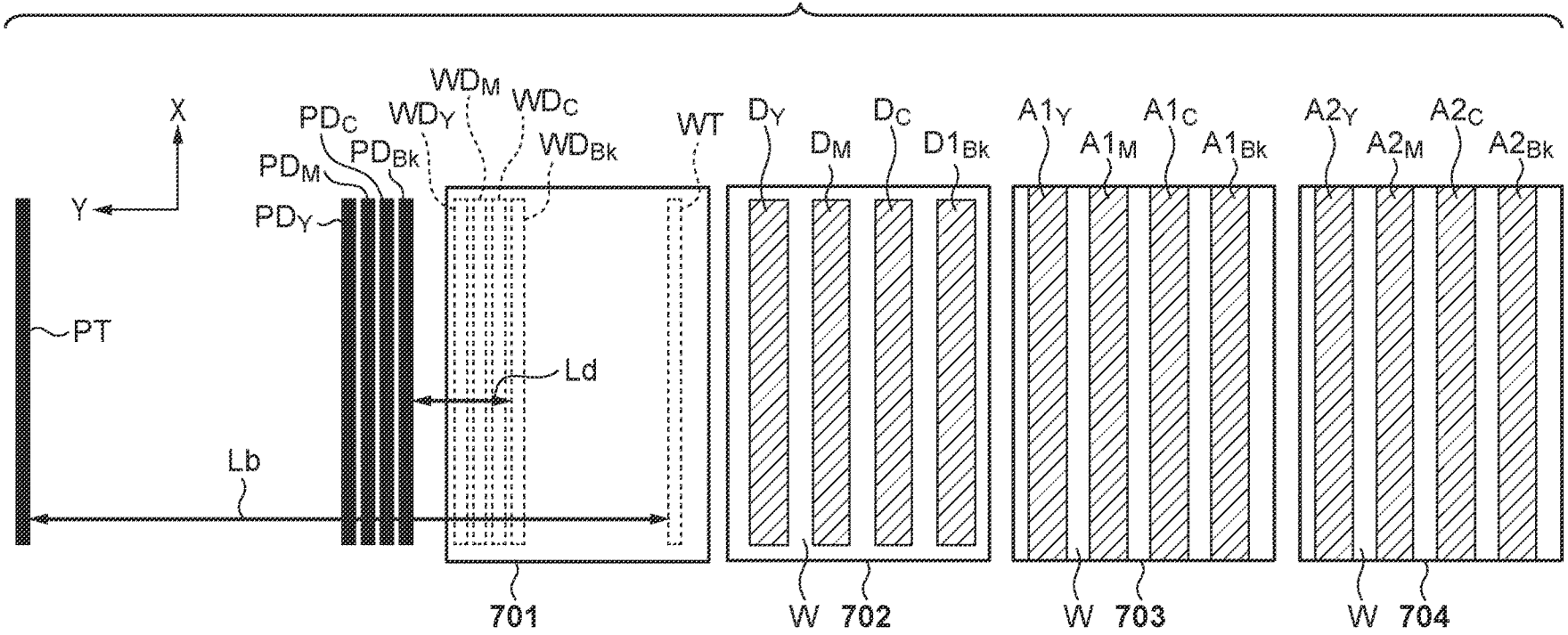
FIG. 3 is a view illustrating a test chart in a first embodiment.

FIG. 3 illustrates exemplary test charts 701 to 704. An arrow Y illustrates a conveyance direction (a Y direction) of a toner image. Note that the arrow Y is also the conveyance direction of the sheet P. An arrow X indicates a direction (an X direction) that is orthogonal to the conveyance direction. The size of each of the test charts 701 to 704 is the A4 size. The test chart 701 is a test chart used to determine the necessity of replacement of the belt cleaner 35 or a drum cleaner 15. The test chart 701 includes blank portions WD and WT where a pattern image is not formed. The blank portion WD is a region where a streak for determining the necessity of replacement of a drum cleaner 15 can occur. The CPU 60 forms a toner patch PD by the printer 3 so that a streak becomes apparent in the blank portion WD when a drum cleaner 15 should be replaced. The CPU 60 controls conveyance of the test chart 701 by the registration roller pair 26 so that a timing when a toner patch PD which has slipped past a drum cleaner 15 passes through the secondary transfer nip portion N2 overlaps with a timing when the test chart 701 passes through the secondary transfer nip portion N2. For example, the CPU 60 controls a timing when the registration roller pair 26 starts conveying the test chart 701 to the secondary transfer nip portion N2 so that the timings previously described overlap. In addition, for example, the CPU 60 controls the conveyance speed of the test chart 701 by the registration roller pair 26 so that the timings previously described overlap. A formation location of the toner patch PD is separated by one circumferential length Ld of the photosensitive drum 11 from a position where the blank portion WD of the test chart 701 contacts the intermediate transfer belt 31 at the secondary transfer nip portion N2, for example. The photosensitive drum 11 conveys a toner image by rotating in the arrow direction illustrated by FIG. 1. Accordingly, the toner patch PD is formed on the photosensitive drum 11 at the n-th rotation of the photosensitive drum 11, and a toner image is not formed on a region on the photosensitive drum 11 corresponding to the blank portion WD at an n+1-th rotation. In other words, the position of the toner patch PD on the photosensitive drum 11 and the position of the blank portion WD match.

The blank portion WT is a region where a streak for determining the necessity of replacement of the belt cleaner 35 can occur. The CPU 60 forms a toner patch PT by the printer 3 so that a streak becomes apparent in the blank portion WT when the belt cleaner 35 should be replaced. The CPU 60 controls conveyance of the test chart 701 by the registration roller pair 26 so that a timing when the toner patch PT which has slipped past the belt cleaner 35 passes through the secondary transfer nip portion N2 overlaps with a timing when the test chart 701 passes through the secondary transfer nip portion N2. For example, the CPU 60 controls a timing when the registration roller pair 26 starts conveying the test chart 701 to the secondary transfer nip portion N2 so that the timings previously described overlap. In addition, for example, the CPU 60 controls the conveyance speed of the test chart 701 by the registration roller pair 26 so that the timings previously described overlap. A formation location of the toner patch PT is separated by one circumferential length Lb of the intermediate transfer belt 31 from a position where the blank portion WT of the test chart 701 contacts the intermediate transfer belt 31 at the secondary transfer nip portion N2, for example. The intermediate transfer belt 31 conveys a toner image by rotating in the arrow direction illustrated by FIG. 1. Accordingly, the toner patch PT is formed on the intermediate transfer belt 31 at the n'-th rotation of the intermediate transfer belt 31, and a toner image is not formed on a region on the intermediate transfer belt 31 corresponding to the blank portion WT at an n'+1-th rotation. In other words, the position of the toner patch PT on the intermediate transfer belt 31 and the position of the blank portion WT match. Note that, in a case of using one test chart 701 to determine a fault of a drum cleaner 15 or the belt cleaner 35, a relationship between a formation position of a toner pattern PT and the formation position of a toner pattern PD is as illustrated by FIG. 3. In FIG. 3, the X direction indicates a direction orthogonal to sheet conveyance direction, and the Y direction indicates sheet conveyance direction.

Y, M, C, and Bk letters added to the end of a reference sign in the drawing indicate a color of toner used to form a toner patch PD used to determine whether to replace a drum cleaner 15. Here, the color of toner used when forming a toner patch PD is a monochrome (one color out of Y, M, C, and Bk). This is to identify what color station the part that should be replaced is in. For example, if a yellow streak is formed in a blank portion $WD_Y$, it is ascertained that replacement of the drum cleaner 15 in the station for yellow is necessary.

A length in the conveyance direction of the toner patch PT and the toner patch PD for each color is 10 mm, for example. If the length in the conveyance direction is 10 mm or more, it becomes possible to detect a vertical streak in a blank portion. Note that an external diameter of the photosensitive drum 11 is 30 mm, and its outer circumference (circumferential length) is approximately 94.2 mm. When the length in the conveyance direction of the toner patch is too long, the toner patches PD (the blank portions WD) for the four colors of Y, M, C, and Bk on the test chart 701 overlap. For example, when a blank portion $WD_Y$ and a blank portion $WD_M$ overlap, a yellow vertical streak and a magenta vertical streak overlap, and it can become difficult to determine at a glance for which color to replace the drum cleaner 15. Accordingly, configuration may be taken to decide the length and formation positions of the toner patches PD for the four colors Y, M, C, and Bk so that the blank portions WD for the four colors do not overlap.

Configuration may be taken such that the blank portion WT and the blank portions WD are not blank portions where a pattern image is not formed. In other words, a pattern image may be formed on the blank portion WT and the blank portions WD. However, when a pattern image is formed on the blank portion WT and the blank portions WD, a streak detection capability can decrease because a luminance difference between a background and a vertical streak decreases. Accordingly, the streak detection capability should be satisfactory if a pattern image is not formed in the blank portion WT and the blank portions WD. In addition, a toner consumption amount should be reduced.

A length in the X direction of the blank portion WT (the toner patch PT) and the blank portions WD (the toner patches PD) may be a maximum length of a toner image that can be formed by the image forming apparatus 1. However, in the present embodiment, an image forming method shared with a digital pattern D is used to form the toner patches PT and PD. Accordingly, the length in the X direction of the toner patches PT and PD is the same as the length in the X direction of the digital pattern D. There is no need for the blank portion WT and the blank portions WD to be formed on the same sheet. In addition, there is no need for both of the blank portion WT and the blank portions WD to always be formed. For example, in a case of wanting to know whether to replace the belt cleaner 35, it is sufficient if the blank portion WT is formed on the test chart 701. In a case of wanting to know whether to replace the drum cleaner 15 for yellow toner, it is sufficient if the blank portion $WD_Y$ is formed on the test chart 701.

Next, in the present embodiment, description is given for the test charts 702 to 704, which are for identifying a replacement part other than the belt cleaner 35 or the drum cleaner 15. The test charts 702 to 704 include digital patterns D and analog patterns A1 and A2. The digital patterns D are toner images formed by the application of exposure. The analog patterns A1 are toner images formed with a first charging potential being applied and without exposure being applied. The analog patterns A2 are toner images formed with a second charging potential different to first charging potential being applied and without exposure being applied. Blank portions W are also formed in the test charts 702 to 704. Y, M, C, and Bk added to the end of a reference sign indicates the color of toner used to form a respective pattern. The color of toner used when a respective pattern is formed is a monochrome, and is one color from Y, M, C, and Bk. This is to identify what color station the part that should be replaced is in. For example, if a yellow streak is found, a part related to yellow is identified as a replacement part (a fault location). The length in the conveyance direction of each pattern is 30 mm, for example. This is because, if the length of a pattern is 30 mm or more, detection of a vertical streak in a region where a pattern image is formed is possible.

The length in the X direction of a digital pattern D is slightly shorter than the length of the entire region in which formation by the image forming apparatus 1 is possible, and a margin region is provided at both ends in the X direction of the digital pattern D. However, the length in the X direction of the analog patterns A1 and the analog patterns A2 is the same as the length in the X direction of a sheet P, and a margin is not formed.

The four digital patterns D illustrated by FIG. 3 are exposure images (toner images) formed by being exposed by the exposure device 13. An analog pattern A1 is a non-exposure image (toner image) formed by the charging potential of the photosensitive drum 11 by the charging device 12 being set to a first charging potential, without exposure by the exposure device 13 being executed. An analog pattern A2 is a non-exposure image (a toner image) formed by the charging potential of the photosensitive drum 11 being set to a second charging potential that is sufficiently lower than the first charging potential by the charging device 12, without exposure by the exposure device 13 being executed. The second charging potential may be substantially 0 [V]. Note that the terms "high" and "low" here mean high or low potential in absolute value. The manner in which a streak caused by the charging device 12 and a streak caused by the developing device 14 appear differs between the analog patterns A1 and the analog patterns A2. That is, if a streak occurring in an analog pattern A1 and a streak occurring in an analog pattern A2 are compared, it is possible to distinguish whether the cause of the streak is in the charging device 12 or the developing device 14.

Figure 4:
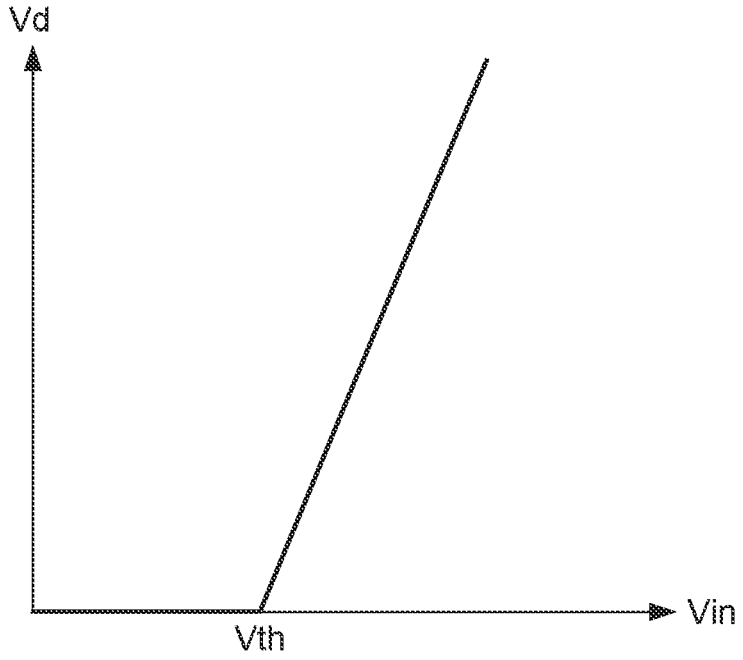
FIG. 4 is a view illustrating the relationship between a charging voltage of a charging device and a charging potential of a photosensitive drum.

Here, using FIG. 4, description is given for a method for forming an image without performing charge processing by the charging device 12. FIG. 4 illustrates a relationship between an applied voltage Vin in the contact charging method, and a charging potential Vd of the photosensitive drum 11. When the charge control unit 65 sets the applied voltage Vin to apply to the charging member of the charging device 12 to less than or equal to a discharge start voltage Vth, the charging potential Vd of the photosensitive drum 11 becomes substantially 0 [V]. In this way, by setting the applied voltage Vin to a voltage (for example, 0 [V]) that is less than or equal to the discharge start voltage Vth (for example, 400 [V]), the charging potential of the photosensitive drum 11 is controlled to substantially 0 [V].

The charge of the front surface of the photosensitive drum 11 may be removed in order to further reduce the effect of the charging device 12 on the analog patterns A2. For example, light emission for destaticization from a pre-exposure light source in relation to the front surface of the photosensitive drum 11 which is cleaned by the drum cleaner 15 may be performed. Configuration may be taken such that processing for charging the photosensitive drum 11 ceases to be applied by controlling the charging power supply 68 so that the charge control unit 65 does not distribute current to the metal wire in a case where the non-contact charging method is used.

Figure 5A:
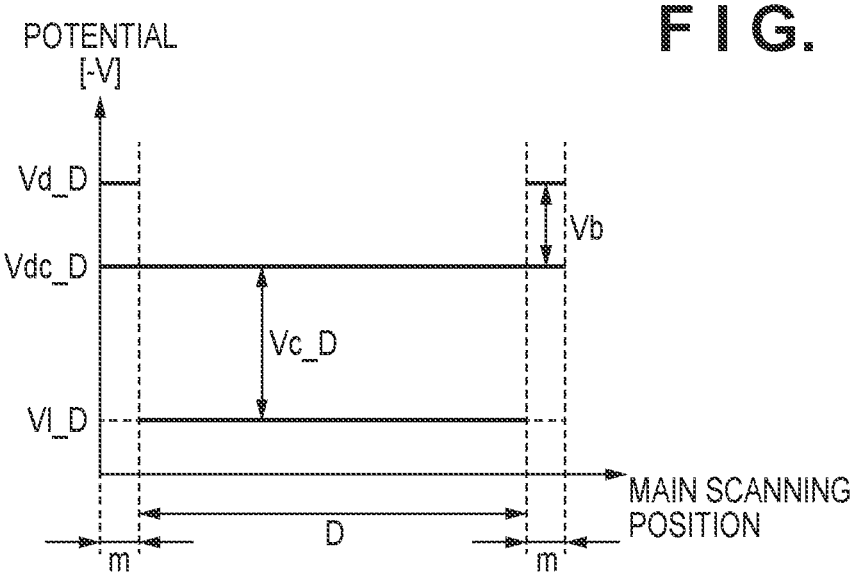
FIGS. 5A to 5F are views illustrating a relationship among streaks, charging potential, and developing potential.
Figure 5B:
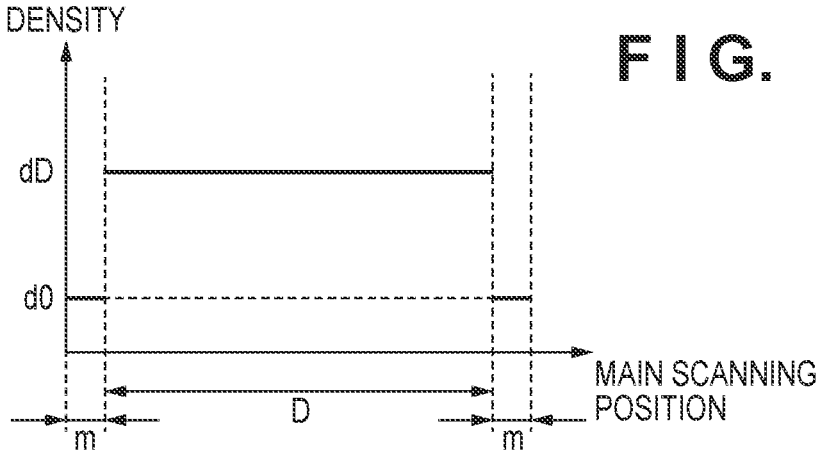

FIG. 5A illustrates potentials at positions in the X direction on the photosensitive drum 11 which is charged by the charging device 12, when forming a digital pattern D. FIG. 5B illustrates a density dD of a digital pattern D formed on a sheet P, and a density d0 of a blank portion W. The density d0 is an optical density of an undercolor (white background) of the sheet P.

The charge control unit 65 causes the charging device 12 to charge the photosensitive drum 11 by controlling the charging power supply 68 so that the charging potential on the surface of the photosensitive drum 11 becomes Vd_D. The exposure device 13 exposes the front surface of the photosensitive drum 11 in accordance with the image data generated by the chart generation unit 64. The result of this is that the potential of the part that is exposed in the surface of the photosensitive drum 11 changes to V1_D. The developing control unit 66 controls the developing power supply 69 so that the potential of the developing sleeve of the developing device 14 becomes a direct current potential Vdc_D which is a developing bias. Vdc_D is set between the charging potential Vd_D and the potential V1_D of the exposure unit. The margin m arranged on both ends of the digital pattern D is not exposed. Therefore, the potential of the margin m is maintained at Vd_D. In this way, a fog removal voltage Vb is formed at a margin m which is a non-exposed portion. Toner does not adhere to the margin m by the fog removal voltage Vb. The image signal value of the digital pattern D is set to 50%. This corresponds to an image for an optical density of 0.6 (in other words, dD=0.6). For a halftone pattern, detection accuracy of a vertical streak increases in comparison to a solid pattern.

Figure 5C:
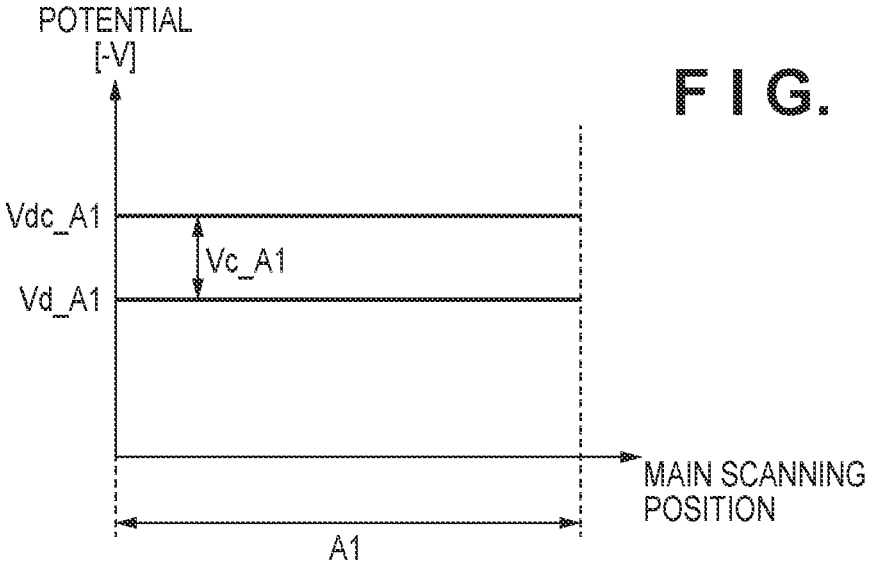
Figure 5D:
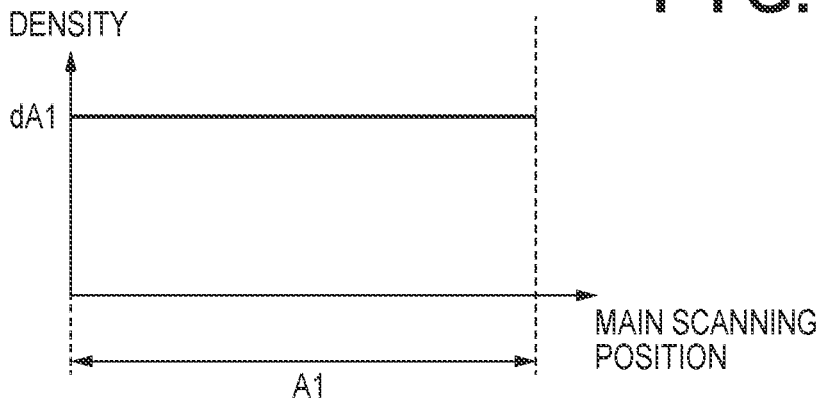

FIG. 5C illustrates potentials at positions in the X direction on the photosensitive drum 11 which is charged by the charging device 12, when forming a first analog pattern A1. FIG. 5D illustrates a density dA1 of an analog pattern A1 which is formed on a sheet P. The charge control unit 65 adjusts the potential of the surface of the photosensitive drum 11 to a charging potential Vd_A1 by controlling the charging power supply 68 in accordance with an instruction from the chart generation unit 64 so as to form the analog pattern A1. The developing control unit 66 adjusts the potential of the developing sleeve of the developing device 14 to the developing bias Vdc_A1 by controlling the developing power supply 69 in accordance with an instruction from the chart generation unit 64. The developing bias Vdc_A1 is a developing potential that is higher than the charging potential Vd_A1. Note that the chart generation unit 64 does not cause the exposure device 13 to emit a laser beam. With this, a developing voltage Vc_A1 occurs as a potential difference between the photosensitive drum 11 and the developing sleeve. That is, an electrostatic latent image corresponding to the analog pattern A1 is formed, and a toner image is formed on the photosensitive drum 11 by the toner supplied from the developing device 14. As illustrated by FIG. 5C, because exposure is not applied for an analog pattern A1, a constant developing voltage Vc_A1 is formed regardless of a position in the X direction. Accordingly, the margins are not formed on the two ends of the analog pattern A1. Also, it is impossible to perform halftone processing because exposure is not applied. Accordingly, in the present embodiment, the developing control unit 66 adjusts the developing voltage Vc_A1 by controlling the developing power supply 69 so that the optical density of a respective color of the analog pattern A1 becomes 0.6. As indicated by FIG. 5D, an analog pattern A1 with the optical density dA1 (=0.6) is formed on a sheet P.

Figure 5E:
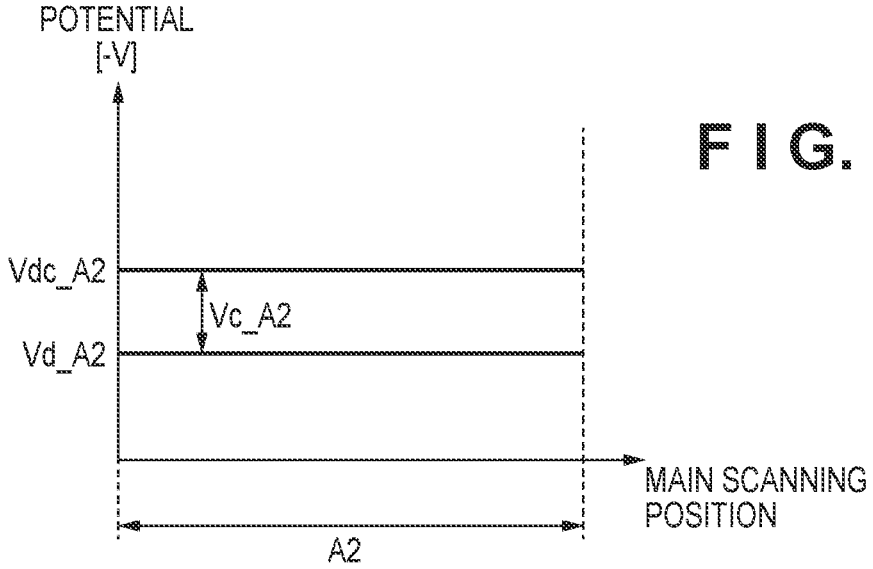
Figure 5F:
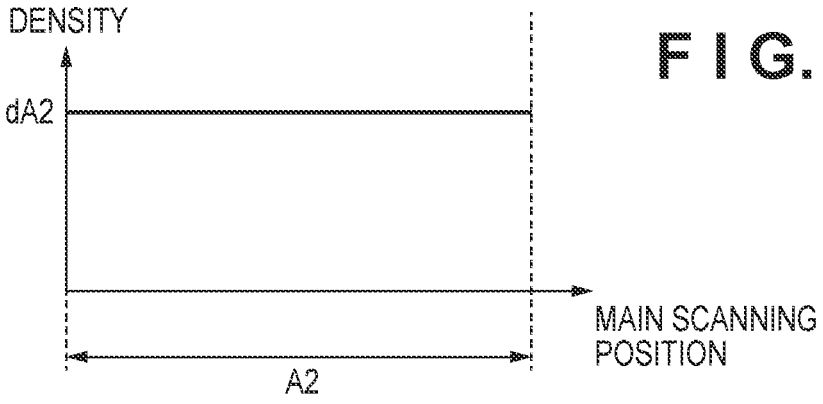

FIG. 5E illustrates potentials at positions in the X direction on the photosensitive drum 11 which is charged by the charging device 12, when forming a second analog pattern A2. FIG. 5F illustrates a density dA2 of an analog pattern A2 which is formed on a sheet P. In order to form the analog pattern A2, the charge control unit 65 controls the charging power supply 68 in accordance with an instruction from the chart generation unit 64. With this, the potential of the surface of the photosensitive drum 11 is adjusted to a charging potential Vd_A2 (for example, substantially 0 [V]). The developing control unit 66 controls the developing power supply 69 in accordance with an instruction from the chart generation unit 64. With this, the potential of the developing sleeve of the developing device 14 is adjusted to a developing bias Vdc_A2. The developing bias Vdc_A2 is a potential that is higher than the charging potential Vd_A2. Note that the chart generation unit 64 does not cause the exposure device 13 to emit a laser beam. By this, a developing voltage Vc_A2 is formed between the photosensitive drum 11 and the developing sleeve. That is, an electrostatic latent image corresponding to the analog pattern A2 is formed, and a toner image is formed on the photosensitive drum 11 by the toner supplied from the developing device 14. As illustrated by FIG. 5E, because exposure is not applied for an analog pattern A2, a constant developing voltage Vc_A2 is formed regardless of a position in the X direction. Accordingly, the margins are not formed on both ends of the analog pattern A2. Also, it is impossible to perform halftone processing because exposure is not applied. Accordingly, in the present embodiment, the developing control unit 66 adjusts the developing voltage Vc_A2 by controlling the developing power supply 69 so that the optical density of each color of the analog pattern A2 becomes 0.6. As indicated by FIG. 5F, an analog pattern A2 with the optical density dA2 (=0.6) is formed on a sheet P.

Here, a second charging potential Vd_A2 (for example, substantially 0 [V]) for forming an analog pattern A2 is set lower than the charging potential Vd_A1 for forming an analog pattern A1 (|Vd_A1|>|Vd_A2|). As a result, in the analog pattern A2, a contribution rate of the charging device 12 to the image defect decreases in comparison to that for the analog pattern A1. Note that the developing control unit 66 adjusts the developing voltage Vc_A2 to be the same as the developing voltage Vc_A1 by controlling the developing power supply 69. By this, the optical density of each color of the analog pattern A2 becomes 0.6.

In the present embodiment, the developing voltage Vc_A1 of the analog pattern A1 and the developing voltage Vc_A2 of the analog patterns A2 are adjusted to be respectively equal. By this, the optical density of the analog pattern A1 becomes equal to the optical density of the analog patterns A2. However, the developing voltage Vc_A1 of the analog patterns A1 may be different to the developing voltage Vc_A2 of the analog patterns A2.

Note that if the non-contact charging method is used, the charging potential of the photosensitive drum 11 is adjusted by changing the amount of current that the charging power supply 68 distributes to the metal wire. By this, the analog pattern A1 and the analog pattern A2 are formed by a non-contact charging method as well.

As an example, description was given regarding a case where the optical density of the digital patterns D matches the optical density of the two types of analog patterns A1 and A2 (dD=dA1=dA2). However, there is no need to have the optical density of the digital patterns D match the optical density of the two types of analog patterns A1 and A2. If these densities are not made to match, with respect to streaks having different densities, it is necessary to correct the difference in density and compare the extent of the streaks.

[Method for Forming a Toner Patch for Making a Streak Due to a Cleaner Apparent]

Figure 6:
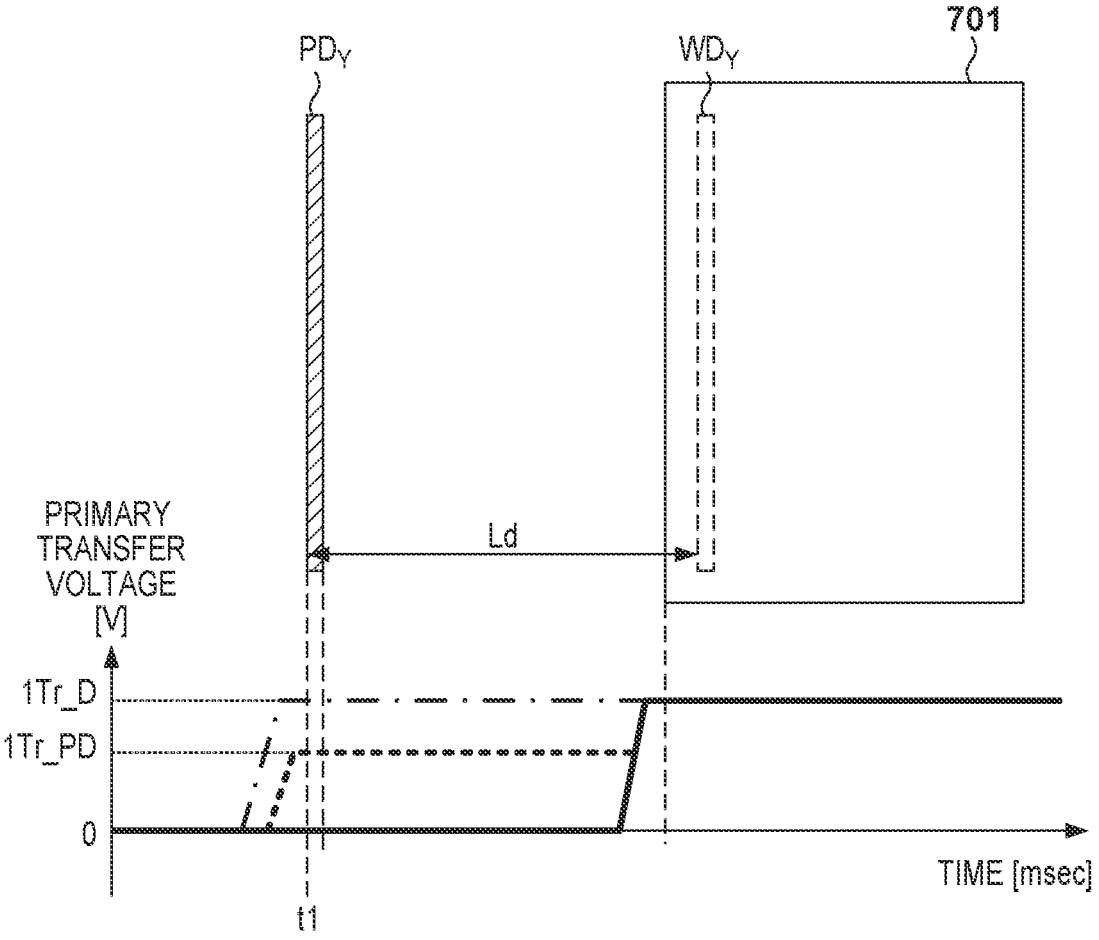
FIG. 6 is a view illustrating a toner patch for making a cleaner defect be apparent.

As illustrated by FIG. 6, a distance between a toner patch PD and a blank portion WD matches one circumferential length Ld of the photosensitive drum 11. The toner patch PD is formed on the photosensitive drum 11 at a timing that is a predetermined amount of time before a timing for forming the blank portion WD. The predetermined amount of time is an amount of time necessary for the photosensitive drum 11 to rotate once. The toner patch PD may be a digital pattern formed by setting an image signal value to 100%. The image signal value is a signal for deciding an optical density of a toner image, and the optical density of the toner image becomes a maximum value when the image signal value is set to 100%. The maximum value is a maximum value in an optical density range of a toner image that can be formed by the image forming apparatus 1. By this, the largest amount of toner will be supplied to the drum cleaner 15, and it will be easier for a streak to be apparent. In this way, the larger the amount of toner supplied to the drum cleaner 15 in accordance with the toner patch PD, the more advantageous it is for detection of a defect of the drum cleaner 15. However, when a toner patch PD is supplied in excess, an excess load will be put on the drum cleaner 15. In addition, a minor defect that should be intentionally overlooked will be detected. Accordingly, an image signal value for forming the toner patch PD may be set lower than 100%.

In the sequence illustrated by FIG. 6, a time t1 is a timing when a region in which the toner patch PD is formed first passes by the primary transfer device 17. In other words, the time t1 is a timing when the leading edge of the toner patch PD goes into the primary transfer nip portion N1. By adjusting a primary transfer voltage 1Tr_PD at this time, an amount of toner supplied to the drum cleaner 15 in accordance with the toner patch PD is controlled.

FIG. 7A illustrates a relationship between a toner amount supplied to the drum cleaner 15 in accordance with the toner patch PD, and a primary transfer voltage 1Tr. In the case of the primary transfer voltage 1Tr_D [V] indicated by a dashed-dotted line in FIG. 6, the toner amount is small. The primary transfer voltage 1Tr_D is a primary transfer voltage that is used in normal image forming. The primary transfer voltage indicated by a solid line in FIG. 6 is 0 [V], but in such a case the toner amount becomes large. 0 [V] is a primary transfer voltage used for a time of jam processing. In the case of the primary transfer voltage 1Tr_PD [V] indicated by a dotted line in FIG. 6, an amount of toner TnPD supplied to the drum cleaner 15 is a value between TnD and Tn0.

Accordingly, a primary transfer voltage for when the toner patch PD first passes through the primary transfer nip portion N1 is controlled to 0 [V] which is a first primary transfer voltage. By this, the toner patch PD remains on the photosensitive drum 11 without being transferred to the intermediate transfer belt 31, and is conveyed to the drum cleaner 15.

Accordingly, a primary transfer voltage for when the toner patch PD passes through the primary transfer nip portion N1 for a second time is controlled to 1Tr_D which is a second primary transfer voltage. By this, from out of the toner patch PD that remained on the photosensitive drum 11, a streak of toner that was not removed by the drum cleaner 15 is transferred to the intermediate transfer belt 31.

In this way, when the toner patch PD first passes through the primary transfer nip portion N1, a first voltage is set as the primary transfer voltage for suppressing transfer of the toner patch PD from the photosensitive drum 11 to the intermediate transfer belt 31. In addition, when the toner patch PD passes through the primary transfer nip portion N1 a second time, the primary transfer voltage is set to a second voltage so that a streak due to a drum cleaning defect is transferred from the photosensitive drum 11 to the intermediate transfer belt 31. In the present embodiment, when a region on the photosensitive drum 11, corresponding to the test chart 701, passes by the primary transfer device 17, the transfer control unit 70 sets the primary transfer voltage to 1Tr_D. By this, it becomes easier for a vertical streak to be transferred to a blank portion WD of the test chart 701 via the intermediate transfer belt 31.

Figure 8:
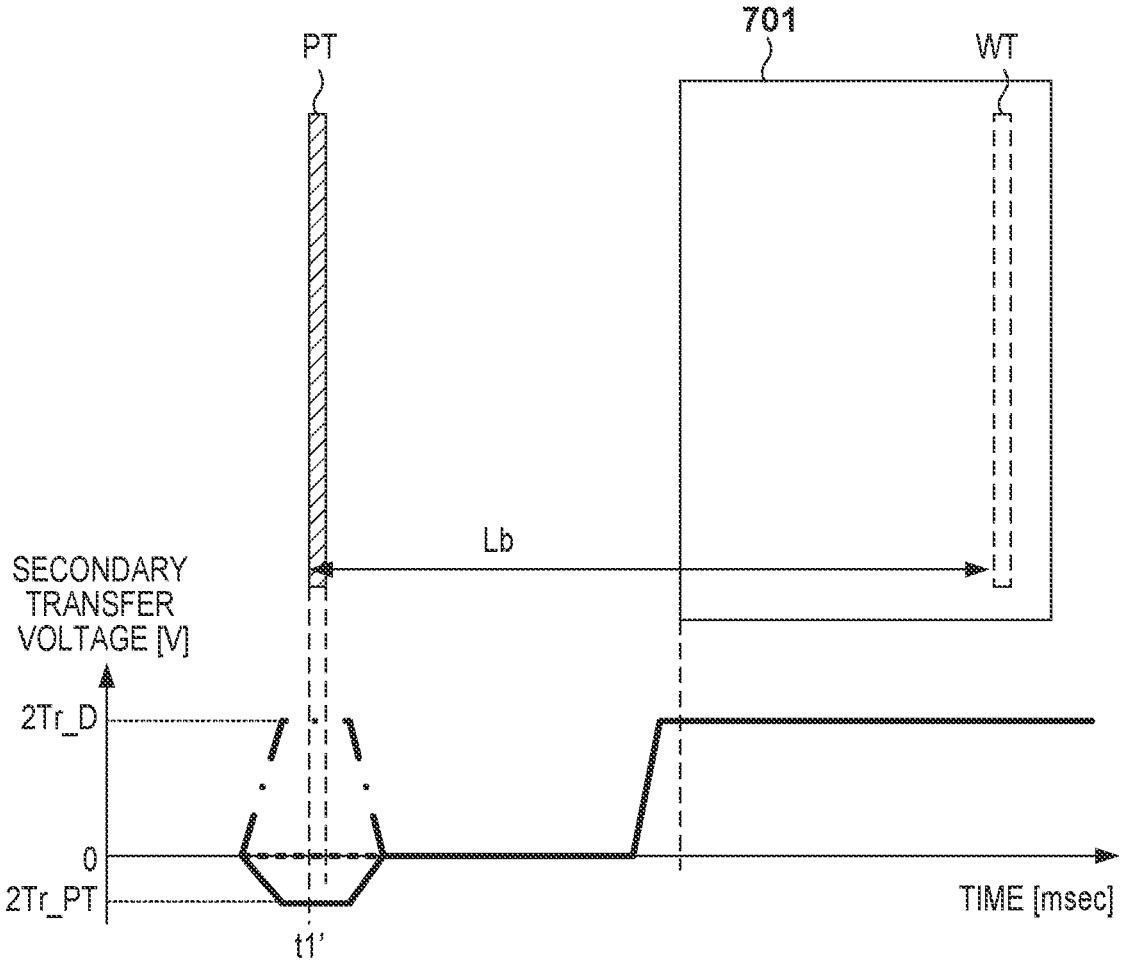
FIG. 8 is a view illustrating a toner patch for making a cleaner defect be apparent.

As illustrated by FIG. 8, a distance between a toner patch PT and a blank portion WT matches one circumferential length Lb of the intermediate transfer belt 31. The toner patch PT is formed on the photosensitive drum 11 at a timing that is a predetermined amount of time before a timing for forming the blank portion WT. The predetermined amount of time is an amount of time necessary for the intermediate transfer belt 31 to rotate once. The color of the toner patch PT is a mixed color. In other words, the toner patch PT is formed by mixing two or more colors from out of the toner colors of Y, M, C, and Bk. The chart generation unit 64 selects an image signal value corresponding to a maximum value of the toner amount for the mixed color, and forms a toner patch PT as a digital pattern. In the present embodiment, the chart generation unit 64 sets an image signal value for yellow to 100% and sets an image signal value for magenta to 100%. By this, a red toner patch PT is formed on the intermediate transfer belt 31. In this way, the larger the amount of toner supplied to the belt cleaner 35 in accordance with the toner patch PT, the more advantageous it is for detection of a defect of the belt cleaner 35. However, when toner is supplied in excess to the belt cleaner 35, an excess load is applied on the belt cleaner 35. In addition, a minor defect that should be intentionally overlooked will be detected. Accordingly, an image signal value for a corresponding toner color for forming the toner patch PT may be set lower than 100%.

In FIG. 8, the amount of toner supplied to the belt cleaner 35 in accordance with the toner patch PT can be controlled, depending on the secondary transfer voltage at a time t1' when the toner patch PT starts passing by the secondary transfer device 27. The time t1' is a timing when a predetermined region on the intermediate transfer belt 31 where the toner patch PT is formed first passes by the secondary transfer device 27. In other words, the time t1' is a timing when the toner patch PT first passes through the secondary transfer nip portion N2. A blank portion WT is formed on the sheet P at a timing when this predetermined region (the toner patch PT) passes by the secondary transfer device 27 for a second time.

FIG. 7B illustrates a relation between a toner amount of the toner patch PT which is supplied to the belt cleaner 35, and a secondary transfer voltage 2Tr. In a case where the secondary transfer voltage is set to the 2Tr_D [V] indicated by a dashed-dotted line in FIG. 8, the toner amount is small. 2Tr_D is a secondary transfer voltage that is used in normal image forming. As illustrated by solid lines in FIG. 8, the secondary transfer voltage may be set to 2Tr_PT [V]. In such a case, the toner amount supplied to the belt cleaner 35 becomes large. 2Tr_PT is a secondary transfer voltage used for a time of jam processing.

Accordingly, a secondary transfer voltage for when the toner patch PT first passes through the secondary transfer nip portion N2 is controlled to 2Tr_PT which is a first secondary transfer voltage. By this, it becomes difficult for the toner patch PT to adhere to the secondary transfer device 27, and the toner patch PT remains on the intermediate transfer belt 31.

A secondary transfer voltage for when the toner patch PT passes through the secondary transfer nip portion N2 for a second time is controlled to 2Tr_PT which is a second secondary transfer voltage. By this, toner that was not removed by the belt cleaner 35 becomes a streak-shaped toner image, and is transferred to a sheet.

In this way, when the toner patch PT first passes through the secondary transfer nip portion N2, the first secondary transfer voltage (2Tr_PT) is set as the secondary transfer voltage. The first secondary transfer voltage (2Tr_PT) is a voltage for suppressing transfer of the toner patch PT from the intermediate transfer belt 31 to a sheet. When the toner patch PT passes through the secondary transfer nip portion N2 for the second time, the second secondary transfer voltage (2Tr_D) is set as the secondary transfer voltage. The second secondary transfer voltage (2Tr_D) is a voltage for a streak due to a belt cleaning defect to be transferred from the intermediate transfer belt 31 to a sheet. In other words, it becomes easier for a vertical streak to be transferred to the blank portion WT of the test chart 701. A secondary transfer portion is a nip portion (the secondary transfer nip portion N2) between the secondary transfer device 27 and the intermediate transfer belt 31.

[Vertical Streak]

Using FIG. 9, description is given for a vertical streak which is one image error that occurs in the image forming apparatus 1 of the present embodiment. FIG. 9 indicates vertical streak types, replacement parts or response methods, blank portion states, and colors of patterns where a streak occurs. Furthermore, FIG. 9 indicates whether a streak occurred for each digital pattern and analog pattern, and indicates that a streak due to a charge defect does not occur in the analog patterns A2 which are formed without charge processing being applied. Note that a streak for which the density has become lower than in a normal portion where there is no streak is called a white streak. The streak for which the density has become higher than a normal portion is called a black streak.

A Streak Due to a Developing Coat Defect

Figure 10A:
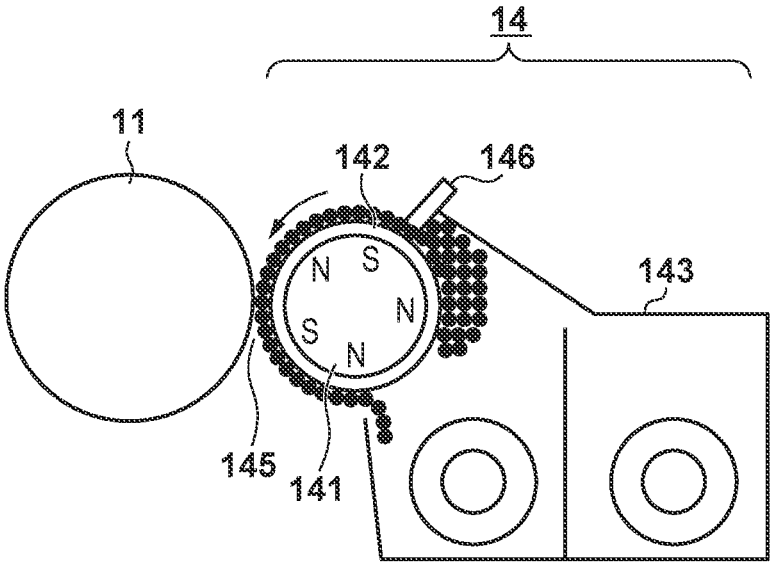
FIGS. 10A to 10C are views for illustrating defects of developing coats.
Figure 10B:
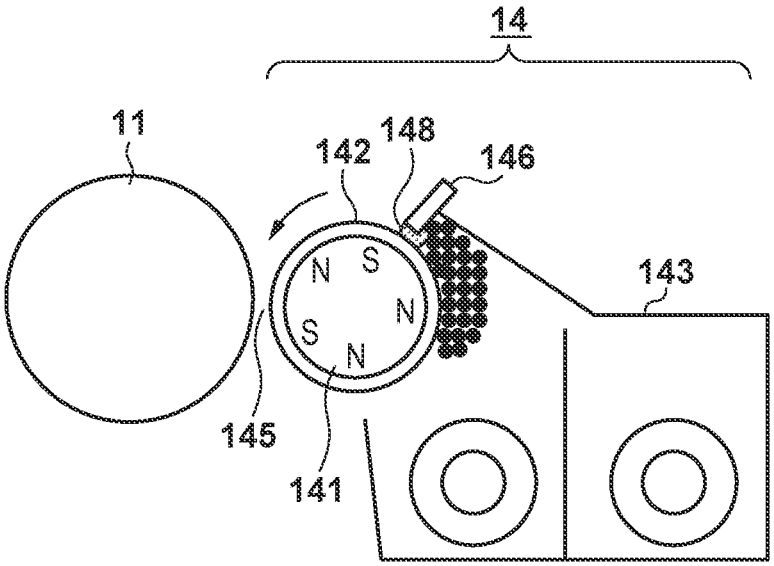

A developing coat defect streak indicated by FIG. 9 is a vertical streak that occurs due to an insufficient developing coat. FIG. 10A and FIG. 10B are views for indicating a reason why a streak due to a developing coat defect occurs. "Developing coat" means that developer is caused to adhere to the surface of a developing sleeve 142 at a uniform thickness. The magnet 141 functioning as a developing agent carrier is provided inside the developing sleeve 142. The developing sleeve 142 is supported by a developing container 143 to be able to rotate freely. A closest part 145 is a part at which the distance between the developing sleeve 142 and the photosensitive drum 11 is the closest. In the rotation direction of the developing sleeve 142, a regulation blade 146 is provided upstream of the closest part 145. The regulation blade 146 is arranged so that the distance in relation to the developing sleeve 142 is fixed, and regulates the amount of two-component developer supplied to the closest part 145.

Figure 10C:
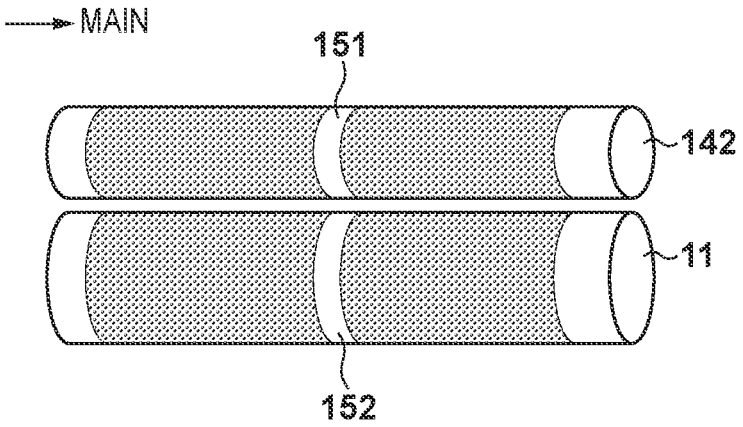

As illustrated by FIG. 10B, a foreign particle 148 such as dust or a hair may clog between the developing sleeve 142 and the regulation blade 146. In such a case, the foreign particle 148 impedes the flow of developer. As illustrated by FIG. 10C, an uncoated region 151 where developer is not carried occurs on the developing sleeve 142. Developer is not present in the uncoated region 151. Consequently, developer is not supplied to a portion out of the surface of a photosensitive drum 11 that faces the uncoated region 151. Therefore, a vertical streak 152 which continues in a straight line occurs on the surface of the photosensitive drum 11. As indicated by FIG. 9, a unit that should be replaced in order to resolve such a developing coat defect streak is the developing device 14.

Furthermore, using FIG. 9, description is given for a feature of a white streak that occurs due to a defect of a developing coat. First, a developing coat defect streak (a white streak) does not occur in the blank portions W, WD, and WT where a pattern image is not formed. From the color of the pattern where the developing coat defect streak was detected, the developing device 14 where the developing coat defect is occurring is identified.

Figure 11A:
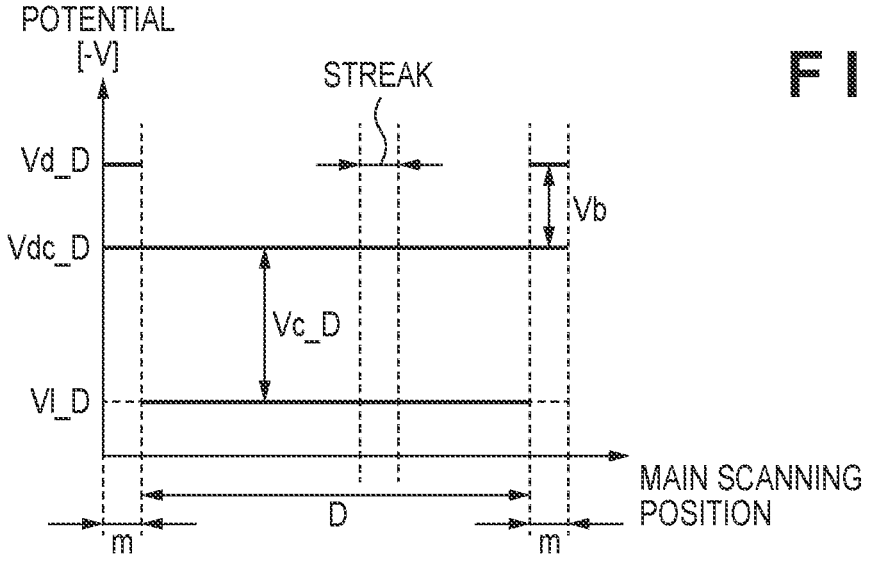
FIGS. 11A to 11F are views illustrating a relationship among streaks, charging potential, and developing potential.
Figure 11B:
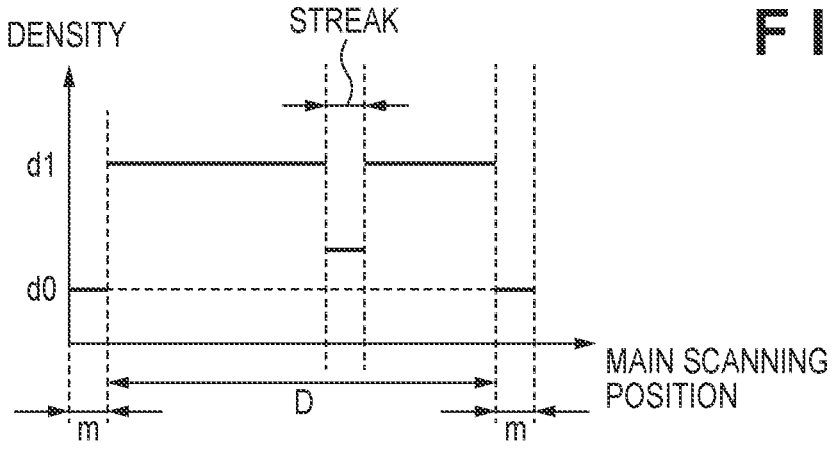
Figure 11C:
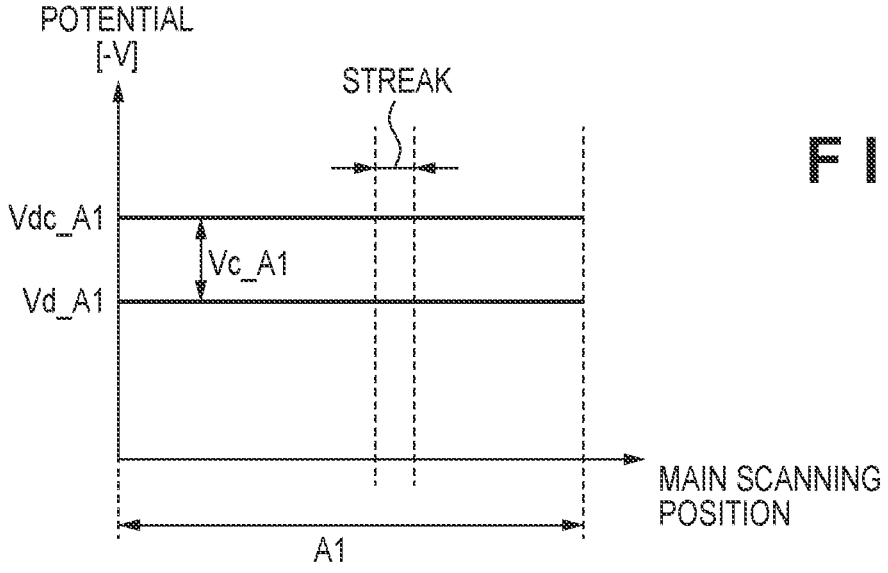
Figure 11D:
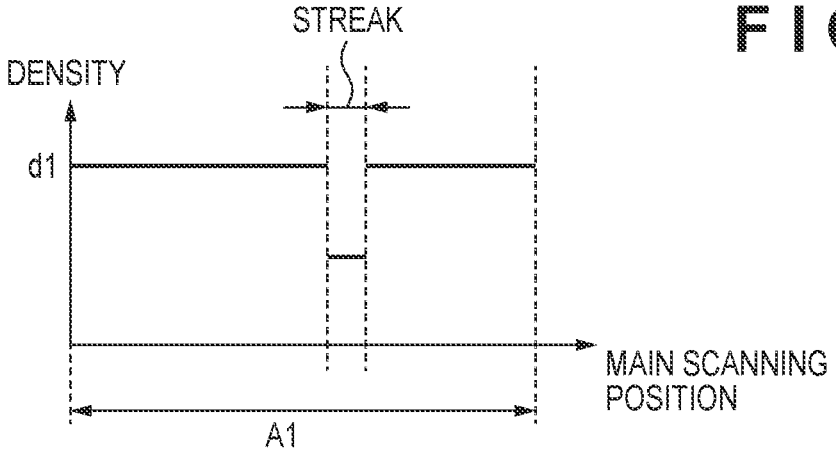
Figure 11E:
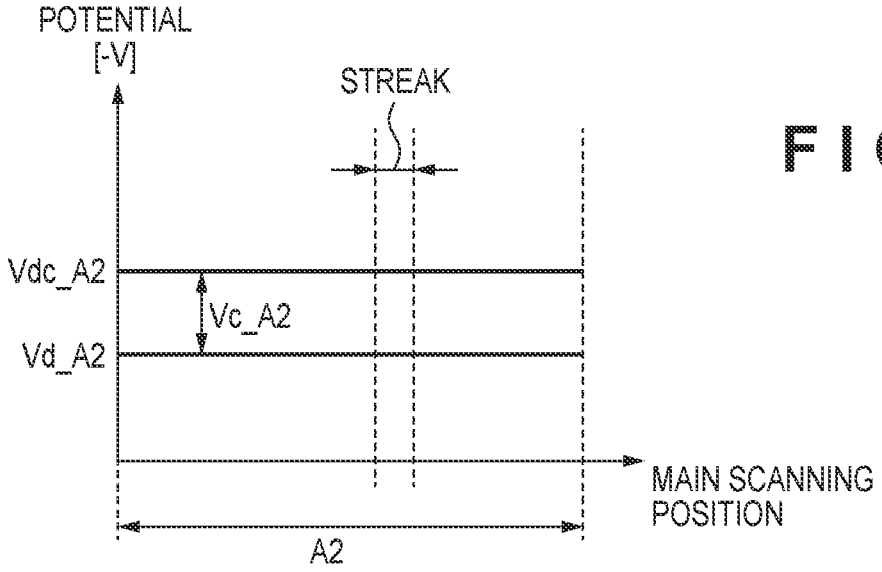
Figure 11F:
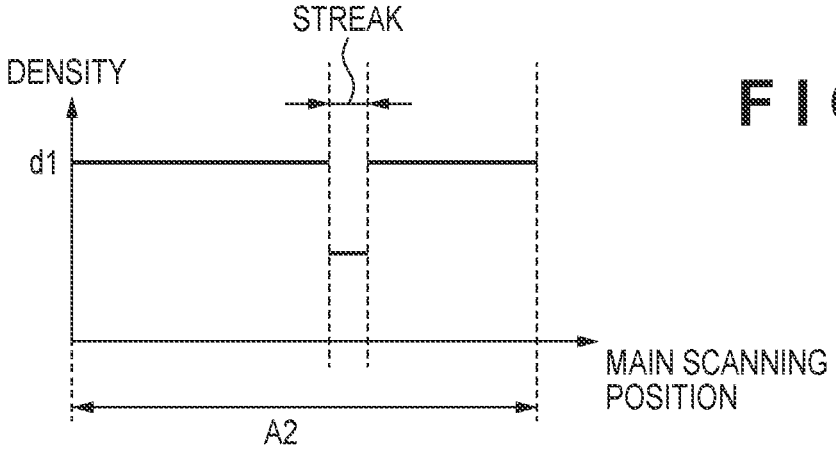

FIG. 11A illustrates potential at positions in the X direction of the photosensitive drum 11 when a digital pattern D is formed. FIG. 11B illustrates optical density at positions in the X direction of the sheet P when a digital pattern D is formed. FIG. 11C illustrates potential at positions in the X direction of the photosensitive drum 11 when an analog pattern A1 is formed. FIG. 11D illustrates optical density at positions in the X direction of the sheet P when an analog pattern A1 is formed. FIG. 11E illustrates potential at positions in the X direction of the photosensitive drum 11 when an analog pattern A2 is formed. FIG. 11F illustrates optical density at positions in the X direction of the sheet P when an analog pattern A2 is formed. As these figures illustrate, a developing coat defect streak is due to developer not being supplied onto the developing sleeve 142. Accordingly, a vertical streak occurs in all of the digital pattern D, the analog pattern A1, and the analog pattern A2. Furthermore, there is no difference between the density of a streak that occurs in the analog pattern A1 and the density of a streak that occurs in the analog pattern A2.

Streak Due to an Exposure Defect

Figure 12A:
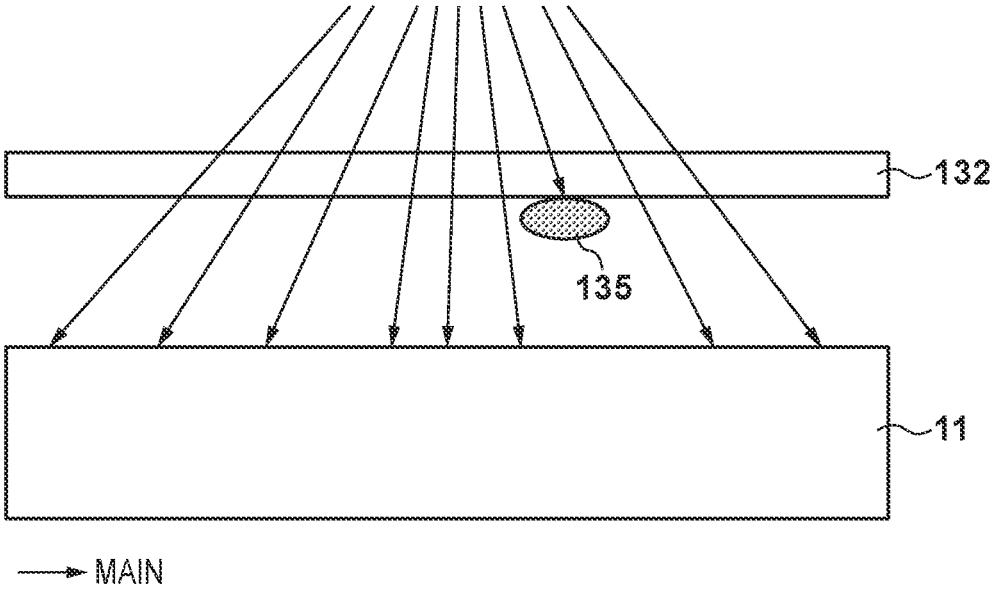
FIGS. 12A and 12B are views for illustrating an exposure defect and a plasticity deformation.

Next, description is given regarding a white streak that occurs due to an exposure defect, as indicated in FIG. 9. FIG. 12A is a view that indicates a mechanism for the occurrence of a white streak due to an exposure defect. A dustproof glass 132 is provided in a light path along which a laser beam outputted from the exposure device 13 passes. When a foreign particle 135 such as a hair or toner adheres to a portion of the dustproof glass 132, a laser beam emitted onto the surface of the photosensitive drum 11 is blocked. That is, a vertical streak occurs when the potential of the electrostatic latent image of a part at which the laser beam is not emitted due to the foreign particle 135 on the surface of the photosensitive drum 11 decreases. This vertical streak becomes a white streak because it occurs due to the amount of adhered toner decreasing. The response method for reducing a white streak due to an exposure defect is to perform cleaning work on the dustproof glass 132, or to replace the exposure device 13.

Using FIG. 9, description is given for features of a white streak due to an exposure defect. Firstly, an exposure defect white streak does not occur in a blank portion W in which a pattern image is not formed. The exposure device 13 for which an exposure defect has occurred is identified from the color of a digital pattern D in which an exposure defect white streak is detected.

Figure 13A:
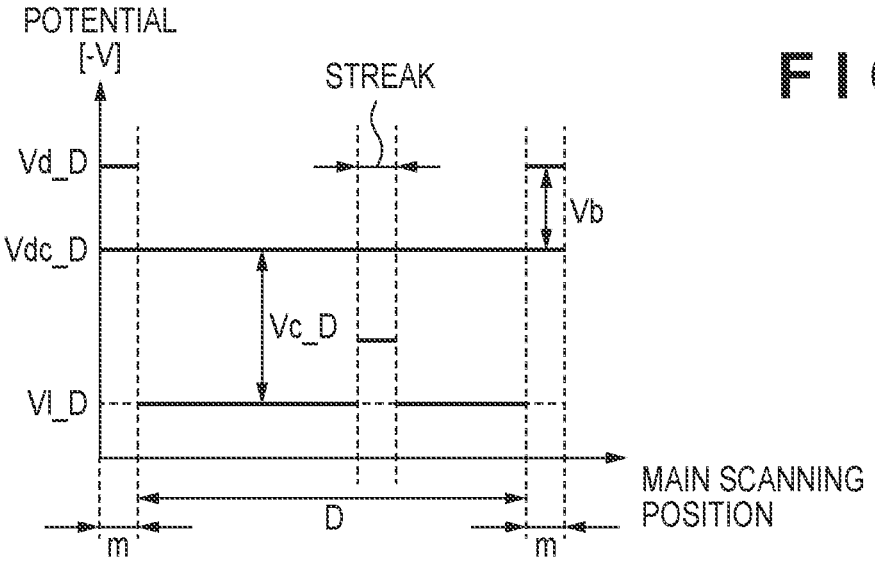
FIGS. 13A to 13F are views illustrating a relationship among streaks, charging potential, and developing potential.
Figure 13B:
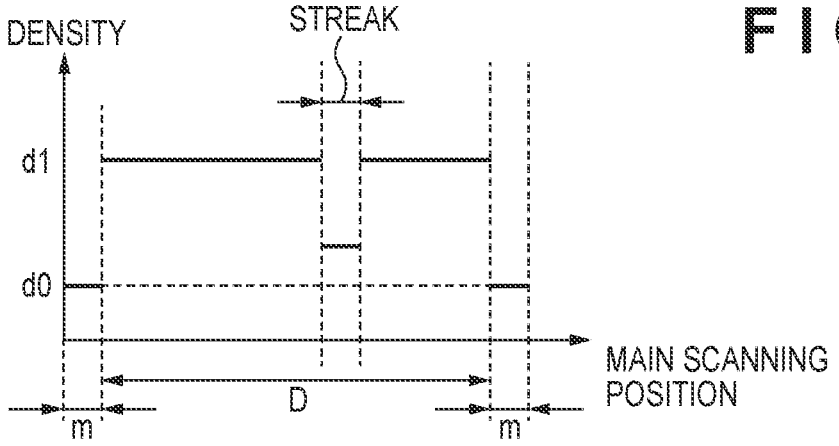
Figure 13C:
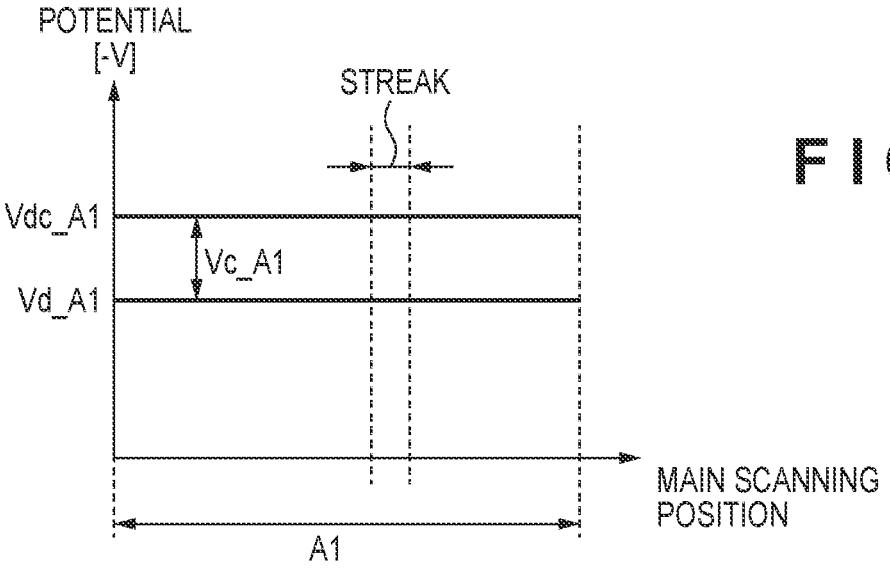
Figure 13D:
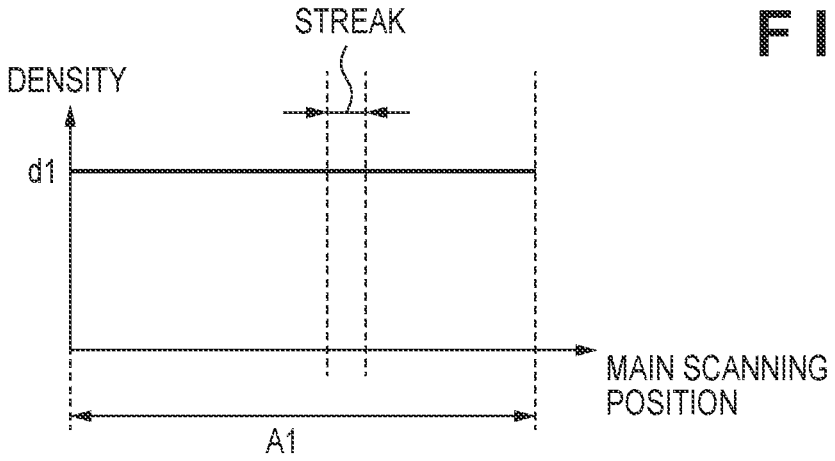
Figure 13E:
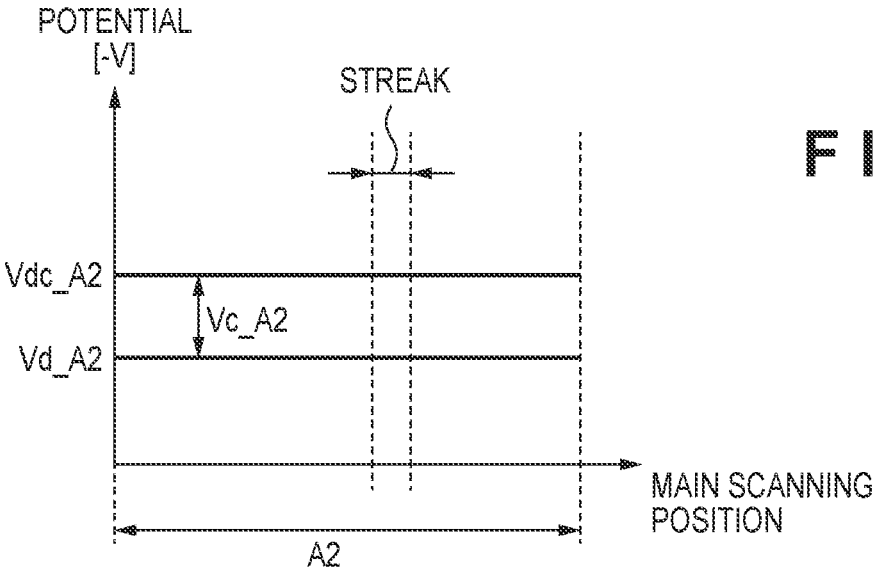
Figure 13F:
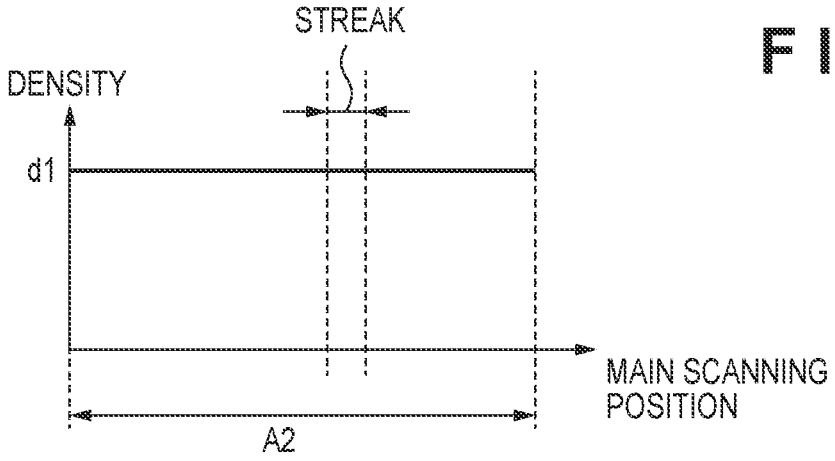

FIG. 13A illustrates potential at positions in the X direction of the photosensitive drum 11 when a digital pattern D is formed. FIG. 13B illustrates optical density at positions in the X direction of the sheet P when a digital pattern D is formed. FIG. 13C illustrates potential at positions in the X direction of the photosensitive drum 11 when an analog pattern A1 is formed. FIG. 13D illustrates optical density at positions in the X direction of the sheet P when an analog pattern A1 is formed. FIG. 13E illustrates potential at positions in the X direction of the photosensitive drum 11 when an analog pattern A2 is formed. FIG. 13F illustrates optical density at positions in the X direction of the sheet P when an analog pattern A2 is formed.

As illustrated by FIG. 13A or FIG. 13B, a white streak occurs due to an exposure defect (that the amount of exposure light has gets low). In a digital pattern D, an exposure defect white streak occurs by the surface potential becoming higher than V1_D in a portion of positions in the X direction of the photosensitive drum 11. However, as illustrated by FIG. 13C through FIG. 13F, because the analog patterns A1 and A2 are formed without exposure being applied, an exposure defect white streak does not occur.

Streak Due to a Charge Defect

Figure 14A:
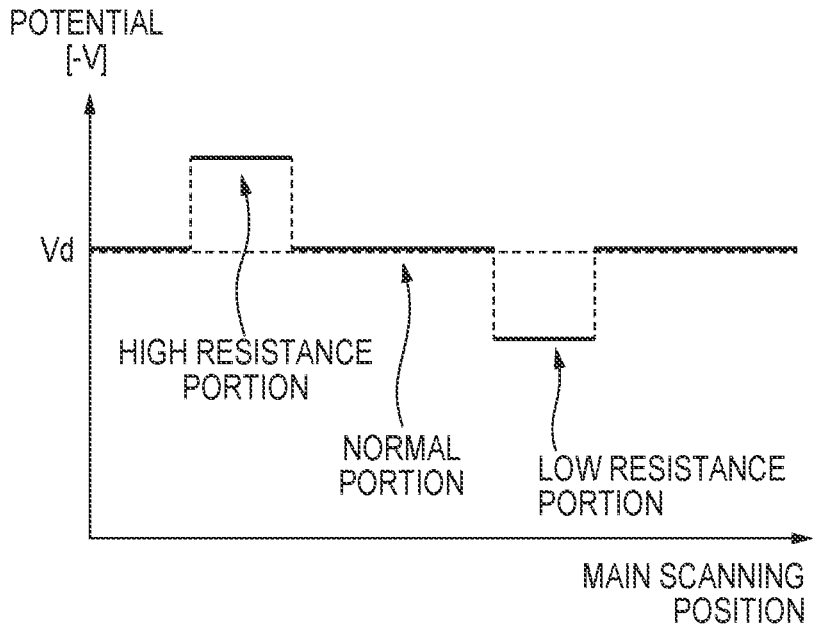
FIGS. 14A and 14B are views for illustrating a relationship between streaks and a cleaning defect of a photosensitive drum.
Figure 14B:
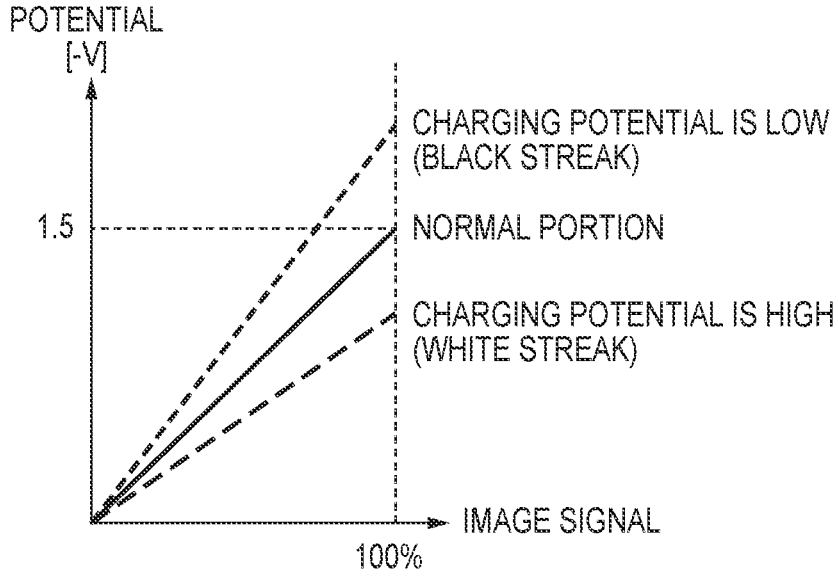

A contact charging method in which the photosensitive drum 11 is caused to be in contact with a charging member to perform charging is employed for the charging device 12 of the present embodiment. With the contact charging method, an additive agent such as silicon may adhere to a charging member due to cleaning being insufficient at a position in the X direction on the surface of the photosensitive drum 11. FIG. 14A is a view that illustrates the surface potential (charging potential) of the photosensitive drum 11. FIG. 14B is a view that illustrates a relationship between an image signal and an optical density. As illustrated by FIG. 14A, the resistance of the charging member increases at some of the positions in the X direction on the surface of the photosensitive drum 11, and the charging potential gets higher at those positions. A region in the X direction where the resistance has increased is referred to as a high resistance portion. When the charging potential increases, as illustrated by FIG. 14B, even if the positions in the X direction of the photosensitive drum 11 are exposed using the same image signal, the density of a high resistance portion becomes less than the density of a normal portion, and a white streak occurs.

In contrast, toner adheres to the charging member when a cleaning defect occurs at some of the positions in the X direction of the surface of the photosensitive drum 11. The resistance of a part at which toner adheres in the surface of the charging member becomes lower. The resistance of the charging member gradually increases due to endurance, but the resistance of the charging member becomes partially lower even if a surface layer of the charging member is stripped off. As a result, as illustrated by FIG. 14A, the resistance of a charging member at a region of a portion in the X direction partially decreases, and the charging potential decreases. This portion is called a low resistance portion. When the charging potential decreases, as illustrated by FIG. 14B, even if the positions in the X direction of the photosensitive drum 11 are exposed using the same image signal, the density of the low resistance portion becomes more than the density of a normal portion, and a black streak occurs.

Using FIG. 9, description is given for features of a charge defect streak. Firstly, a charge defect streak does not occur in a blank portion W in which a pattern image is not formed. The charging device 12 for which a charge defect has occurred is identified from the color of a pattern in which an exposure defect streak is detected.

Figure 15A:
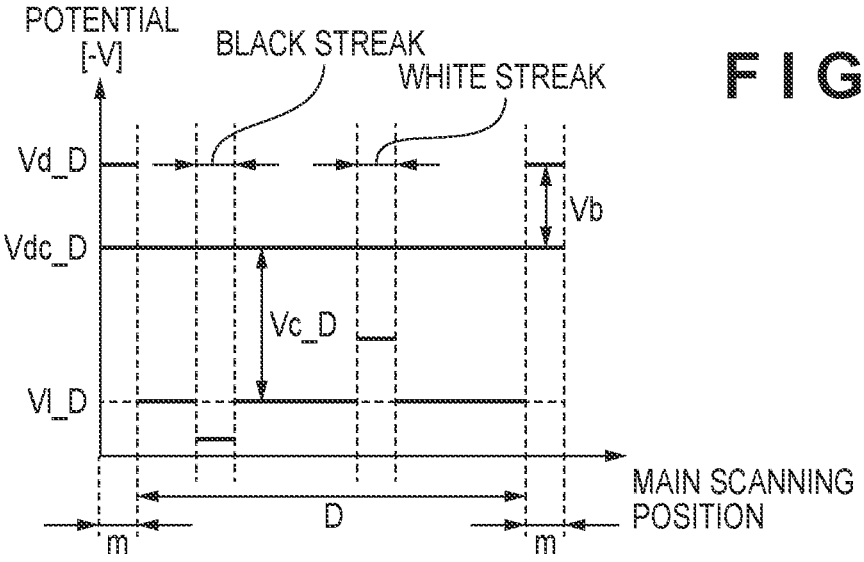
FIGS. 15A to 15F are views illustrating a relationship among streaks, charging potential, and developing potential.
Figure 15B:
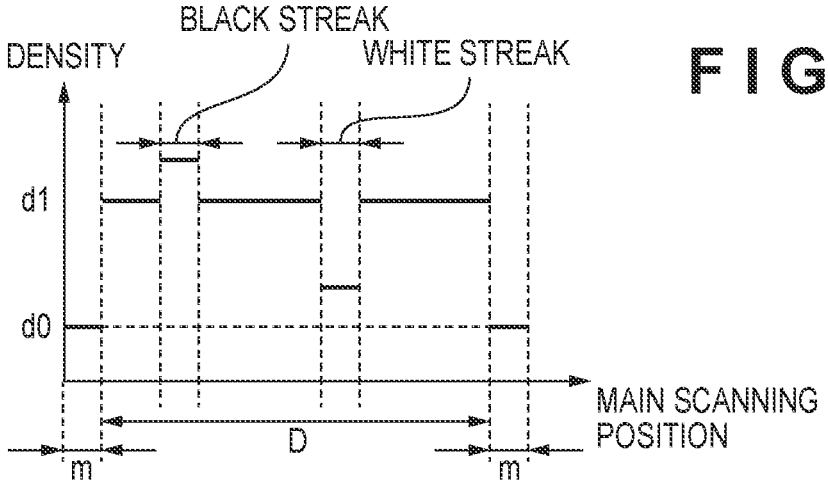
Figure 15C:
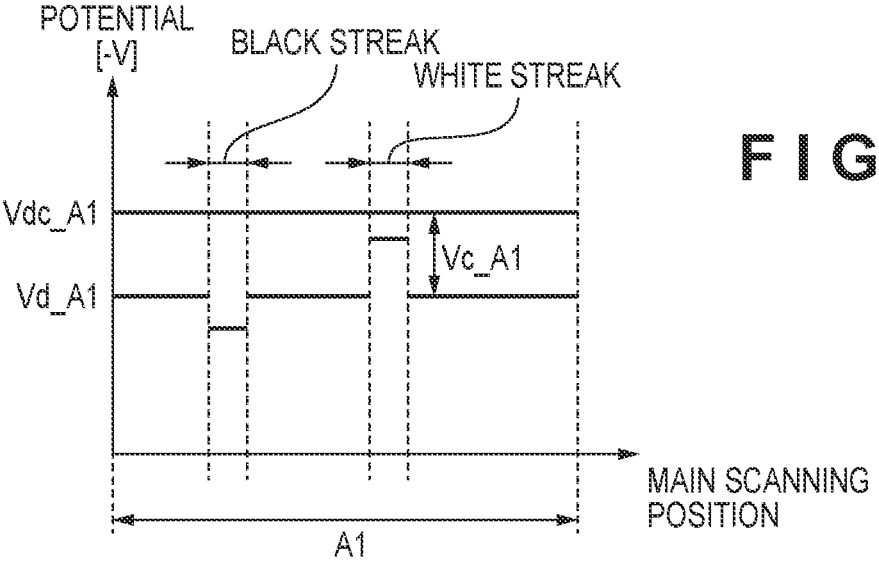
Figure 15D:
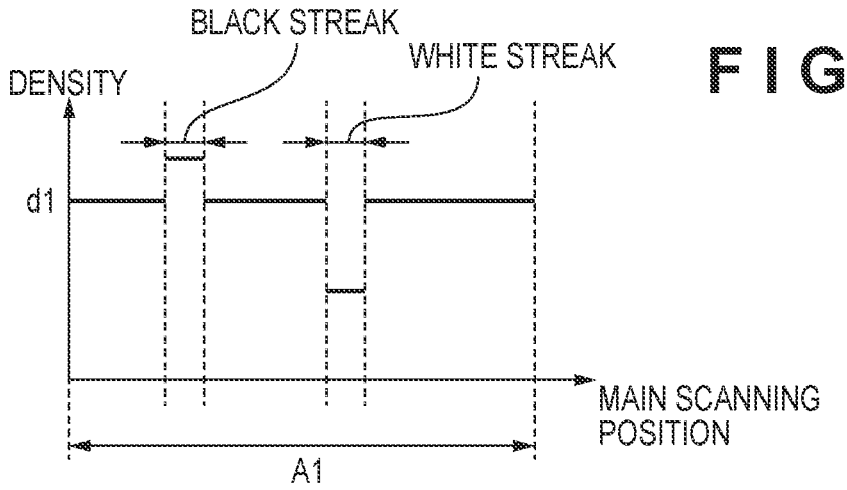
Figure 15E:
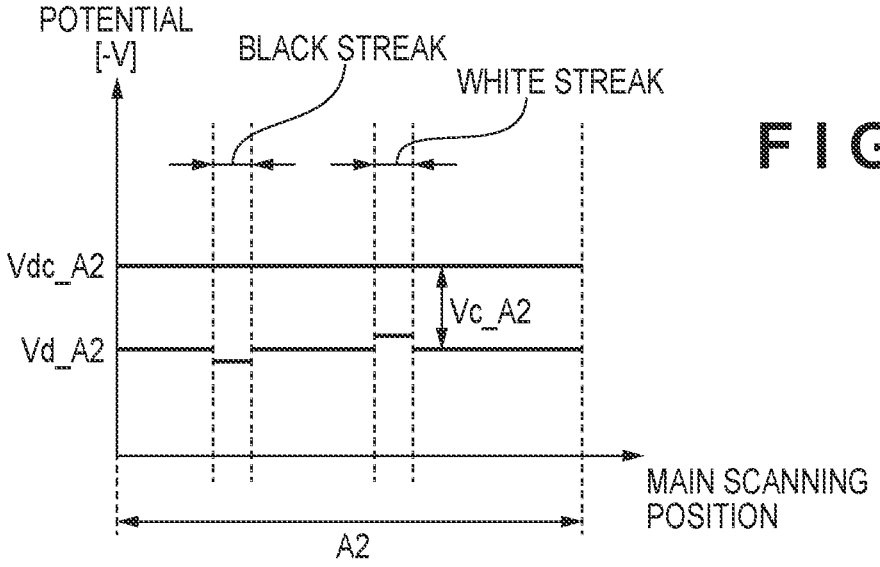
Figure 15F:
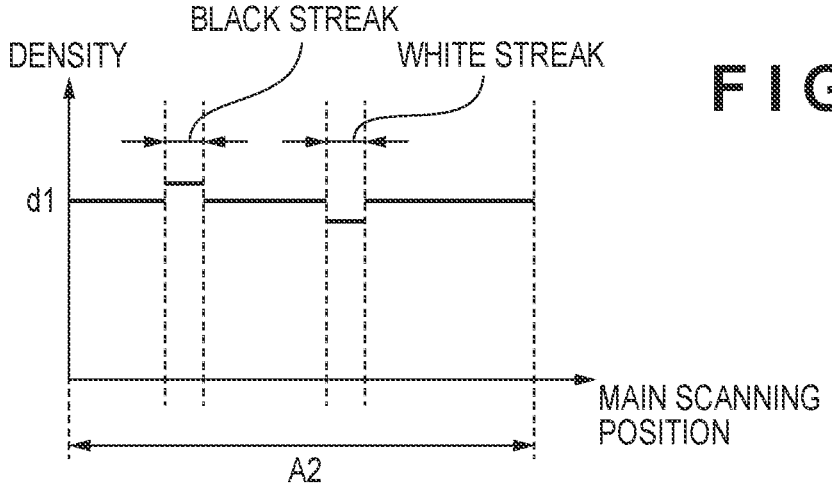

FIG. 15A illustrates potential at positions in the X direction on the photosensitive drum 11 when a digital pattern D is formed. FIG. 15B illustrates optical density at positions in the X direction of the sheet P when a digital pattern D is formed. FIG. 15C illustrates potential at positions in the X direction of the photosensitive drum 11 when an analog pattern A1 is formed. FIG. 15D illustrates optical density at positions in the X direction of the sheet P when an analog pattern A1 is formed. FIG. 15E illustrates potential at positions in the X direction on the photosensitive drum 11 when an analog pattern A2 is formed. FIG. 15F illustrates optical density at positions in the X direction of the sheet P when an analog pattern A2 is formed.

As illustrated by FIG. 15A and FIG. 15B, the charging potential at some of the positions of the photosensitive drum 11, which is exposed in the X direction by the digital pattern D, differs from V1_D. A black streak occurs at a position where the charging potential is lower than V1_D, and a white streak occurs at a position where the charging potential is higher than V1_D. As illustrated by FIG. 15C and FIG. 15D, a black streak or a white streak occurs even with the analog patterns A1 because the charging potential at a portion in the X direction differs from Vd_A1. Because the charge defect occurs due to a charging member resistance difference, the charge defect is reduced by causing the charging potential of the charging device 12 to decrease. As illustrated by FIG. 15E and FIG. 15F, because the analog patterns A2 are formed without charge processing being applied, a streak due to a charge defect does not occur.

Streak Due to a Plasticity Deformation of the Intermediate Transfer Belt

Figure 12B:
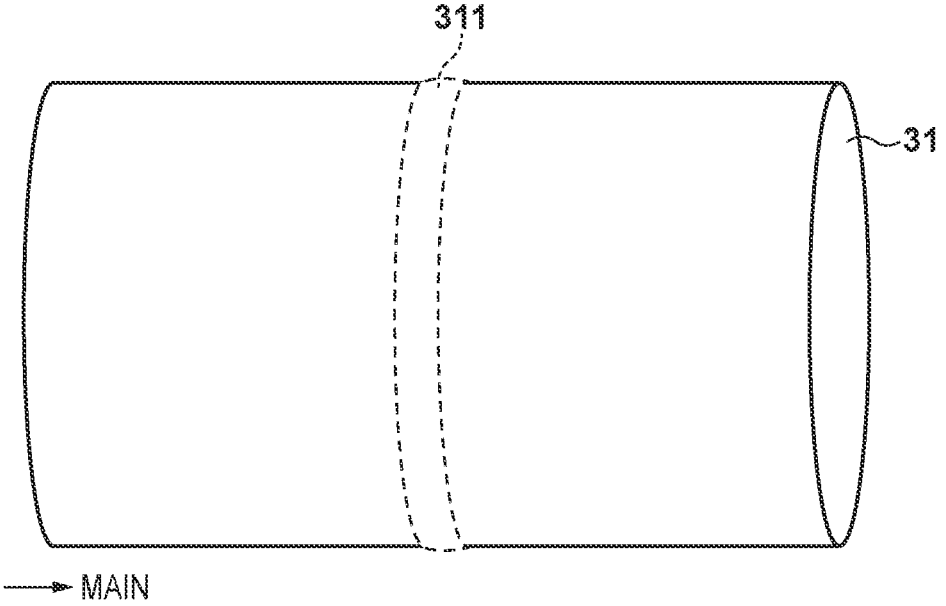

Next, a streak due to a plasticity deformation of the intermediate transfer belt 31 indicated by FIG. 9 is described. An inner surface of the intermediate transfer belt 31 that is used for a long period may be scraped, producing a powder. There are cases in which some of the parts that configure the transfer unit adhere to the surface of the rollers 36 and 37. As illustrated by FIG. 12B, a portion of the intermediate transfer belt 31 is subject to a plasticity deformation to become a convex shape. Such a portion is called a convex portion 311. In this way, when the convex part 311 is produced in the intermediate transfer belt 31, the photosensitive drum 11 and the sheet P tend not to be in contact at the two sides of the convex part 311. Accordingly, the secondary transfer of the toner image to the sheet P is adversely influenced at the two sides, and a white streak occurs. A black streak occurs at the convex part 311 because a lot of toner is secondary transferred to the sheet P. Accordingly, the part that should be replaced to fix the streak due to a plasticity deformation of the intermediate transfer belt 31 is the intermediate transfer unit. Note that a white streak is not a streak of a white color, but rather is a pale streak where the density is low (there is less toner). Also, a black streak is a dense streak where the density is high (there is more toner).

Using FIG. 9, description is given for features of a streak due to a plasticity deformation. A streak due to a plasticity deformation does not occur in a blank portion W in which a pattern image is not formed. A streak due to a plasticity deformation can occur for patterns of all colors. This is because a streak due to a plasticity deformation occurs in a secondary transfer portion. Also, because it is independent of the existence or absence of an exposure and the charging potential, the streak occurs in the analog patterns A1 and A2 and not just the digital pattern D.

Streak Due to a Photosensitive Drum Cleaning Defect

A streak due to a defect in cleaning of the photosensitive drum 11 is a black streak. With the drum cleaner 15, in rare cases, a portion of a blade for rubbing the photosensitive drum 11 may be defective. If a portion of a blade as a removal member is defective, this defective portion is not able to scrape away toner that remains on the photosensitive drum 11. This becomes the cause of a black streak. Accordingly, the drum cleaner 15 for which the cleaning defect occurred is identified from the color of a black streak. For example, when a cleaning defect occurs with the drum cleaner 15 for the yellow station, a yellow black streak will occur. In addition, a black streak that accompanies a cleaning defect occurs as an approximately straight line shaped streak in the blank portion WD. Accordingly, the part to be replaced in order to reduce black streaks due to a cleaning defect of the photosensitive drum 11 is the process cartridge 50. In this way, an assembly unit including the drum cleaner 15 is a replacement part.

Features of a streak due to a drum cleaning defect are described using FIG. 9. Because streaks occur due to a drum cleaning defect, these streaks also occur in the blank portion WD in which a pattern image is not formed. A color of a streak that occurs in the blank portion WD is the same color as the color of toner that is held in the drum cleaner 15. Therefore, this streak is a monochrome streak. Because the streak occurs even for a color for which an image is not formed, it occurs in patterns of all of the colors of yellow, magenta, cyan, and black. For example, when the drum cleaner 15 for the yellow station is defective, a yellow streak will occur across the entire region in the conveyance direction of the sheet P.

Figure 16A:
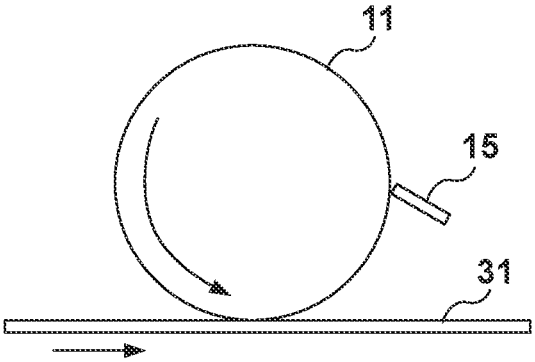
FIGS. 16A to 16D are views for illustrating an occurrence mechanism of an image defect due to a cleaner.

However, a streak may not occur even though a portion of the blade is defective. FIG. 16A illustrates that toner is not supplied to the drum cleaner 15 for which a portion of the blade is defective. In this case, because there is substantially no toner that slips past the defective portion, a streak does not occur on the test chart.

Figure 16B:
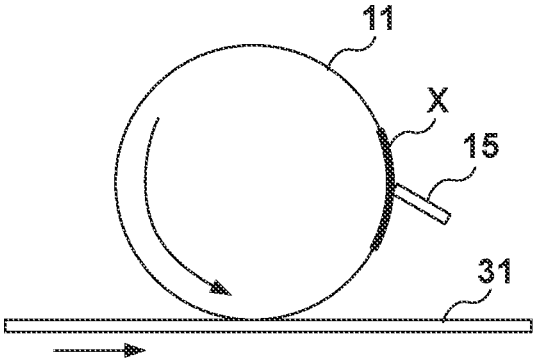

In contrast, as illustrated by FIG. 16B, toner is supplied by the toner patch PD to the drum cleaner 15 in the present embodiment. Accordingly, toner passes through the defective portion of the blade of the drum cleaner 15, and a streak-shaped image X is conveyed to the primary transfer nip portion N1 again. This streak-shaped image X is transferred to the intermediate transfer belt 31 from the photosensitive drum 11 at the primary transfer nip portion N1, and is transferred from the intermediate transfer belt 31 to the blank portion WD of the test chart 701 at the secondary transfer nip portion N2. Accordingly, the streak is apparent in the blank portion WD. Note that a streak will similarly be apparent even if there is a defect in a fur brush.

Streak Due to an Intermediate Transfer Belt Cleaning Defect

A black streak that occurs due to a cleaning defect of the intermediate transfer belt 31 is described using FIG. 9. With the belt cleaner 35, in rare cases, a portion of a blade as a removal member for rubbing the intermediate transfer belt 31 may be defective. If a portion of a blade of the belt cleaner 35 is defective, this defective portion is not able to scrape away toner that remains on the intermediate transfer belt 31. As a consequence, a black streak occurs. The color of this type of streak can be a color resulting from yellow, magenta, cyan, and black toner mixing (a mixed color). Thus, the unit that should be replaced to reduce a black streak that occurs due to a defect in cleaning the intermediate transfer belt 31 is the belt cleaner 35.

Features of a streak that occurs due to a cleaning defect of the intermediate transfer belt 31 are described using FIG. 9. Because a belt cleaning defect is the cause, a streak occurs in the blank portions W and WT in which a pattern image is not formed. Therefore, because a streak that occurs in the blank portions W and WT is something due to toner that accumulates in the belt cleaner 35, the color of the streak can be a mixed color of yellow, magenta, cyan, and black.

Figure 16C:
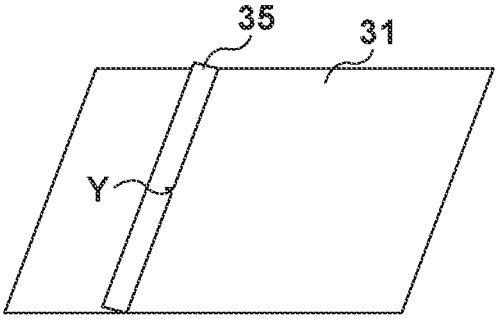

However, a streak may not occur even though a portion of the blade of the belt cleaner 35 is defective. FIG. 16C illustrates that toner is not supplied to the belt cleaner 35 for which a portion of the blade is defective. In this case, because there is substantially no toner that slips past the defective portion, a streak does not occur on the test chart.

Figure 16D:
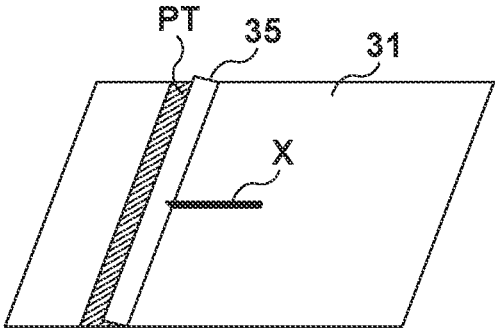

In contrast, as illustrated by FIG. 16D, toner is supplied by the toner patch PT to the belt cleaner 35 in the present embodiment. Accordingly, toner passes through the defective portion of the blade of the belt cleaner 35, and a streaky-shaped image X is conveyed to the secondary transfer nip portion N2 again. The streak-shaped image X is transferred to the blank portion WT of the test chart 701 from the intermediate transfer belt 31 at the secondary transfer nip portion N2. Accordingly, the streak is apparent in the blank portion WT. Note that a streak will similarly be apparent even if there is a defect in a fur brush. In the present embodiment, as illustrated by FIG. 16D, a pattern is formed in order to cause a streak-shaped image to be apparent on a test chart. This pattern supplies toner to the belt cleaner 35. If there is a defect in the belt cleaner 35, a streak due to a cleaning defect of the intermediate transfer belt 31 will occur on the test chart.

[Replacement Part Identification Processing]

Figure 17:
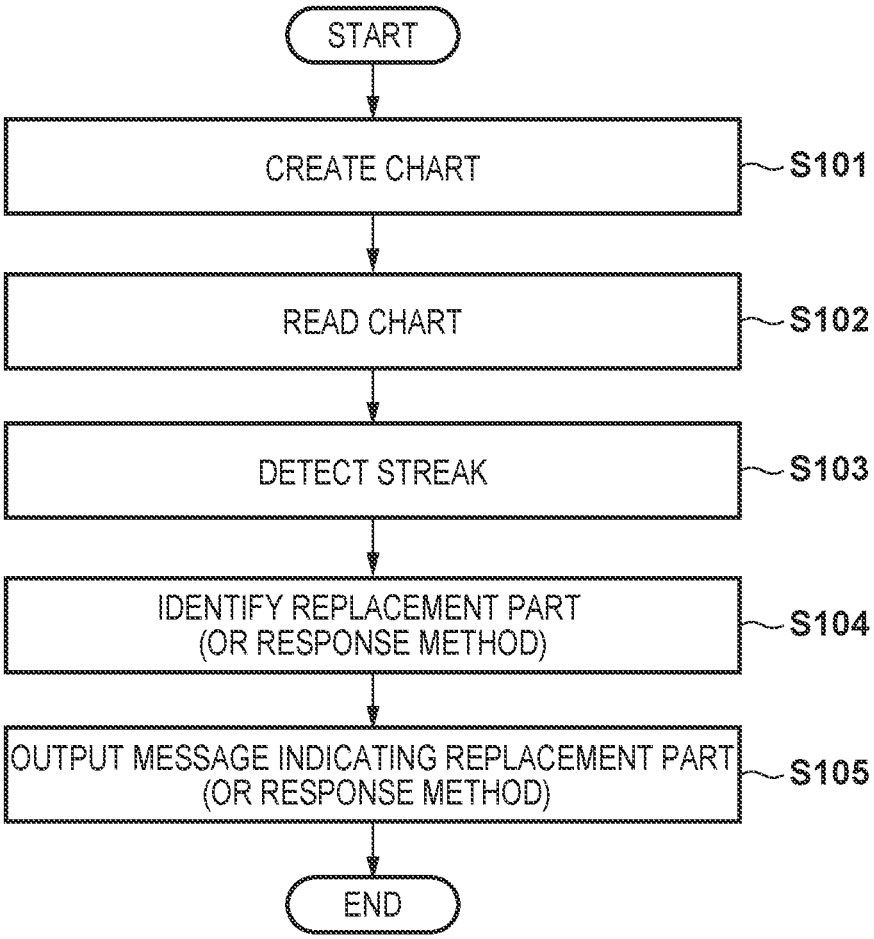
FIG. 17 is a flowchart illustrating processing for creating a test chart and processing for identifying a replacement part.

Processing for creating the test charts 701 to 704 for identifying a replacement part, and processing for identifying a replacement part are described using FIG. 17. Upon an instruction to identify a replacement part or an instruction to create the test charts 701 to 704 being inputted from the input apparatus 62, the CPU 60 executes the following processing.

In step S101, the CPU 60 (the chart generation unit 64) controls the printer 3 to create the test charts 701 to 704.

Test Chart 701

For the test chart 701, it is necessary for a streak-shaped image that has passed by a defective portion of the drum cleaner 15, and a streak-shaped image that has passed by a defective portion of the belt cleaner 35 to be transferred to one sheet. However, an amount of time for the photosensitive drum 11 to make one rotation is smaller than an amount of time for the intermediate transfer belt 31 to make one rotation. Consequently, in processing to create the test chart 701, firstly, the toner patch PT is formed before the toner patches PD.

In order to form the toner patch PT, the chart generation unit 64 sets the charging potential Vd_D for the charging devices 12 for the yellow station and the magenta station, and sets the developing potential Vdc_D for the developing devices 14 for the yellow station and the magenta station. The chart generation unit 64 sets the primary transfer voltage to 1Tr_D by the transfer control unit 70. The chart generation unit 64 then outputs an image signal for forming the toner patch PT to the exposure devices 13 of the yellow station and the magenta station. By this, the toner patch PT, which is a mixed color of yellow toner and magenta toner, is formed on the intermediate transfer belt 31. The chart generation unit 64 sets the secondary transfer voltage to 2Tr_PT by the transfer control unit 70. By this, the toner patch PT passes through the secondary transfer nip portion N2 and is conveyed to the belt cleaner 35. Thus toner is supplied to the belt cleaner 35. If there is a defective portion in the belt cleaner 35, a streak-shaped image will remain in a region where the toner patch PT is formed, even if this region passes a cleaning position of the belt cleaner 35. After the toner patch PT passes through the secondary transfer nip portion N2, the chart generation unit 64 controls the secondary transfer voltage to 2Tr_D by the transfer control unit 70. By this, when the above region passes through the secondary transfer nip portion N2 again, a streak-shaped image due to a belt cleaning defect will be transferred from the intermediate transfer belt 31 to a sheet P (the test chart 701).

In addition, in order to form the toner patch $PD_Y$, the chart generation unit 64 sets the charging potential Vd_D to the charging device 12 for the yellow station, and sets the developing potential Vdc_D to the developing device 14 for the yellow station. The chart generation unit 64 sets the primary transfer voltage to 0 by the transfer control unit 70. The chart generation unit 64 then outputs an image signal for forming the toner patch $PD_Y$ to the exposure device 13 of the yellow station. By this, the yellow station forms the toner patch $PD_Y$. The toner patches $PD_M$, $PD_C$, and $PD_{Bk}$ are similarly formed. The toner patches $PD_Y$, $PD_M$, $PD_C$, and $PD_{Bk}$ pass through the primary transfer nip portion N1, and are conveyed to the drum cleaner 15. By this, toner is supplied to the drum cleaners 15. If there is a defective portion in a drum cleaner 15, a streak-shaped image will remain in a region where the toner patches $PD_Y$, $PD_M$, $PD_C$, and $PD_{Bk}$ are formed, even if this region passes a cleaning position of the drum cleaner 15. After the toner patches $PD_Y$, $PD_M$, $PD_C$, and $PD_{Bk}$ pass through the primary transfer nip portion N1, the chart generation unit 64 controls the primary transfer voltage to 1Tr_D by the transfer control unit 70. By this, when the above region passes through the primary transfer nip portion N1 again, a streak-shaped image of the region is transferred to the intermediate transfer belt 31. The chart generation unit 64 then controls the secondary transfer voltage to 2Tr_D by the transfer control unit 70. By this, a streak-shaped image due to the drum cleaning defect is transferred from the intermediate transfer belt 31 to a blank portion WD of the sheet P (the test chart 701).

Test Chart 702

In order to form the digital pattern $D_Y$, the chart generation unit 64 sets the charging potential Vd_D to the charging device 12 of the yellow station. Also, the chart generation unit 64 sets a developing potential Vdc_D to the developing device 14 of the yellow station. Furthermore, the chart generation unit 64 outputs an image signal for forming the digital pattern $D_Y$ to the exposure device 13 of the yellow station. By this, the digital pattern $D_Y$ is formed. The digital patterns $D_M$, $D_C$, and $D_{Bk}$ are similarly formed.

Test Chart 703

Next, the CPU 60 sets the charging potential Vd_A1 to the charging device 12 of each color station to form an analog pattern $A1_Y$. Also, the chart generation unit 64 sets a developing potential Vdc_A1 to the developing device 14 of each color station. By this the analog patterns $A1_Y$, $A1_M$, $A1_C$, and $A1_{Bk}$ are formed.

Test Chart 704

Next, the CPU 60 sets the charging potential Vd_A2 to the charging device 12 of each color station to form an analog pattern $A2_Y$. Also, the chart generation unit 64 sets a developing potential Vdc_A2 to the developing device 14 of each color station. By this, the analog patterns $A2_Y$, $A2_M$, $A2_C$, and $A2_{Bk}$ are formed. By the above, the test charts 701 to 704 are formed, and are discharged to the discharge tray of the image forming apparatus 1. Note that, in a case where a user or a service person identifies a replacement part by visual observation of the test charts 701 to 704, the following processing is omitted.

In step S102, the CPU 60 (the diagnostic unit 67) controls the image reader 2 to read the test charts 701 to 704. The diagnostic unit 67 may display, on the display apparatus 61, guidance prompting an operator to place the test charts 701 to 704 and then press a read start button. A read result of the test charts 701 to 704 is stored in the storage apparatus 63.

In step S103, the CPU 60 (the diagnostic unit 67) detects a streak from the read result of the test charts 701 to 704. For example, the diagnostic unit 67 may analyze the image data which is the read result, and obtain a feature amount to detect the streak. An RGB luminance value is included in the read result, and the diagnostic unit 67 divides the read result into an R image, a G image, and a B image, and executes analysis for each color individually. That is, the diagnostic unit 67 attempts to detect a vertical streak for the image data of each of the R image, the G image, and the B image. Note that the diagnostic unit 67 may attempt to detect a vertical streak for each color after converting the R image, the G image, and the B image into a Y image, an M image, a C image, and a K image. The diagnostic unit 67 calculates an average value of luminance values of a plurality of pixels lined up in a vertical direction of the image data (the conveyance direction of the test charts 701 to 704 or the scan direction of the image reader 2). This is because electrical noise added by the image reader 2 is reduced thereby.

In the present embodiment, because the width of the blank portions WD and WT (length in the conveyance direction) is 10 mm, averaging for a plurality of pixels corresponding to 10 mm is applied. However, with digital patterns D and the analog patterns A1 and A2, because the width of a pattern for a respective color (length in a shorter side direction) is 30 mm, averaging for a plurality of pixels corresponding to 30 mm is applied. The diagnostic unit 67 performs gradient correction processing for correcting a gradient of luminance values (an average value in the vertical direction) that follow the long side direction of a pattern. By this, the influence of density variation of a pattern image or the image reader 2 is reduced. The diagnostic unit 67 detects a pixel group (region) for which there is a difference in luminance value with respect to a uniform portion (a normal portion) among luminance values of the pattern. For example, the diagnostic unit 67 calculates a difference (a luminance difference) between an average luminance value of the pattern in the long side direction, and a luminance value (a luminance value that has been subject to gradient correction) of each position of the pattern in the long side direction. The diagnostic unit 67 detects a pixel group for which a luminance difference exceeds a predetermined threshold value (example: 20% of the average value) as a vertical streak. The diagnostic unit 67 may distinguish a streak whose luminance is lower (density is high) than the luminance of a normal portion as a black streak, and conversely may distinguish a streak whose luminance is high (density is low) as a white streak. The diagnostic unit 67 stores a position in the X direction and a position in the Y direction where the streak was detected, and the color, the luminance difference, or the like of the streak in the storage apparatus 63 as feature amounts of the streak. Note that the position of the streak indicates where the streak occurred from out of the blank portions W, WT, WD, the digital patterns D, and the analog patterns A1 and A2. The color of the streak is useful in identifying the replacement part. The luminance difference for the streak in the analog pattern A1 and the luminance difference for the streak in the analog pattern A2 are useful in determining whether or not the streak improved.

In step S104, the CPU 60 (the diagnostic unit 67) identifies a cause of the streak and a replacement part (or a response method) based on the read result of the test charts 701 to 704 (a result of detecting the streak). For example, based on the feature amounts of the streak stored in the storage apparatus 63, the diagnostic unit 67 distinguishes a streak color (monochrome (Y, M, C, and Bk) or mixed color, or the like), and the existence or absence of a streak for each of the blank portions W, WT, WD and the Y, M, C, and Bk patterns. The diagnostic unit 67 identifies the cause and the replacement part by comparing the result of distinguishing with an identification condition for identifying the cause and replacement part. The diagnostic unit 67 functions as a detecting unit for detecting a fault location of the image forming apparatus 1.

In step S105, the CPU 60 (the diagnostic unit 67) displays a message indicating the replacement part or the response method on the display apparatus 61, or transmits this message to the PC 124 or the server 128 via the communication IF 109.

FIG. 18 illustrates an example of a message that indicates a replacement part or a response method. In this example, the message includes information such as that a vertical streak (a streak that extends in the conveyance direction) has occurred in the test charts 701 to 704, a code indicating a cause, and a name of a replacement part. A user or a service person can easily understand what the cause of the streak is and what the replacement part is by referring to the message. Note that if a vertical streak is not detected, the diagnostic unit 67 displays a message indicating that the image forming apparatus 1 is normal on the display apparatus 61. In this way, a user, a service person or the like can easily understand what the replacement part is because they can know that a vertical streak occurred and what the replacement part is by the specific information.

[Details of Replacement Part Identification Processing]

Figure 19A:
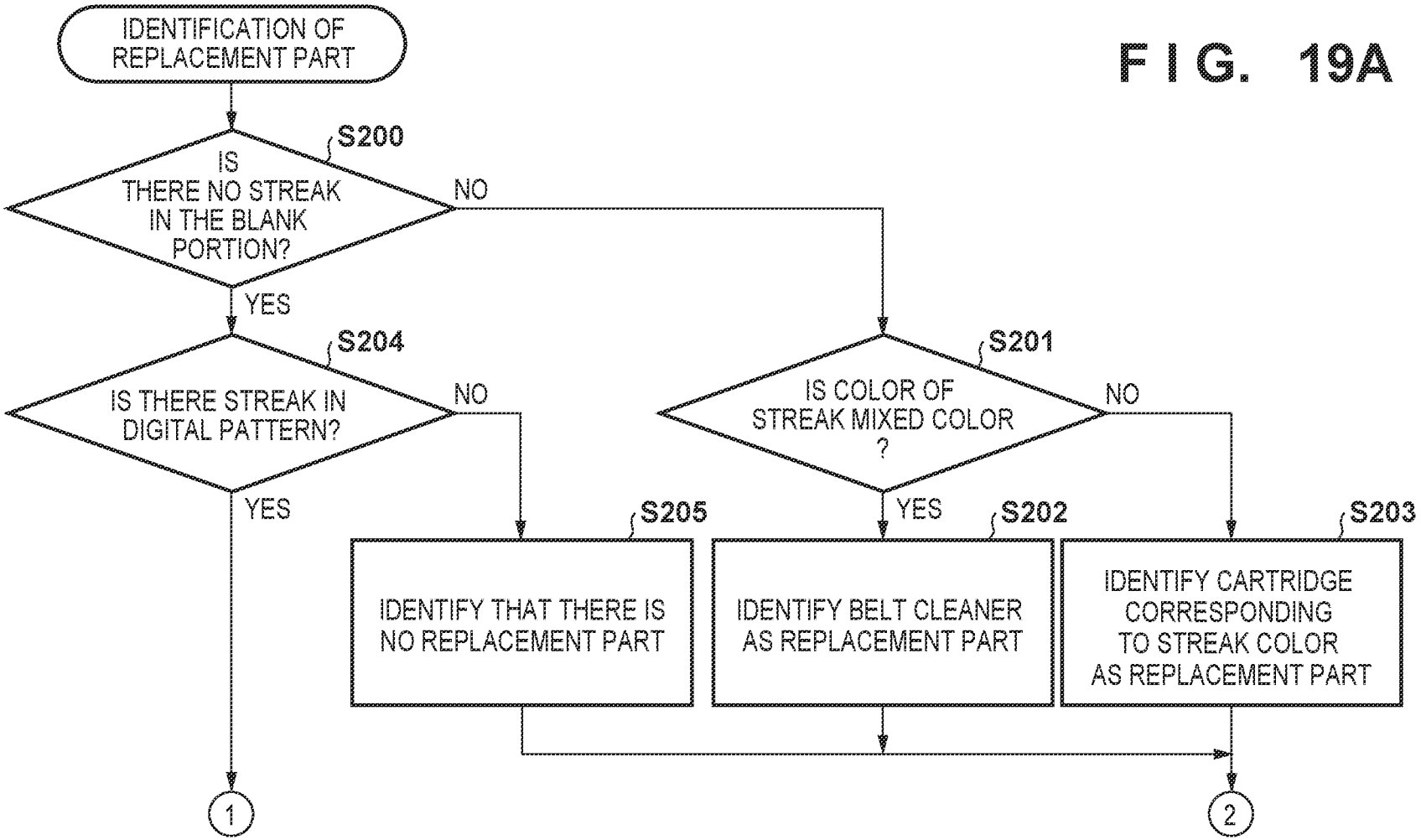
FIGS. 19A and 19B are flowcharts illustrating processing for identifying a replacement part.
Figure 19B:
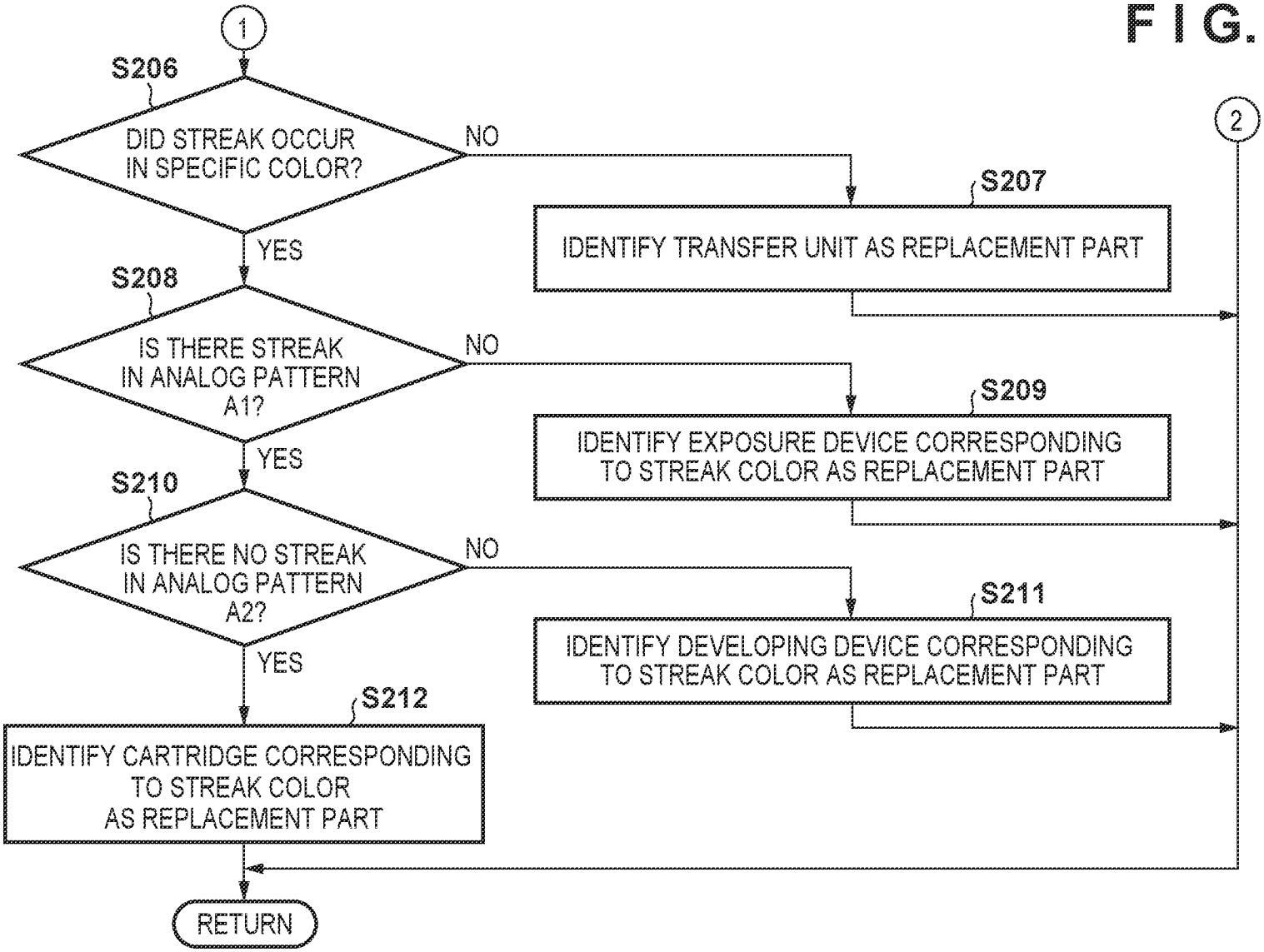

FIGS. 19A and 19B are flowcharts illustrating details of processing for identifying a replacement part and a response method. The CPU 60 (the diagnostic unit 67) detects a vertical streak for respective positions in the X direction (for example, each 1 mm). Accordingly, it may be that a vertical streak is detected in a plurality of positions in the X direction. In addition, there is the possibility that the causes of a plurality of vertical streaks are respectively different. Accordingly, the CPU 60 (the diagnostic unit 67) identifies the cause and the replacement part for each streak. Note that the replacement part may be identified by identifying the cause of the occurrence of the streak. Each determination process indicated in FIGS. 19A and 19B is a set of identification conditions for identifying a replacement part or a cause.

In step S200, the CPU 60 (the diagnostic unit 67) reads feature amounts from the storage apparatus 63, and determines whether streaks are absent from all of the blank portions W, WD, and WT. The coordinates of the blank portions W, WD, and WT in the test charts 701 to 704 are known beforehand. By comparing the position of a streak with the coordinates of the blank portions W, WD, and WT, the CPU 60 can distinguish the presence or absence of a streak in the blank portions W, WD, and WT. If there is a streak in any of the blank portions W, WD, and WT, the CPU 60 advances to step S201.

In step S201, the CPU 60 (the diagnostic unit 67) determines whether the color of a streak is a mixed color. If the color of the streak is a mixed color, the CPU 60 advances to step S202. In step S202, the CPU 60 (the diagnostic unit 67) distinguishes that the cause of the streak is a defect in cleaning the intermediate transfer belt 31, and identifies the belt cleaner 35 as the replacement part. Meanwhile, if the color of the streak is a monochrome of any of Y, M, C, and Bk, the CPU 60 advances to step S203. In step S203, the CPU 60 (the diagnostic unit 67) distinguishes the cause of the streak to be a cleaning defect of the photosensitive drum 11, and identifies the process cartridge 50 corresponding to the color of the streak as the replacement part. If a streak in the blank portions W, WD, and WT was not detected in step S200, the CPU 60 advances to step S204.

In step S204, the CPU 60 (the diagnostic unit 67) reads feature amounts from the storage apparatus 63, and determines whether a streak is present in the digital patterns DY to DBk. The coordinates of the digital patterns $D_Y$ to $D_{Bk}$ in the test charts 701 to 704 are known beforehand. The CPU 60 distinguishes the existence or absence of a streak in the digital patterns $D_Y$ to $D_{Bk}$ by comparing the position of the streak and the coordinates of the digital patterns $D_Y$ to $D_{Bk}$. If there is no streak in any of the digital patterns $D_Y$ to $D_{Bk}$, the CPU 60 advances to step S205. In step S205, the CPU 60 (the diagnostic unit 67) identifies that there is no replacement part (normal). Meanwhile, the CPU 60 advances to step S206 when it detects a streak in any of the digital patterns $D_Y$ to $D_{Bk}$.

In step S206, the CPU 60 (the diagnostic unit 67) reads feature amounts from the storage apparatus 63, and determines whether or not a streak occurs in a particular color. This is the same as determining whether or not a streak is occurring in all colors (all of the digital patterns $D_Y$ to $D_{Bk}$). If a streak is occurring for all colors, the CPU 60 advances to step S207. In step S207, the CPU 60 (the diagnostic unit 67) distinguishes that the cause of the streak is a plasticity deformation of the intermediate transfer belt 31, and identifies a transfer unit which includes the intermediate transfer belt 31 as the replacement part. Meanwhile, if a streak is occurring for a particular color, the CPU 60 advances to step S208.

In step S208, the CPU 60 (the diagnostic unit 67) determines whether a streak has occurred in an analog pattern A1 of the same color as the color of a digital pattern D where a streak occurred. If there is no streak in the analog pattern A1, the CPU 60 advances to step S209. In step S209, the CPU 60 (the diagnostic unit 67) distinguishes that the cause of the streak is an exposure defect, and identifies the exposure device 13 corresponding to the color of the streak as the replacement part. Note that the CPU 60 may identify cleaning of the exposure device 13 corresponding to the color of the streak as the response method. If a streak is occurring in the analog pattern A1 of the same color as the color of the digital pattern D in which the streak is occurring, the CPU 60 advances to step S210.

In step S210, the CPU 60 (the diagnostic unit 67) reads feature amounts from the storage apparatus 63, and determines whether streaks are absent from the analog patterns A2. If there is a streak in an analog pattern A2, the CPU 60 advances to step S211. In step S211, the CPU 60 (the diagnostic unit 67) identifies the developing device corresponding to the color of the streak as the replacement part. If there is no streak in the analog patterns A2, the CPU 60 advances to step S212. In step S212, the CPU 60 (the diagnostic unit 67) identifies a charge defect as the cause of the streak, and identifies the process cartridge 50 including the charging device 12 as the replacement part. Also, the replacement part is a replacement part corresponding to the color of the streak. For example, if there is no streak in the yellow analog pattern A2 even though there is a streak in the yellow analog pattern A1, the process cartridge 50 responsible for yellow is identified as the replacement part.

In this way, the CPU 60 creates the test charts 701 to 704, and analyzes a streak that occurs in the test charts 701 to 704 to identify the cause of the streak and a replacement part. Also, the CPU 60 may output a message indicating the cause of the streak and the replacement part to the display apparatus 61 or the like. By this, it becomes possible for a user or a service person to easily recognize the cause of the streak and the replacement part. Thereby, the work time (downtime) necessary for maintenance may be significantly shortened. Also, because a part involved in the streak is identified, it may be that the replacement of a part that is not involved in the streak may be avoided. Thereby, maintenance costs may also be reduced as well as maintenance time. The message indicating the cause of the streak and the replacement part may be transmitted to the server 128 of the service person via the network. Because the service person can know what the replacement part is in advance, he or she can reliably bring the replacement part to perform the maintenance. Processing illustrated in FIGS. 19A and 19B for identifying, for example, a replacement part or a cause of a streak may be executed with a user or a service person visually observing the test charts 701 to 704. Here, a color printer is employed as an example, but the present embodiment may be applied to a monochrome printer.

The test charts 701 to 704 illustrated by FIG. 3 are merely examples. The order of the blank portions W and WD, the blank portion WT, the digital patterns D, and the analog patterns A1 and A2 in the test charts 701 to 704 may be another order. It is sufficient if the blank portions WD or the blank portion WT are present in a test chart, and the blank portions W, digital patterns D, and the analog patterns A1 and A2 may be omitted from test charts. In other words, it is sufficient to create a test chart that includes a pattern relating to a replacement part for which an operator wishes to determine the necessity of replacement, from out of the blank portions W, WD, and WT, the digital patterns D, and the analog patterns A1 and A2.

Examples of an image error other than a vertical streak are a horizontal streak that occurs in accordance with a rotation period of a rotation part in a direction orthogonal to the conveyance direction of the sheet P, and an image scratch that occurs when there is a scratch in a rotation part. By setting the length in the conveyance direction of the test chart 701 to be greater than or equal to the length of a rotation part that is a cause of a horizontal streak or an image scratch, it is also possible to detect a horizontal streak, an image scratch, or the like. An identification condition that associates a feature of a horizontal streak or an image scratch and a part corresponding to that feature may be stored in the storage apparatus 63. In such a case, the CPU 60 identifies a replacement part by comparing a feature of a detected horizontal streak or image scratch with the identification condition.

Second Embodiment

In the first embodiment, a determination is made on which cleaner should be replaced, depending on the color of a streak that occurs in a blank portion W. In other words, if the streak is a monochrome, the diagnostic unit 67 determines that the drum cleaner 15 matching the color of the streak is the cause of the streak. If the color of the streak is a mixed color, the diagnostic unit 67 determines that the cause of the streak is the belt cleaner 35.

However, if the extent of the streak is small, the luminance value of the streak which is to be detected will be small, and it will be difficult to determine whether it is a monochrome or a mixed color. In addition, the diagnostic unit 67 cannot separate a black streak formed by toner colors mixing from a streak of a black monochrome in accordance with detected values for a streak.

Accordingly, in the second embodiment, the CPU 60 determines, based on a detection position where a streak was detected, which of a drum cleaner 15 and the belt cleaner 35 should be replaced, and, if a drum cleaner 15 should be replaced, which drum cleaner 15 responsible for which toner color should be replaced. In this way, it is possible to identify the replacement part even if it is not possible to recognize the color of a streak that occurred in the blank portions W, WD, and WT. Note that the second embodiment is similar to the first embodiment, excluding step S201 through step S203 of FIGS. 19A and 19B of the first embodiment. Accordingly, portions that have already been described are omitted.

[Processing to Identify a Replacement Part Based on Position Where a Streak is Detected in a Blank Portion W]

Figure 21:
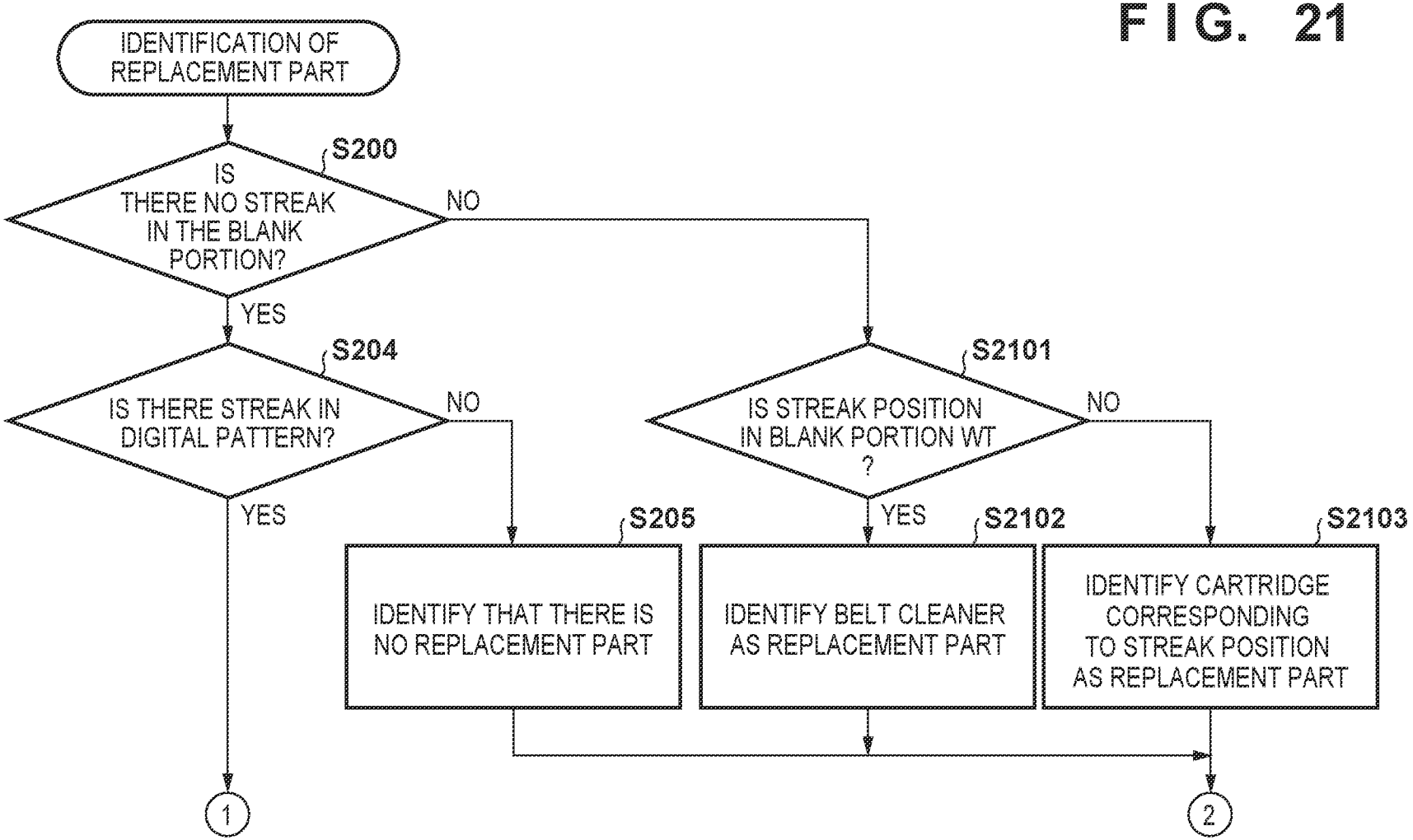
FIG. 21 is a flowchart illustrating processing for identifying a replacement part.

FIG. 20 illustrates a relationship between replacement parts and streak detection positions. Configuration may be taken such that this relationship is stored in the storage apparatus 63, and can be referred to by the CPU 60. FIG. 21 is a flowchart illustrating processing for identifying a replacement part. Step S201 to step S203 of FIG. 19A are replaced by step S2101 through step S2103 in FIG. 21.

In step S2101, the CPU 60 (the diagnostic unit 67) determines whether the position where a streak was detected is in the blank portion WT. When a streak is detected in the blank portion WT, the CPU 60 proceeds to step S2102.

In step S2102, the CPU 60 (the diagnostic unit 67) identifies the belt cleaner 35 as a replacement part, as indicated by FIG. 20. In contrast, when a streak is not detected in the blank portion WT, the CPU 60 proceeds to step S2103.

In step S2103, the CPU 60 (the diagnostic unit 67) identifies a cartridge corresponding to the detection position of the streak as a replacement part. As indicated by FIG. 20, if a streak is detected in the blank portion $WD_Y$, the diagnostic unit 67 identifies the drum cleaner 15 for yellow toner as a replacement part. If a streak is detected in the blank portion $WD_M$, the diagnostic unit 67 identifies the drum cleaner 15 for magenta toner as a replacement part. If a streak is detected in the blank portion $WD_C$, the diagnostic unit 67 identifies the drum cleaner 15 for cyan toner as a replacement part. If a streak is detected in the blank portion $WD_{Bk}$, the diagnostic unit 67 identifies the drum cleaner 15 for black toner as a replacement part.

In this way, the diagnostic unit 67 can identify a replacement part based on the detection position of a streak. Accordingly, it is possible to identify a replacement part even if the color of a streak cannot be recognized.

Third Embodiment

Figure 22A:
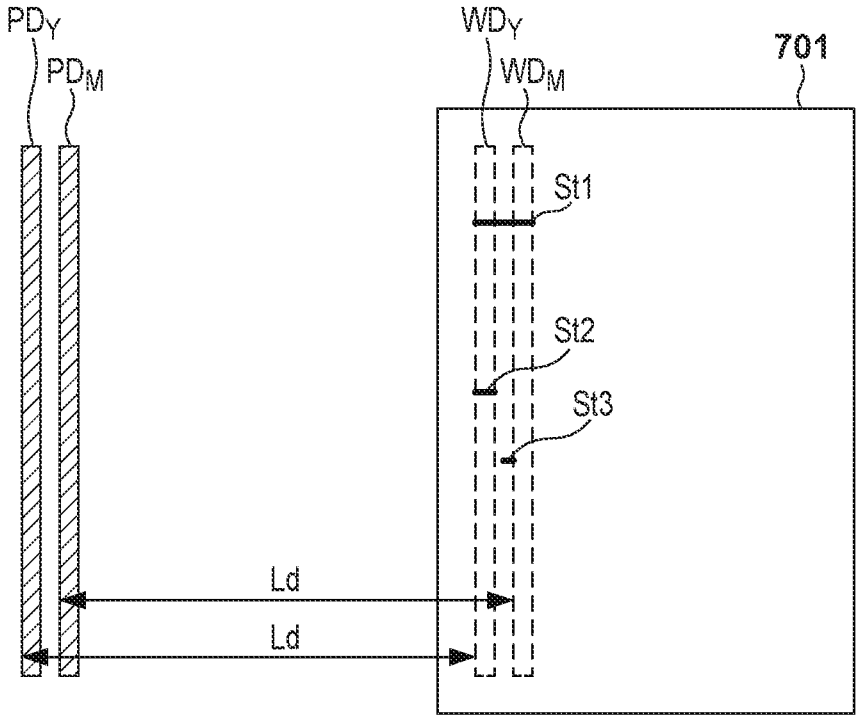
FIGS. 22A and 22B are views illustrating features of a test chart in a third embodiment.

In the second embodiment, a determination is made as to whether a drum cleaner 15 for one color should be replaced, or whether the belt cleaner 35 should be replaced, depending on in which blank portion a streak is detected. As indicated by FIG. 22A, the length of a streak due to a cleaner gets longer as the degree of wear or a defect in the cleaner increases. In this example, illustration is given for the occurrence of three defects of respectively different degrees in the drum cleaner 15 for yellow toner, in the test chart 701. The degrees of the three defects are respectively different. A streak St1 is a streak that occurs due to a large defect. A streak St2 is a streak that occurs due to a medium defect. A streak St3 is a streak that occurs due to a small defect. The length of the streak St1 in the conveyance direction of the test chart 701 is the longest, and the length of the streak St3 is the shortest. The length of a streak in the conveyance direction of the test chart 701 may be shorter than the length of a patch PD. The position where the streak St3 occurs is more retarded (is a rear position) than the positions where the streaks St1 and St2 occurred.

A reason why the length of a streak differs from the length of a patch PD or why the occurrence position of a streak differs to a position corresponding to a patch PD is because toner that configures the patch PD is being obstructed and stopped by the blade of the drum cleaner 15, and gradually passes by the drum cleaner 15. This phenomenon similarly occurs for the belt cleaner 35.

In the second embodiment, a replacement part is identified based on the position of a streak. When this identification method is stringently applied, both of the drum cleaner 15 for yellow and the drum cleaner 15 for magenta will be identified as replacement parts in accordance with the streak St1. In addition, the drum cleaner 15 for magenta will be identified as a replacement part in accordance with the streak St3.

Figure 22B:
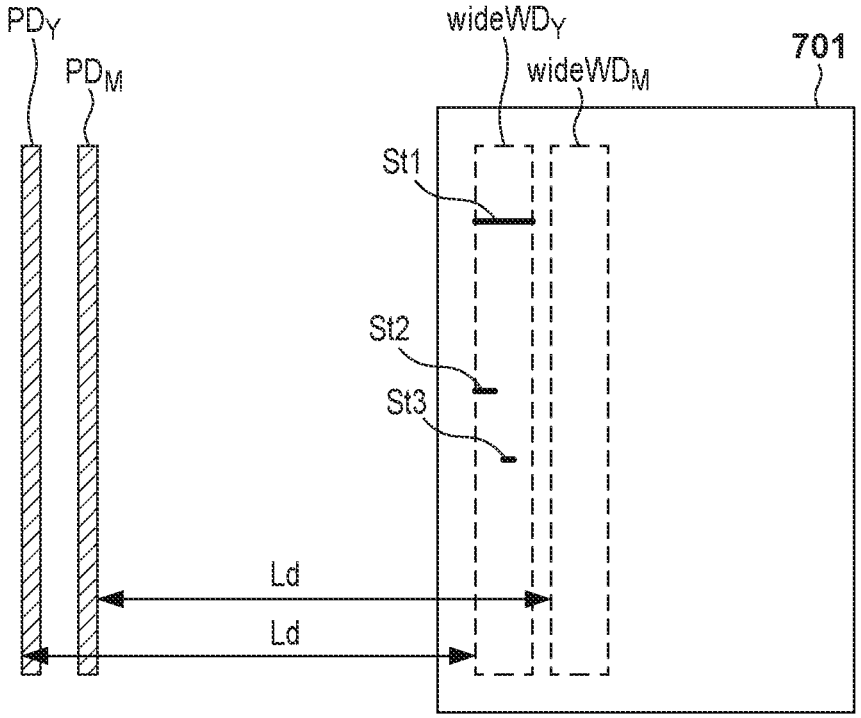

FIG. 22B illustrates a test chart 701 and a method of identifying a replacement part, according to the third embodiment. A wide blank portion WideWD is applied as a blank portion with respect to a patch PD. The length of the wide blank portion WideWD is longer than the length of the patch PD in the test chart 701. For example, the streaks St1 to St3 which are due to the photosensitive drum 11 for yellow are all positioned inside a wide blank portion $WideWD_Y$. Accordingly, the CPU 60 can correctly identify the photosensitive drum 11 for yellow as a replacement part, based on the streaks St1 to St3.

Note that, if a wide blank portion WideWD for one of Y, M, C, and Bk overlaps with another adjacent wide blank portion WideWD, it will be difficult to accurately identify a replacement part based on the position of a streak. Accordingly, the chart generation unit 64 shifts the formation start positions of the patches $PD_M$, $PD_C$, and $PD_{Bk}$ in accordance with the respective formation start positions of the wide blank portions $WideWD_M$, $WideWD_C$, and $WideWD_{Bk}$. However, a distance between a patch PD and a wide blank portion WideWD is maintained at the circumferential length Ld of the photosensitive drum 11.

In this way, the third embodiment can identify a replacement part more accurately than in the second embodiment by devising, in the test chart 701, a position for forming a patch PD, and a position and length of a wide blank portion WideWD. Note that a wide blank portion can be similarly applied for a blank portion WT that corresponds to the patch PT.

Fourth Embodiment

When an electrophotographic image forming apparatus is used for a long time, it is necessary to replace a consumable part that makes up the image forming apparatus. When a "streak image" that follows a sub scanning direction or a main scanning direction occurs on a sheet, it is often indicates that it is time to replace or clean a consumable part. Japanese Patent Laid-Open No. 2017-040758 discloses a technique for predicting a malfunctioning part by outputting an image by an image forming apparatus, reading the image by an image reader, and detecting whether a streak has occurred or a position or width of a streak based on a read result. Japanese Patent Laid-Open No. 2014-134673 discloses a technique for forming a test image on an intermediate transfer member, and detecting a white streak that occurs in the test image by a sensor that moves in a main scanning direction of the intermediate transfer member.

The invention recited in Japanese Patent Laid-Open No. 2017-040758 cannot distinguish which of a cleaning mechanism of a photosensitive drum and a cleaning mechanism of the intermediate transfer belt should be replaced. With the invention of Japanese Patent Laid-Open No. 2014-134673, the manufacturing cost of the image forming apparatus increases because a number of sensors equal to the number of intermediate transfer members and photosensitive members is necessary.

[Print System]

Figure 23:
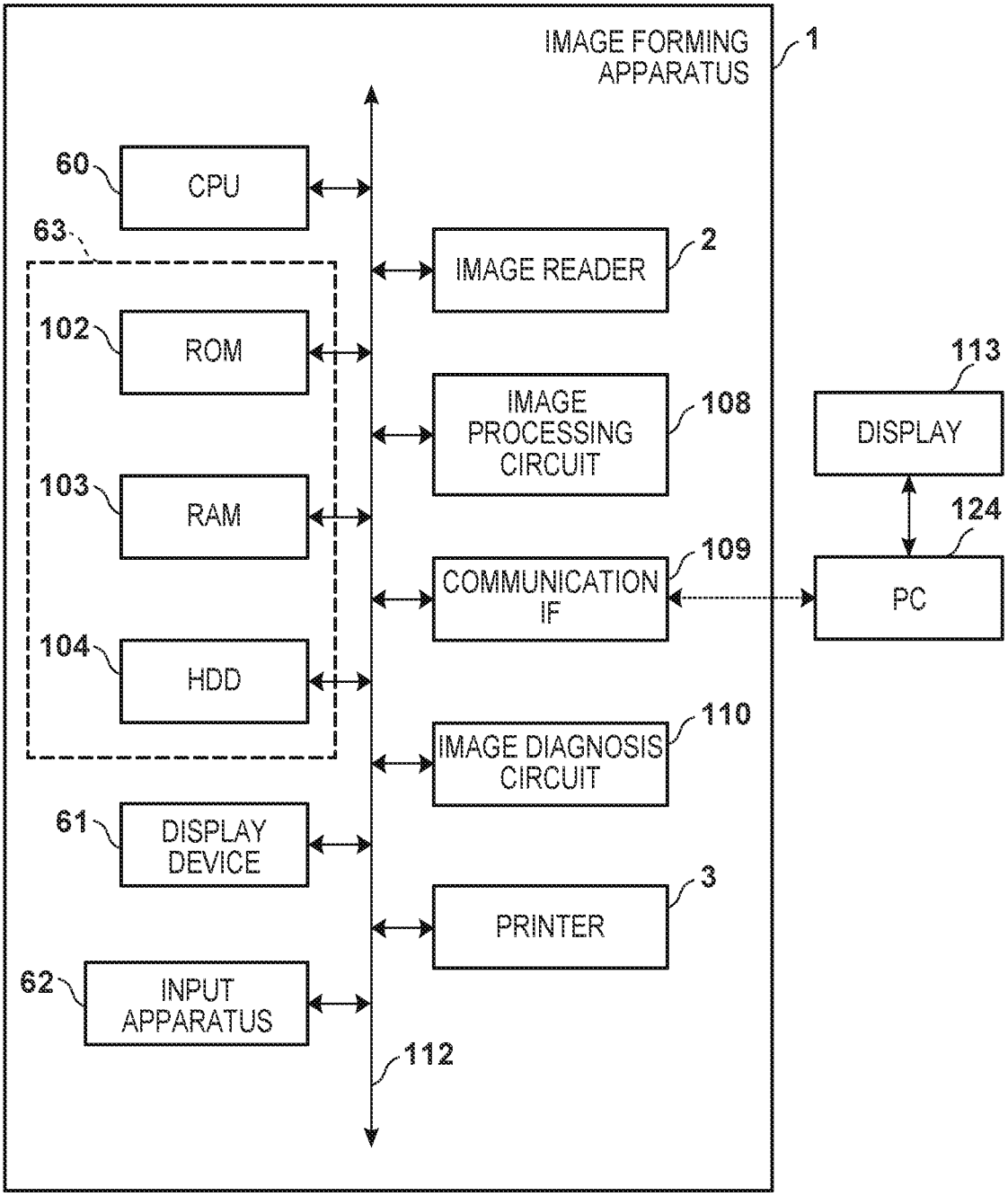
FIG. 23 is a view illustrating an image forming system.

An image forming system illustrated in FIG. 23 comprises the image forming apparatus 1 and the PC 124. Note that description of parts that has already been described may be omitted.

The image forming apparatus 1 has the CPU 60, a ROM 102, a RAM 103, an HDD 104, the display apparatus 61, the input apparatus 62, the image reader 2, an image processing circuit 108, an image diagnosis circuit 110, the printer 3, and a system bus 112. Note that the image forming apparatus 1 also has the communication IF 109 for communicating with the PC 124, which belongs to a user or a service person. A display 113 is connected to the PC 124.

The CPU 60 is a central processing unit that comprehensively controls the entirety of the image forming apparatus 1. The CPU 60 executes later-described image processing in accordance with a control program stored in the ROM 102. The ROM 102 is a read-only memory, and stores a system boot program, a program for controlling the image reader 2 and the printer 3, character data, character code information, or the like. The RAM 103 is a random-access memory, and a program or data stored in the ROM 102 is loaded into the RAM 103 by the CPU 60 for each of a variety of processes. The RAM 103 stores an image file that is received from the image reader 2 or the communication IF 109. The HDD 104 is a hard disk, a solid-state drive, or the like, for example. The HDD 104 stores a result of processing executed by the CPU 60, a program, various information files, a print image, or the like. The HDD 104 is used as a work region when the CPU 60 executes processing. The display apparatus 61 is an output apparatus such as a liquid crystal display apparatus, for example. The display apparatus 61 displays guidance for a user, a setting state of the image forming apparatus 1, or the like. The guidance may be a message prompting that a diagnosis chart be read by the image reader 2. In addition, the display apparatus 61 displays information indicating a replacement part that is predicted from a read result of the diagnosis chart. The input apparatus 62 is used when a user inputs various instructions such as a setting change or a setting reset. The CPU 60 stores in the RAM 103 and uses various instructions that have been inputted via the input apparatus 62. The image reader 2 emits light onto an original, converts light reflected from the original into an electrical signal by, for example, a CCD that is provided with RGB color filters, and outputs the electrical signal to the image processing circuit 108. The image processing circuit 108 performs, for example, a color space conversion (RGB→YMCK or Lab) or a tone correction on the RGB image signal (image data). The image processing circuit 108 converts PDL (Page Description Language) data received from the PC 124 via the communication IF 109 to bitmap data. The image diagnosis circuit 110 is a circuit for predicting a replacement part based on read data relating to a diagnosis chart (a test chart) outputted from the image reader 2. Some or all of the image diagnosis circuit 110 may be realized by the CPU 60 executing a control program. In addition, some or all of the functions realized by the CPU 60 may be realized by a hardware circuit such as a DSP (digital signal processor) or an FPGA.

The printer 3 forms a visible image on a sheet using image data in a CMYK format that is outputted from the image processing circuit 108. The printer 3 uses electrophotography to form a toner image, but configuration may be taken to use ink instead of toner to form an ink image. Toner and ink may be referred to as colorants. The system bus 112 is a communication channel that is connected to various circuit components that configure the image forming apparatus 1, and is used to transmit and receive information between circuit components. The display 113 accepts a diagnosis result (for example, information indicating a replacement part) of a diagnosis chart outputted from the image diagnosis circuit 110, and displays the result to a service person or the like. The PC 124 is connected to the image forming apparatus 1 via the communication IF 109. The PC 124 displays, on the display 113, an image or an analysis result transmitted from the image forming apparatus 1. In other words, the display 113 is an example of a screen for making a notification of a fault location. In this screen is displayed information that indicates a replacement part based on a result determined by the CPU 60 and the image diagnosis circuit 110. The CPU 60 and the image diagnosis circuit 110 are an example of a controller for controlling an image forming unit and a reading unit. Note that the image forming unit 10 is an example of an image forming unit for forming a toner image on an image carrier. The image reader 2 is an example of a reading unit for reading an image formed on a sheet P.

[Image Diagnosis]

Figure 24:
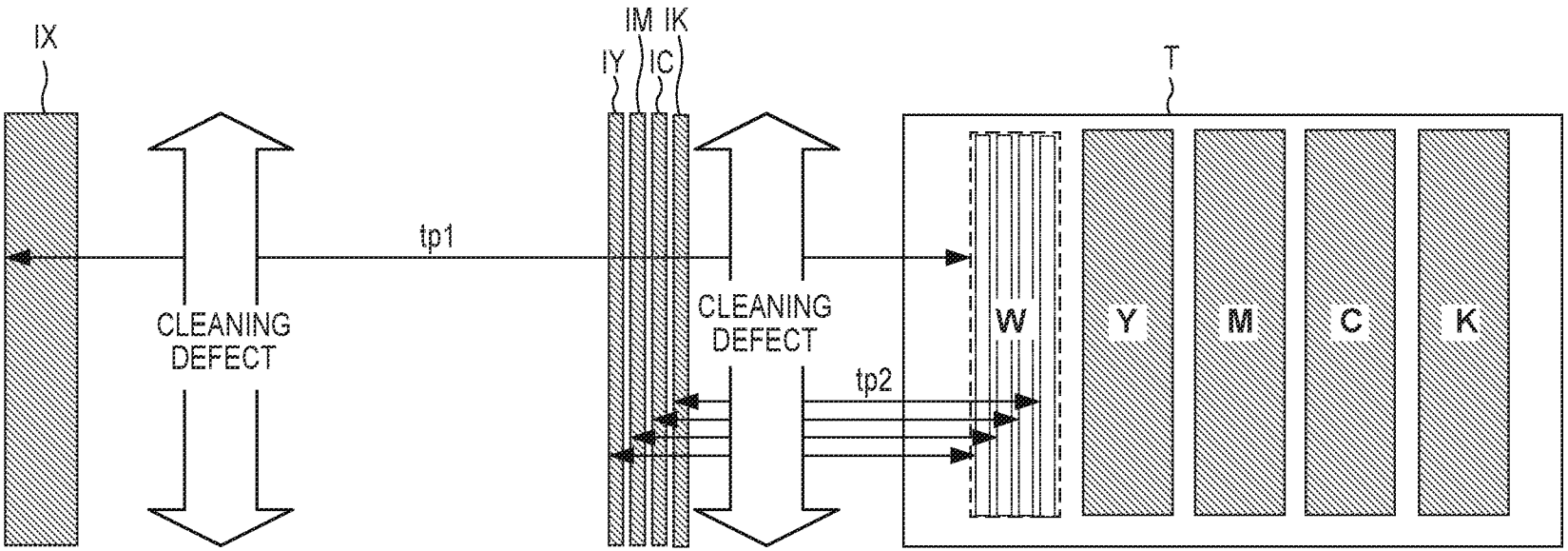
FIG. 24 is a view illustrating a diagnosis chart and a pattern image.

FIG. 24 illustrates a relationship between a diagnosis chart T and pattern images IY, IM, IC, IK, and IX for making a streak image be apparent. The pattern images IY, IM, IC, IK, and IX differ from user images, and are images for supplying toner to a cleaning mechanism in order to make a streak image be apparent. The diagnosis chart T has a blank region W, a yellow monochrome band image Y, a magenta monochrome band image M, a cyan monochrome band image C, and a black monochrome band image K. The yellow monochrome band image Y, the magenta monochrome band image M, the cyan monochrome band image C, and the black monochrome band image K are test images used for identifying a replacement part that is not a cleaning mechanism, and may be omitted. The image diagnosis circuit 110 identifies which out of the drum cleaners 15Y, 15M, 15C, and 15K and the belt cleaner 35 should be replaced based on the color of a streak image formed in the blank region W.

The image diagnosis circuit 110 forms the pattern images IY, IM, IC, and IK on the photosensitive drums 11 at timings that precede timings for forming the blank region W on the photosensitive drums 11 by an amount of time tp2 required for the photosensitive drum 11 to rotate once. The image diagnosis circuit 110 controls the transfer voltage of the primary transfer device 17 so that the pattern images IY, IM, IC, and IK are not transferred to the intermediate transfer belt 31. By this, the drum cleaners 15 remove the pattern images that are on the photosensitive drums 11. In a case where a drum cleaner 15 should be replaced, because developer for a pattern image slips through a defect location of the drum cleaner 15, a streak image (a cleaning defect) occurs on a photosensitive drum 11. At a timing when a surface region of the photosensitive drum 11 corresponding to the blank region W passes by the primary transfer device 17, the image diagnosis circuit 110 applies the primary transfer voltage to the primary transfer device 17 to transfer the streak image to the intermediate transfer belt 31. At a timing when a surface region of the intermediate transfer belt 31 that corresponds to the blank region W passes by the secondary transfer portion, the image diagnosis circuit 110 causes the secondary transfer device 27 to make contact with a sheet P, and applies the secondary transfer voltage to the secondary transfer device 27. By this, a monochrome streak image is transferred to the blank region W.

The image diagnosis circuit 110 forms a toner image for the pattern image IX on the photosensitive drums 11 at a timing that precedes the timing for forming the blank region W on the photosensitive drums 11 by an amount of time tp1 required for the intermediate transfer belt 31 to rotate once. By aligning a plurality of toner images of respectively different colors and overlapping them on the intermediate transfer belt 31, a pattern image IX is formed. The color of the pattern image IX may be a color that can be distinguished from Y, M, C, and K, and, for example, is a mixed color formed by using two or more toners out of Y, M, C, and K. The image diagnosis circuit 110 keeps the secondary transfer device 27 in a separated state when the pattern image IX passes through the secondary transfer portion. By this, the belt cleaner 35 removes the pattern image IX that is on the intermediate transfer belt 31. In a case where the belt cleaner 35 should be replaced, because developer for a pattern image slips past a defect location on the belt cleaner 35, a streak image (a cleaning defect) occurs on the intermediate transfer belt 31. At a timing when a surface region of the intermediate transfer belt 31 corresponding to the blank region W passes by the secondary transfer portion, the image diagnosis circuit 110 applies the secondary transfer voltage to the secondary transfer device 27 to transfer the streak image to a sheet P. While the sheet P is passing through the secondary transfer portion, the secondary transfer device 27 is kept in a state of contact. By this, a mixed color streak image is transferred to the blank region W.

In this way, the image diagnosis circuit 110 forms a diagnosis chart T for identifying a replacement part by controlling the image forming unit to form a predetermined blank region W on a sheet where a toner image is not formed. The image diagnosis circuit 110 controls the image forming unit 10 to form a pattern image on a photosensitive drum 11 at a second timing that precedes a first timing for forming the blank region W on the photosensitive drum 11 by an amount of time required for the photosensitive drum 11 to rotate once. The pattern images IY, IM, IC, and IK are examples of monochromatic pattern images. For example, a timing for starting to write a latent image corresponding to the pattern image IY on the photosensitive drum 11Y by a laser beam is an example of a second timing. A timing for starting to form a latent image corresponding to the blank region W on the photosensitive drum 11Y is an example of a first timing. Because the blank region W is a region where toner does not adhere, a laser beam is not emitted. In this way, a time difference between the second timing and the first timing is the amount of time required for the photosensitive drum 11 to rotate once. The image diagnosis circuit 110 causes a first removal member to remove a monochromatic pattern image, formed using toner of a first color, without the monochromatic pattern image being transferred to the intermediate transfer belt 31. The image diagnosis circuit 110 applies a primary transfer voltage of a first polarity to the primary transfer device 17 when transferring a toner image from the photosensitive drum 11 to the intermediate transfer belt 31. The image diagnosis circuit 110 applies a primary transfer voltage of a second polarity to the primary transfer device 17 when not transferring a toner image from the photosensitive drum 11 to the intermediate transfer belt 31. The first polarity and the second polarity are different. The image diagnosis circuit 110 controls the image forming unit 10 to form a second toner image on the photosensitive drum 11 at a third timing that precedes a first timing by an amount of time required for the intermediate transfer belt 31 to rotate once, and then transfer the second toner image to the intermediate transfer belt 31. The pattern image IX is an example of a mixed-color pattern image. The image diagnosis circuit 110 causes another removal member to remove the mixed-color pattern image, and then forms the diagnosis chart T by the image forming unit 10. The color of the monochromatic pattern image and the color of the mixed-color pattern image are different. The image diagnosis circuit 110 controls the image forming unit 10 to form the yellow pattern image IY on the photosensitive drum 11Y at a timing that precedes a timing for forming the blank region W on the photosensitive drum 11Y by an amount of time required for the photosensitive drum 11Y to rotate once, and causes the drum cleaner 15Y to remove the yellow pattern image IY without the yellow pattern image IY being transferred to the intermediate transfer belt 31. The image diagnosis circuit 110 controls the image forming unit 10M to form the magenta pattern image IM on the photosensitive drum 11M at a timing that precedes a timing for forming the blank region W on the photosensitive drum 11M by an amount of time required for the photosensitive drum 11M to rotate once, and causes the drum cleaner 15M to remove the magenta pattern image IM without the magenta pattern image IM being transferred to the intermediate transfer belt 31. The image diagnosis circuit 110 controls the image forming unit 10C to form the cyan pattern image IC on the photosensitive drum 11C at a timing that precedes a timing for forming the blank region W on the photosensitive drum 11C by an amount of time required for the photosensitive drum 11C to rotate once, and causes the drum cleaner 15C to remove the cyan pattern image IC without the cyan pattern image IC being transferred to the intermediate transfer belt 31. The image diagnosis circuit 110 controls the image forming unit 10K to form the black pattern image IK on the photosensitive drum 11K at a timing that precedes a timing for forming the blank region W on the photosensitive drum 11K by an amount of time required for the photosensitive drum 11K to rotate once, and causes the drum cleaner 15K to remove the black pattern image IK without the black pattern image IK being transferred to the intermediate transfer belt 31. The image diagnosis circuit 110 controls the image forming unit to form a toner image of a first color on a first photosensitive member at a timing that precedes a timing for forming a blank region on the first photosensitive member by an amount of time required for the intermediate transfer belt 31 to rotate once, and transfer the toner image of the first color to the intermediate transfer member, controls the image forming unit to form a toner image of a second color on a second photosensitive member at a timing before a timing for forming a blank region W on the second photosensitive member by an amount of time required for the intermediate transfer member to rotate once, and transfer the toner image of the second color to the intermediate transfer member, causes a fifth cleaner to clean a toner image of a mixed color formed by overlapping the toner image of the first color and the toner image of the second color, and thereby forms the diagnosis chart. The image diagnosis circuit 110 causes the reading unit to read the diagnosis chart, and identifies one of a first cleaner, a second cleaner, a third cleaner, a fourth cleaner, and a fifth cleaner as a replacement part, based on a read result of the diagnosis chart.

In FIG. 24, a length in the sub scanning direction of the pattern images IY, IM, IC, IK, and IX is shorter than a length in the sub scanning direction of the blank region W, but they may be substantially equal. It is possible to convey more toner to the cleaning mechanism by lengthening the pattern images IY, IM, IC, IK, and IX, and thus it is easier to make a streak image apparent. In FIG. 24, the pattern images IY, IM, IC, and IK do not overlap. Provisional configuration may be taken to adjust the position of respective latent images for the pattern images IY, IM, IC, and IK so that the pattern images IY, IM, IC, and IK overlap on the intermediate transfer belt 31 when they are transferred to the intermediate transfer belt 31. This is useful to lengthen the pattern images IY, IM, IC, and IK.

[Image Diagnosis Flow]

Figure 25:
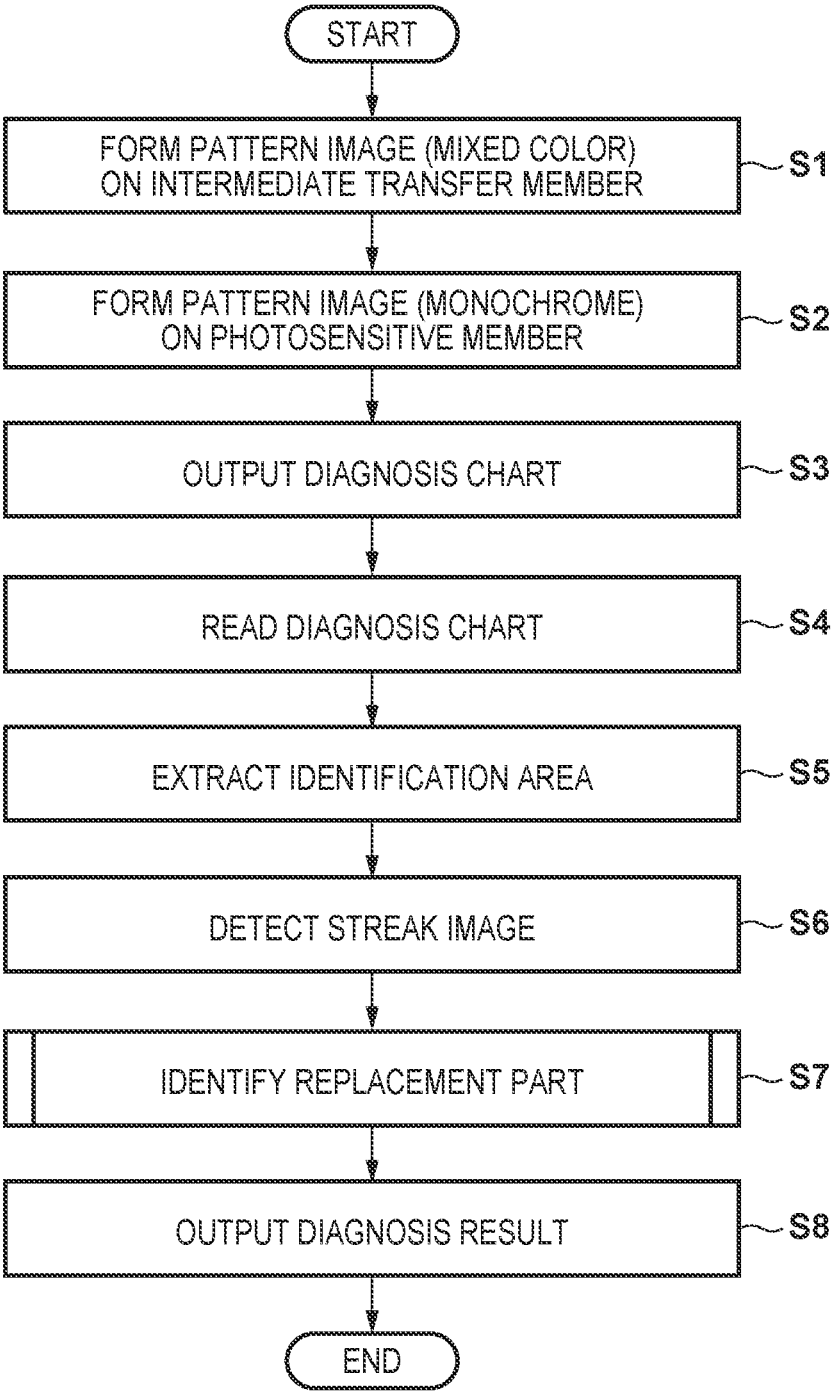
FIG. 25 is a flowchart illustrating image diagnosis processing.
Figure 26:
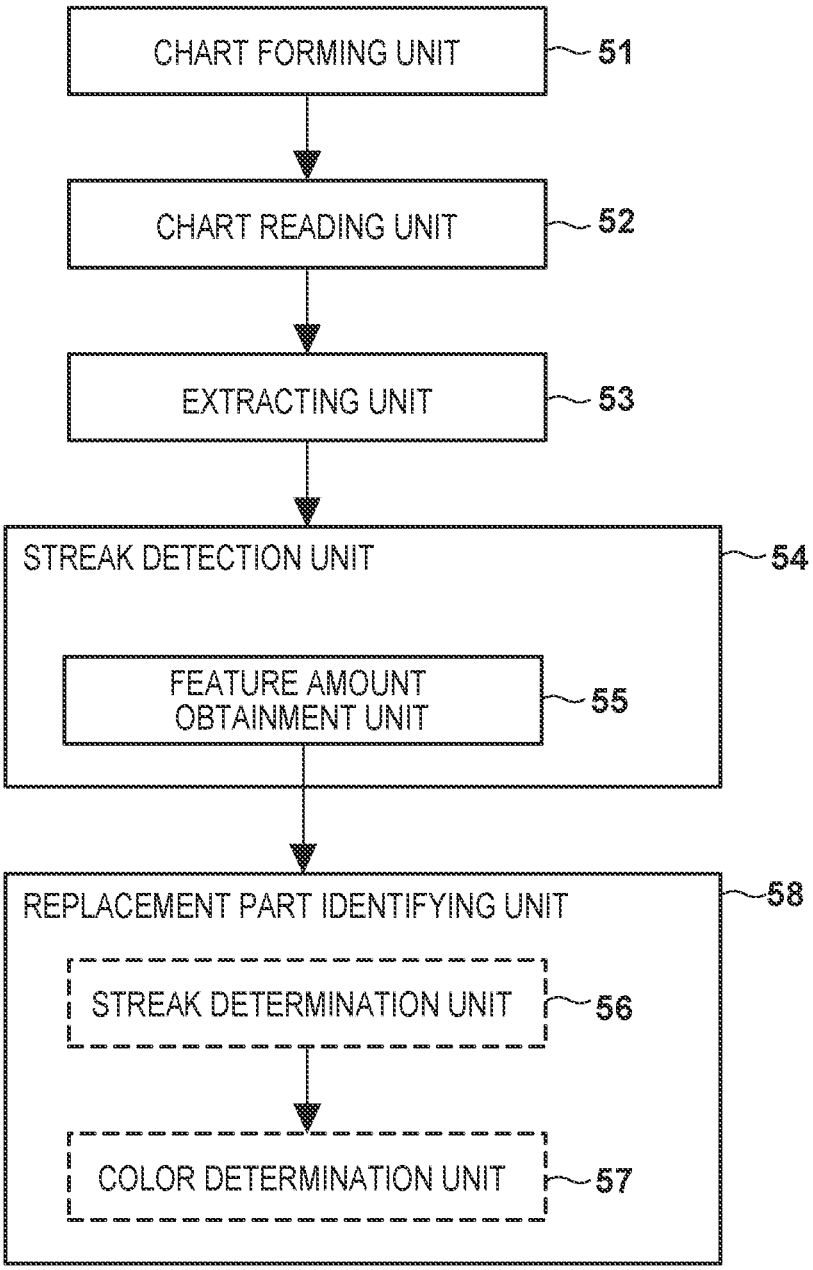
FIG. 26 is a view for describing functionality of an image diagnosis circuit.

FIG. 25 illustrates image diagnosis processing executed by the image diagnosis circuit 110. FIG. 26 illustrates functions of the image diagnosis circuit 110. Upon discovering a defective image, a user operates the input apparatus 62 to instruct the CPU 60 to start image diagnosis processing. In accordance with the instruction, the CPU 60 activates the image diagnosis circuit 110 and executes image diagnosis processing. Alternatively, a user may telephone a service center, and a service person of the service center operates the PC 124 to instruct the CPU 60 to execute image diagnosis processing.

In step S1, the image diagnosis circuit 110 forms the pattern image IX for supplying toner to the belt cleaner 35 on the intermediate transfer belt 31. A chart forming unit 51 controls two or more image forming units out of the four image forming units 10Y through 10K to form a mixed color toner image on the intermediate transfer belt 31. Here, it is sufficient if the color of the pattern image IX is a color that can be distinguished from a monochromatic toner image, such as one of red, green, and blue (mixed-color toner), for example. A toner image for forming the pattern image IX is formed on the photosensitive drum 11 at a timing before a timing for forming the blank region W for the diagnosis chart T on the photosensitive drum 11, by an amount of time tp1 needed for one rotation of the intermediate transfer belt 31. If it is necessary for the belt cleaner 35 to be replaced, a streak image of the same color as the color of the pattern image IX will be transferred to the blank region W of the diagnosis chart T. The image diagnosis circuit 110 may control the image forming unit 10 to form the pattern image IX using two or more from out of a first toner color, a second toner color, a third toner color, and a fourth toner color.

In step S2, the image diagnosis circuit 110 forms pattern images for supplying toner to the drum cleaners 15 on the photosensitive drums 11. The chart forming unit 51 controls each of the four image forming units 10Y through 10K to form the monochromatic pattern image IY through IK on the photosensitive drums 11Y through 11K. The chart forming unit 51 forms the pattern images IY to IK on the photosensitive drums 11 at timings before the timings for forming the blank region W on the photosensitive drums 11 by the amount of time tp2. If it is necessary for a drum cleaner 15 to be replaced, a streak image of the same color as the color of a corresponding one of the pattern images IY to IK will be transferred to the blank region W of the diagnosis chart T.

In step S3, the image diagnosis circuit 110 controls the printer 3 to form the diagnosis chart T. The chart forming unit 51 reads the test image data for forming the diagnosis chart T (a test chart) from the HDD 104, and outputs the test image data to the printer 3. The printer 3 forms the diagnosis chart T based on the test image data. The blank region W is formed at a timing when the amount of time tp2 has elapsed from the timing when the pattern image IY was formed on the photosensitive drum 11Y. It is similar for the photosensitive drums 11M to 11K. In addition, the blank region W is formed at a timing when the amount of time tp1 has elapsed from the timing when the pattern image IX was formed on the intermediate transfer belt 31.

In step S4, a chart reading unit 52 of the image diagnosis circuit 110 controls the image reader 2 to read the diagnosis chart T. A read result of the diagnosis chart T (read data in an RGB format) may be stored in the RAM 103 or the HDD 104. At this point, the pattern images IY to IK will be cleaned if the drum cleaners 15Y through 15K are each normal. Accordingly, a streak image will not appear in the diagnosis chart T. If any of the drum cleaners 15Y through 15K is not normal, a streak image of a color corresponding to a drum cleaner 15 that is not normal will occur in the blank region W or the like. If the belt cleaner 35 is not normal, a streak image of a color that is the same as the color of the pattern image IX will occur in the blank region W or the like.

Figure 27:
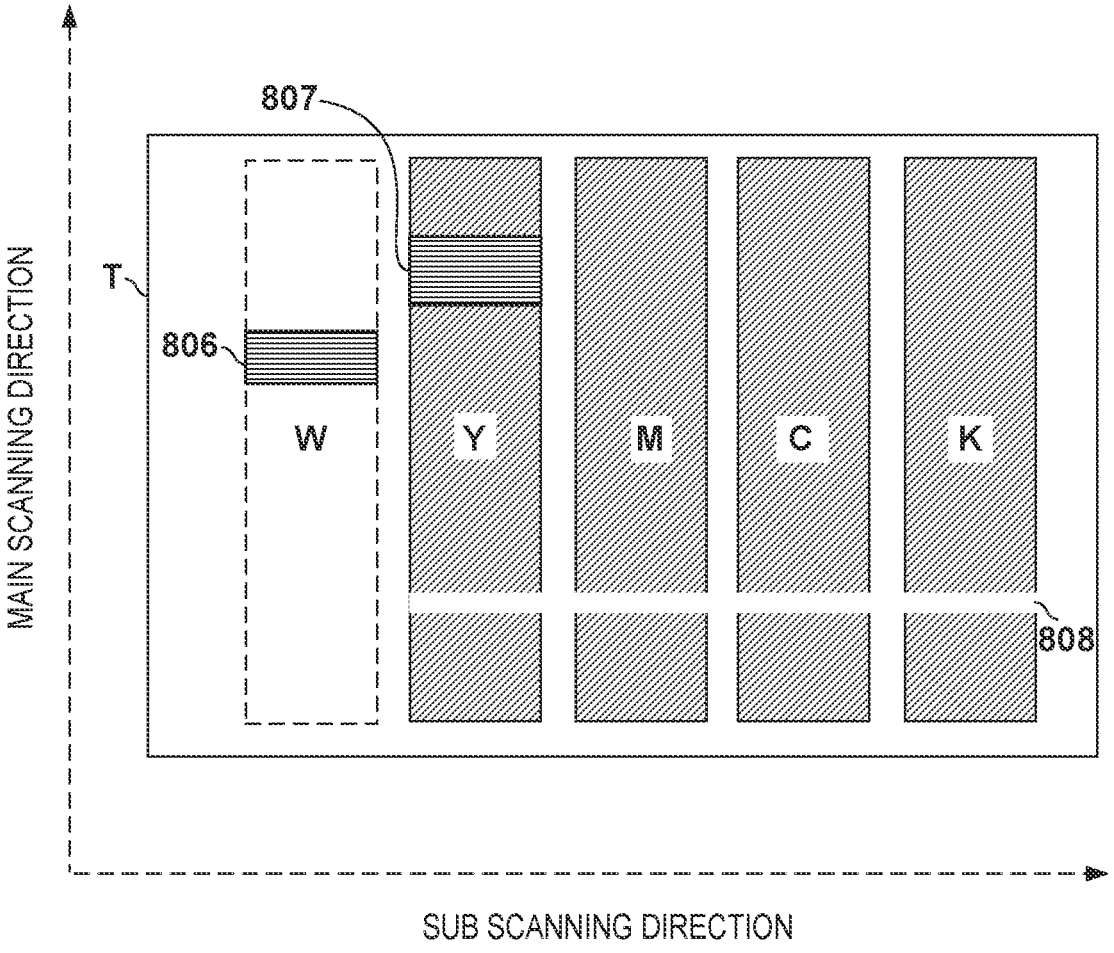
FIG. 27 is a view illustrating an example of printing a diagnosis chart.

FIG. 27 illustrates an example of printing a diagnosis chart T. The sub scanning direction is a direction parallel to the conveyance direction of the diagnostic sheet T. The main scanning direction is a direction orthogonal to the sub scanning direction. In this example, a streak image 806 occurs in the blank region W. A streak image 807 occurs in the band image Y. A streak image 808 occurs in each of the band images Y through K. The streak image 806 is a monochromatic or mixed-color streak image that occurred by it not being possible to successfully clean one of the pattern images IY, IM, IC, IK, and IX. The width in the main scanning direction of the streak image 807 is relatively wide. The density of the streak image 807 is relatively high. The width in the main scanning direction of the streak image 808 is relatively narrow. A density of the streak image 808 is relatively low. Long side directions of the streak images 806 and 807 are parallel to the sub scanning direction.

In step S5, the image diagnosis circuit 110 extracts a specific area from the read result of the diagnosis chart T. An extracting unit 53 extracts read data corresponding to the blank region W or read data corresponding to each of the band images Y through K from the read result of the diagnosis chart T. Coordinates of an extracted region may be fixed, or may be dynamically decided. For example, the extracting unit 53 may use a luminance difference between the band images Y, M, C, and K and blank portions of peripheries thereof to extract read data corresponding to the band images Y, M, C, and K. In addition, the extracting unit 53 may identify coordinates of the blank region W from coordinates of the band images Y, M, C, and K, and then extract read data of the blank region W. Note that the extracting unit 53 may store coordinate data of the band images Y, M, C, and K or the blank region W in a read result of a diagnosis chart T in the HDD 104.

Figure 28A:
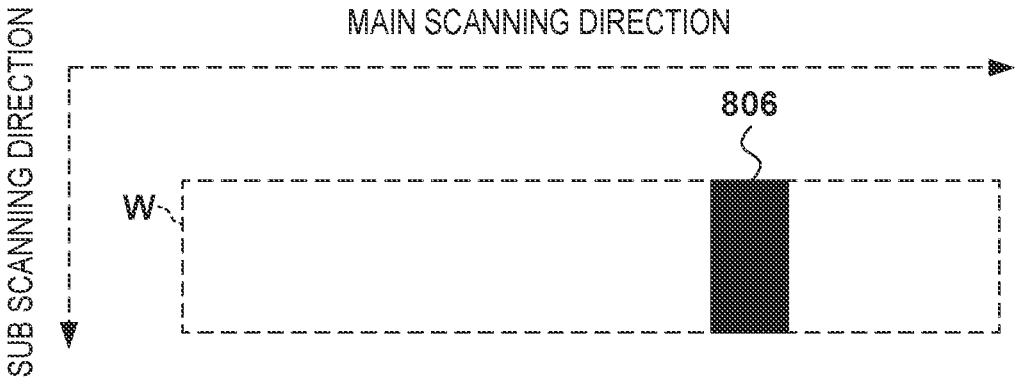
FIGS. 28A to 28C are views for describing detection processing of a streak image.

FIG. 28A illustrates a result of extracting the blank region W. Similarly, results of extracting the band images Y, M, C, and K are also stored in the HDD 104.

In step S6, a streak detection unit 54 of the image diagnosis circuit 110 selects read data of each region from the diagnosis chart T, and detects a streak image based on a result of analyzing the read data for each region. As illustrated by FIG. 28A, a streak image occurs in parallel with the sub scanning direction. Accordingly, the streak detection unit 54 obtains, from the read data, respective pixel values of a plurality of pixels (sub scanning lines) that line up in parallel with the sub scanning direction. One pixel has three luminance values (pixel values) corresponding to R, G, and B. The streak detection unit 54 may convert pixel values in an RGB format to a density, or the streak detection unit 54 calculates an average value of density for each sub scanning line.

Figure 28B:
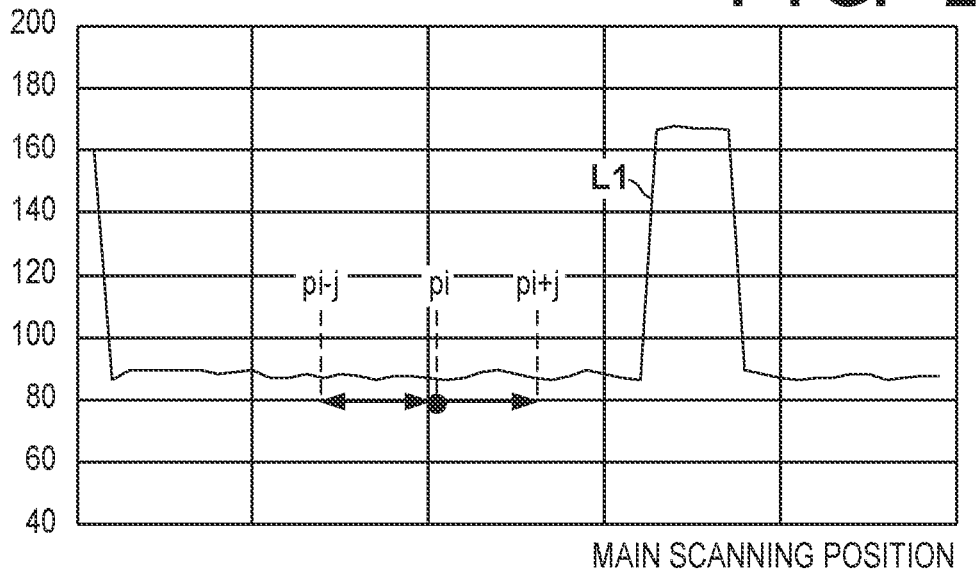

FIG. 28B illustrates an average density L1 for each main scanning position (sub scanning line). The abscissa indicates main scanning positions. The ordinate indicates density. The average density L is relatively large at the main scanning positions where the streak image 806 is present.

The streak detection unit 54 may correct the average density L1. For example, the streak detection unit 54 may reduce noise included in the average density L1 by executing a moving average with respect to the average density L1 for each main scanning position.

The streak detection unit 54 calculates an average density value Li for each position of interest pi. The average density Li is obtained from average densities L of a plurality of main scanning positions in a predetermined range in the main scanning direction, centered on the position of interest pi indicated by FIG. 28B. In this example, a range from a main scanning position pi+1 until a main scanning position pi+j is set as a target. In this way, an average value of the j average densities L is the average density Li. The streak detection unit 54 calculates an average density L'i for each position of interest pi. As illustrated by FIG. 28B, the average density L'i is an average value of the average densities L from a main scanning position pi−j until a main scanning position pi−1. The streak detection unit 54 determines the presence or absence of a streak by calculating a difference (hereinafter referred to as difference data) between the average density Li and the average density L'i, and comparing the difference with a threshold value stored in the HDD 104 in advance.

Figure 28C:
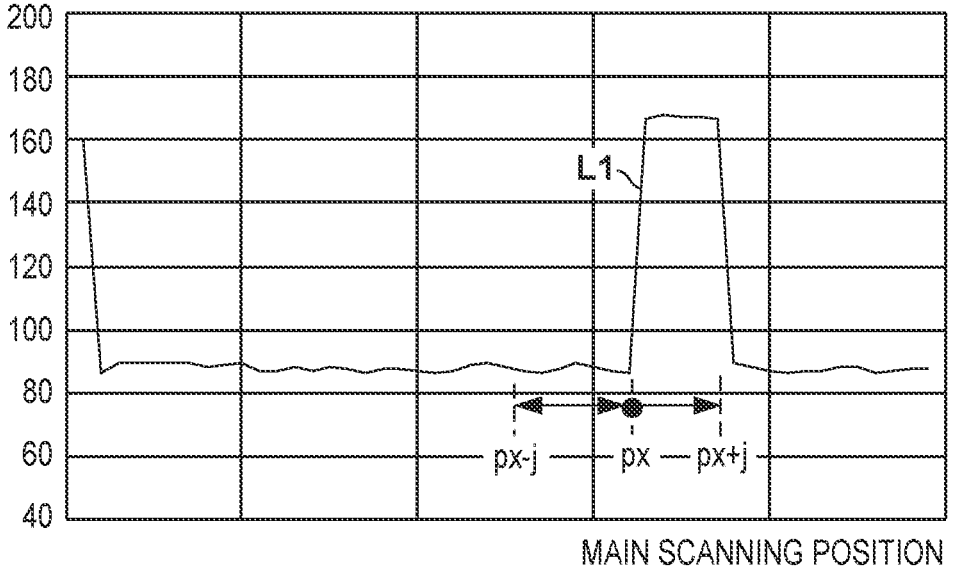

As illustrated by FIG. 28C, if the difference data of a certain main scanning position x exceeds the threshold value th, the streak detection unit 54 determines that there is a streak at the main scanning position x. If the difference data of the certain main scanning position x does not exceed the threshold value th, the streak detection unit 54 determines that there is no streak at the main scanning position x. By this, the presence or absence of a streak image is determined for all main scanning positions in the blank region W. Note that the streak detection unit 54 may obtain RGB pixel values at the plurality of main scanning positions "where a streak image is detected" and calculate an average value for each of R, G, and B. These average values may be referred to as streak signal values. A feature amount obtainment unit 55 of the streak detection unit 54 obtains, as feature amounts, position data indicating a start position of a streak image, position data indicating an end position, width data indicating a distance from the start position to the end position, and a streak signal value, and stores these in the HDD 104. Streak detection processing may be executed in the band regions Y through K in addition to the blank region W. The feature amount obtainment unit 55 extracts feature amounts from the read result of the blank region W formed on the diagnosis chart T.

In step S7, the image diagnosis circuit 110 identifies a replacement part based on the result of detecting the streak image. In step S8, the image diagnosis circuit 110 outputs a diagnosis result that includes information such as a replacement part to the display apparatus 61 or the display 113. In this way, the image diagnosis circuit 110 includes an identifying unit for causing the reading unit to read a diagnosis chart T, and identifying one of the first cleaning unit and the second cleaning unit as a replacement part based on a read result of the diagnosis chart T.

[Diagnosis Result]

FIG. 29 illustrates an example of an image diagnosis result. The image diagnosis circuit 110 creates an image diagnosis result 901, and displays the image diagnosis result 901 on the display apparatus 61. Replacement part information 902 includes identifying information (such as a name) of a replacement part identified based on a result of detecting a streak image. Identification accuracy information 903 is a degree that indicates identification accuracy. The streak detection unit 54 uses information that was used when detecting the streak image to decide the identification accuracy information 903. The identification accuracy information 903 may be indicated as a number such as a percentage, and may be indicated as a level such as high, medium, and low.

A user may notify an image diagnosis result to a service person (a maintenance person). The service person can grasp identification accuracy and the existence or absence of a replacement part based on the image diagnosis result. In other words, the service person can grasp identification accuracy and the existence or absence of a replacement part without going to an installation location of the image forming apparatus 1. By this, service efficiency increases because the service person can head to the installation location after preparing a replacement part. The image diagnosis circuit 110 may display the image diagnosis result on the display 113 through the communication IF 109. In such a case, effort for a user to notify a diagnosis result to a service person is eliminated. The image diagnosis result 901 may include detailed information of a streak, for example.

[Identification of a Replacement Part]

Figure 30A:
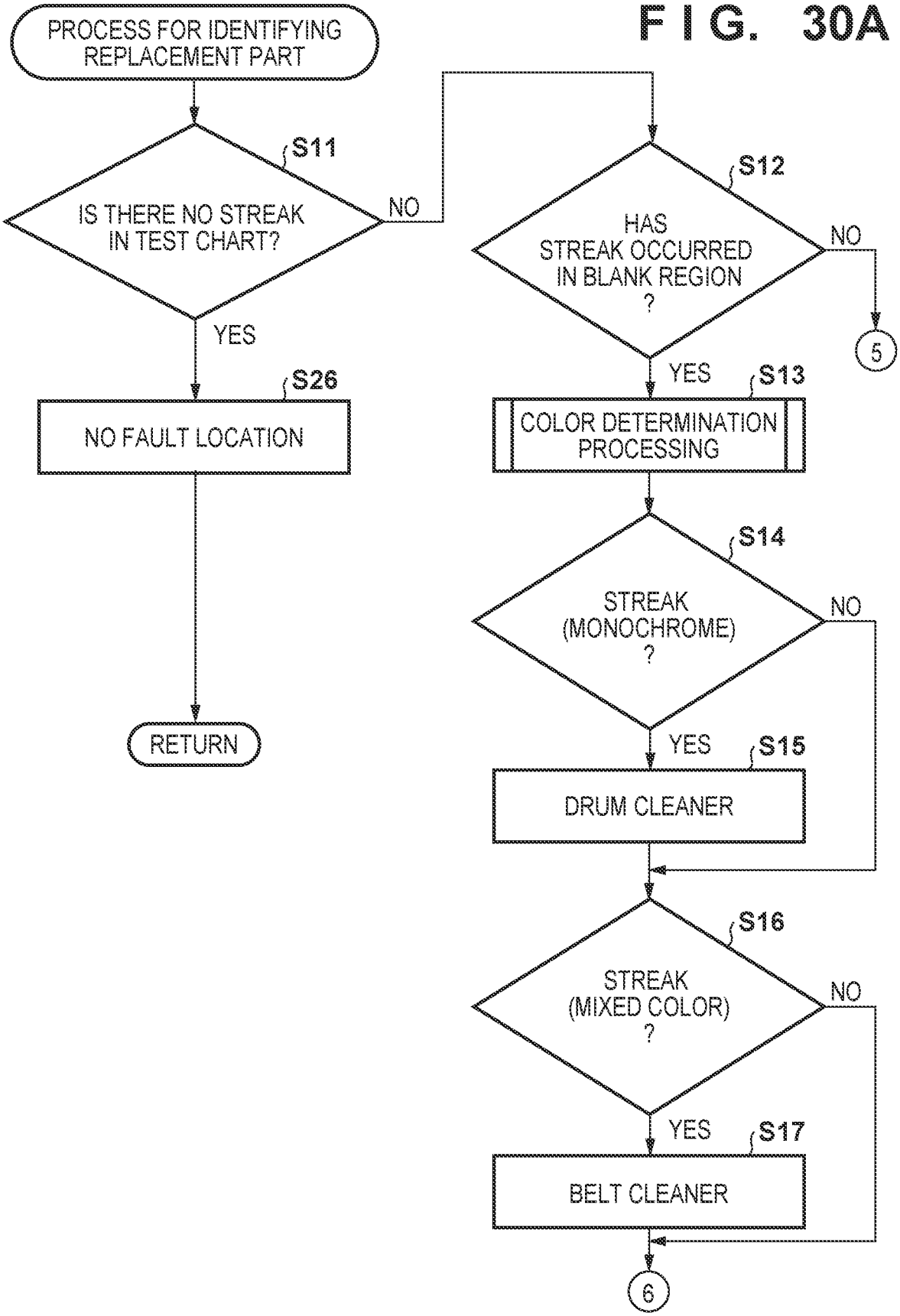
FIGS. 30A and 30B are flowcharts illustrating processing for identifying a replacement part.
Figure 30B:
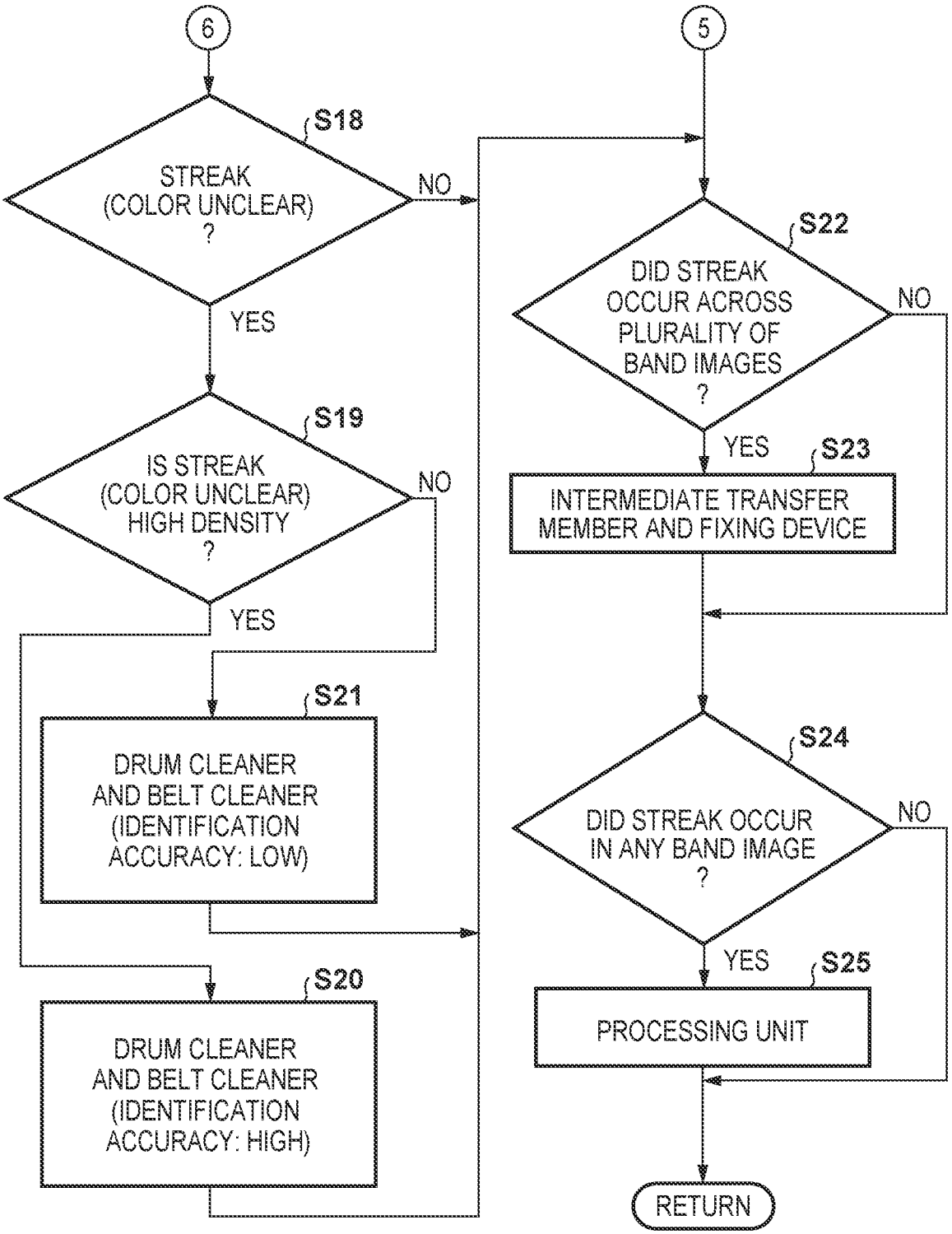

FIGS. 30A and 30B illustrate detail of processing for identifying a malfunctioning part (step S7). The following processing is executed by a replacement part identifying unit 58 of the image diagnosis circuit 110. The replacement part identifying unit 58 has a streak determination unit 56 and a color determination unit 57. The replacement part identifying unit 58 is configured to identify a replacement part based on the feature amounts extracted from the read result of the blank region W, first feature amounts for the pattern images IY to IK, and a second feature amount for the pattern image IX. The color determination unit 57 distinguishes a color of a streak image formed on the blank region W based on the feature amounts extracted from the read result of the blank region W, the first feature amounts and the second feature amount. The replacement part identifying unit 58 identifies a replacement part based on the color distinguished.

The streak determination unit 56 determines, based on a result of detection by the streak detection unit 54, whether a streak has been detected from the diagnosis chart (step S11). If the streak detection unit 54 has not detected a streak from the diagnosis chart T, the image diagnosis circuit 110 determines that there is no fault location (step S26). As a result, the replacement part identifying unit 58 determines that there is no replacement part, and ends the processing for identifying a replacement part.

In contrast, if, in step S11, the streak detection unit 54 has detected a streak from the diagnosis chart T, the streak determination unit 56 determines whether the streak occurred in a blank region (step S12). In step S12, the streak determination unit 56 determines, based on feature amounts stored in the HDD 104, whether a streak image has occurred in the blank region W. For example, is a streak is inside the blank region W from the position data, the streak determination unit 56 determines that a streak image has occurred in the blank region W. If a streak image has occurred in a blank region W in step S12, the streak determination unit 56 executes color determination processing (step S13). In step S13, the color determination unit 57 determines the color of the streak image based on feature amounts of the streak image that has occurred in the blank region W. From the feature amounts, streak signal values are used to determine the color of the streak. The color determination unit 57 classifies the color of the streak as one of "monochrome", "mixed color" and "color unclear".

After the color determination processing is executed, the replacement part identifying unit 58 determines whether to detect a monochromatic streak from the blank region W (step S14). If it is determined in the color determination processing that the color of the streak is a monochrome (yellow, magenta, cyan, or black), the replacement part identifying unit 58 identifies the drum cleaner 15 of the image forming unit corresponding to the monochrome determined as the replacement part (step S15). For example, if it is determined that the color of a streak detected in the blank region W is yellow, the replacement part identifying unit 58 identifies the yellow drum cleaner 15Y as a replacement part. In addition, for example, if it is determined that the colors of a plurality of streaks detected in the blank region W are magenta and black, the replacement part identifying unit 58 identifies the magenta drum cleaner 15M and the black drum cleaner 15K as replacement parts.

Next, after the color determination processing is executed, the replacement part identifying unit 58 determines whether to detect a mixed color streak from the blank region W (step S16). If it is determined in the color determination processing that the color of a streak is a mixed color (a mixed color recited in the present embodiment is red), the replacement part identifying unit 58 identifies the belt cleaner 35 as a replacement part (step S17). Furthermore, after the color determination processing is executed, the replacement part identifying unit 58 determines whether a streak with an unclear color has been detected from the blank region W (step S18). If it is determined in the color determination processing that the color of a streak is unclear, the streak determination unit 56 determines whether the density of the streak is a high density (step S19). If a brightness of the streak whose color is unclear is less than a threshold value thL in step S19, the replacement part identifying unit 58 identifies the drum cleaner 15 and the belt cleaner 35 as replacement parts, and also sets identification accuracy to a high level (step S20). The replacement part identifying unit 58 then causes the processing to transition to step S22.

In contrast, a brightness of the streak whose color is unclear is greater than or equal to threshold value thL in step S19, the replacement part identifying unit 58 identifies the drum cleaner 15 and the belt cleaner 35 as replacement parts, and also sets identification accuracy to a low level (step S21). If the density of the streak is low, it is also possible for a part other than a cleaning mechanism to be involved with the streak image. Consequently, the replacement part identifying unit 58 sets identification accuracy to a low level. The replacement part identifying unit 58 then causes the processing to transition to step S22.

The streak determination unit 56 determines whether the streak image 808 is detected at the same main scanning position for the band images Y through K (step S22). In step S22, for example, the streak determination unit 56 refers to the feature amounts, and determines whether streak images of the same width have been detected at the same main scanning position in all of the band images Y through K. If the streak image 808 is detected at the same main scanning position in all of the band images Y through K, the replacement part identifying unit 58 identifies the fixing device 40 and the intermediate transfer belt 31 as replacement part. This is because the fixing device 40 and the intermediate transfer belt 31 are parts shared for all toner colors (step S23). The replacement part identifying unit 58 then causes the processing to transition to step S24. In addition, even if a streak image is not detected at the same main scanning position in all of the band images Y through K, the replacement part identifying unit 58 causes the processing to transition to step S24. For example, if the streak image 807 has occurred in the band image Y but a streak image has not occurred in the band images M, C, and K, the replacement part identifying unit 58 causes the processing to transition to step S24.

The streak determination unit 56 determines whether there is a band image in which a streak has occurred, from out of the band images Y through K (step S24). In step S24, the replacement part identifying unit 58 identifies the processing unit (including the drum cleaner 15, the photosensitive drum 11, the charging device 12, the exposure device 13, and the developing device 14) corresponding to the color of the band image in which the streak image occurred as a replacement part. For example, if the streak image 807 is detected in the band image Y, the replacement part identifying unit 58 identifies the processing unit for yellow as a replacement part. After a replacement part is identified, the image diagnosis circuit 110 ends the processing for identifying the replacement part. In addition, even if there is no band image in which a streak occurred, the image diagnosis circuit 110 ends the processing for identifying a replacement part.

<Color Determination Processing>

Figure 31:
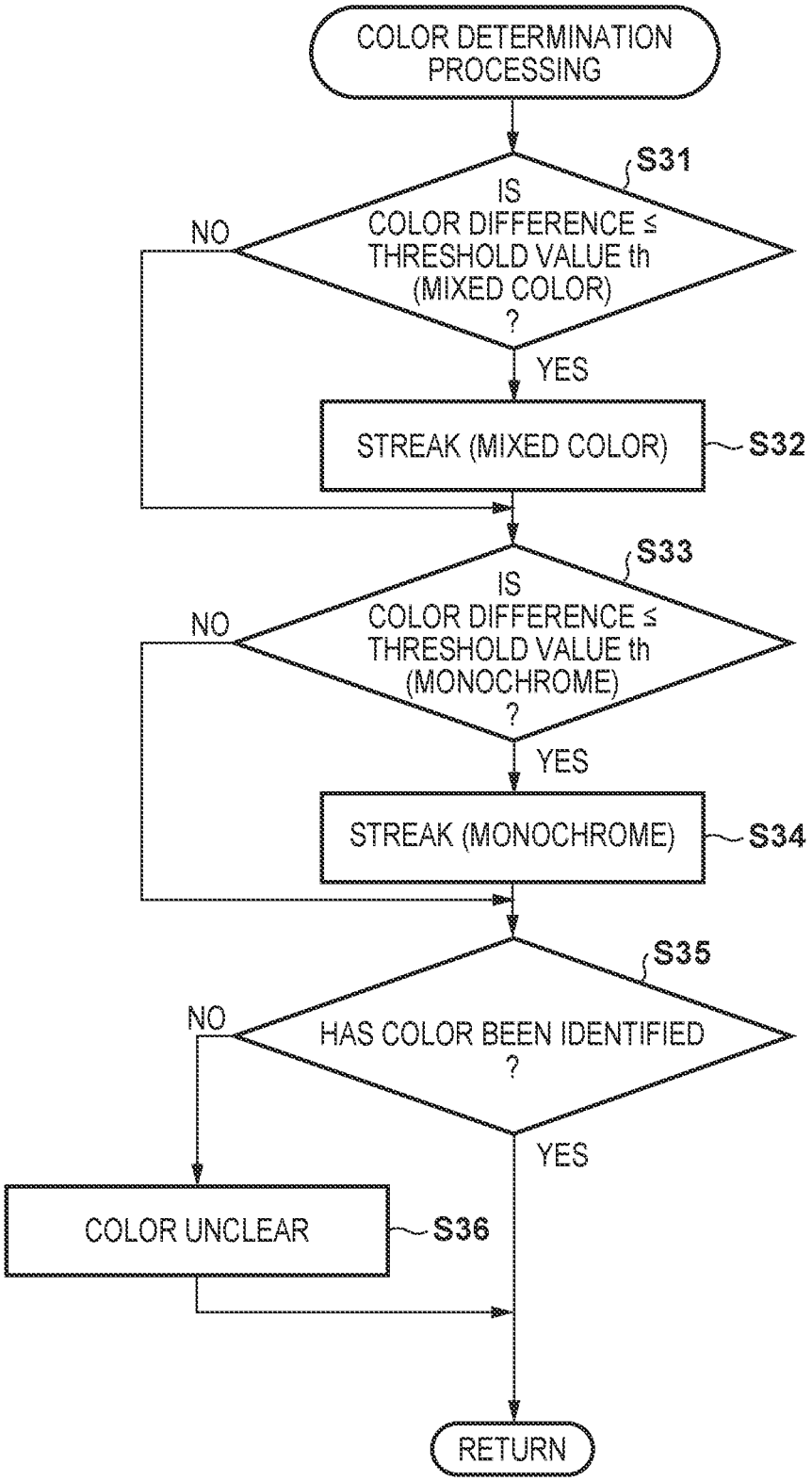
FIG. 31 is a flowchart illustrating color determination processing.

FIG. 31 illustrates detail of color determination processing (step S13). When the color determination processing is started, firstly the color determination unit 57 determines whether a color difference between the color of a streak and red is less than or equal to the threshold value th (step S31). A reference value (a L*a*b* value) indicating a predetermined color (red) is stored in the HDD 104 in advance. To obtain the color difference, the color determination unit 57 performs a color conversion on the streak signal values (RGB values) from the feature amounts to convert them to L*a*b* values. If the color difference between the color of the streak and red is less than or equal to the threshold value th in step S31, the color determination unit 57 determines that the color of the streak is a mixed color (red) (step S32). In order to determine the color of all streaks, the color determination unit 57 transitions the processing to step S33.

Figure 32A:
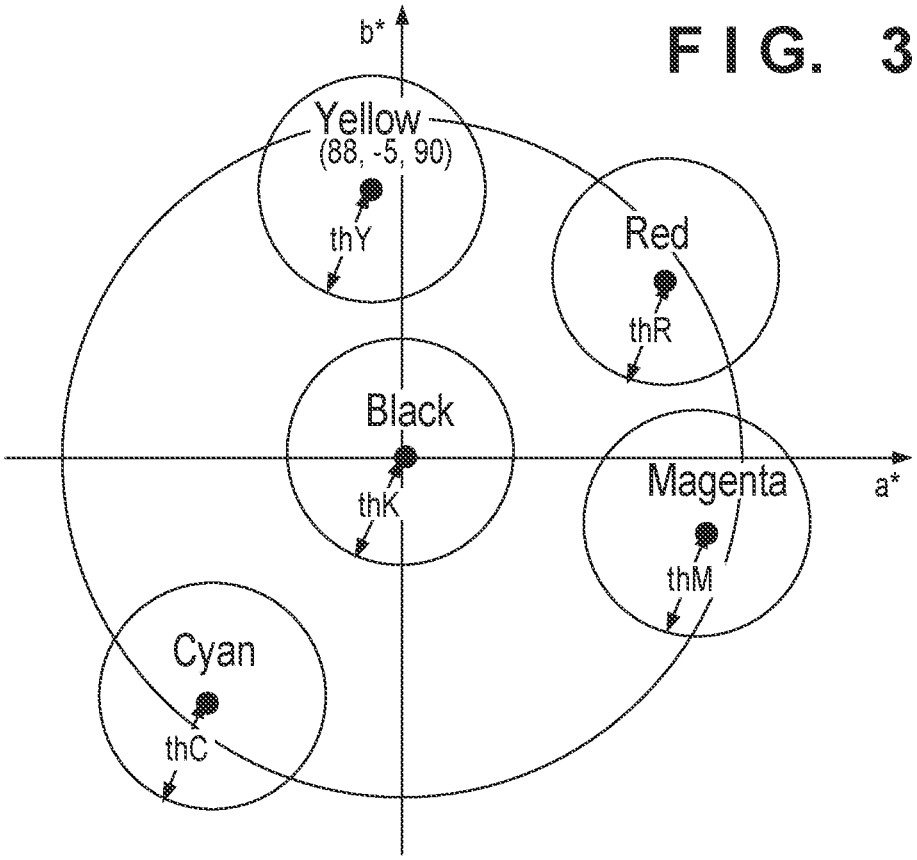
FIGS. 32A and 32B are views illustrating examples of threshold values and reference values for a color determination.
Figure 32B:
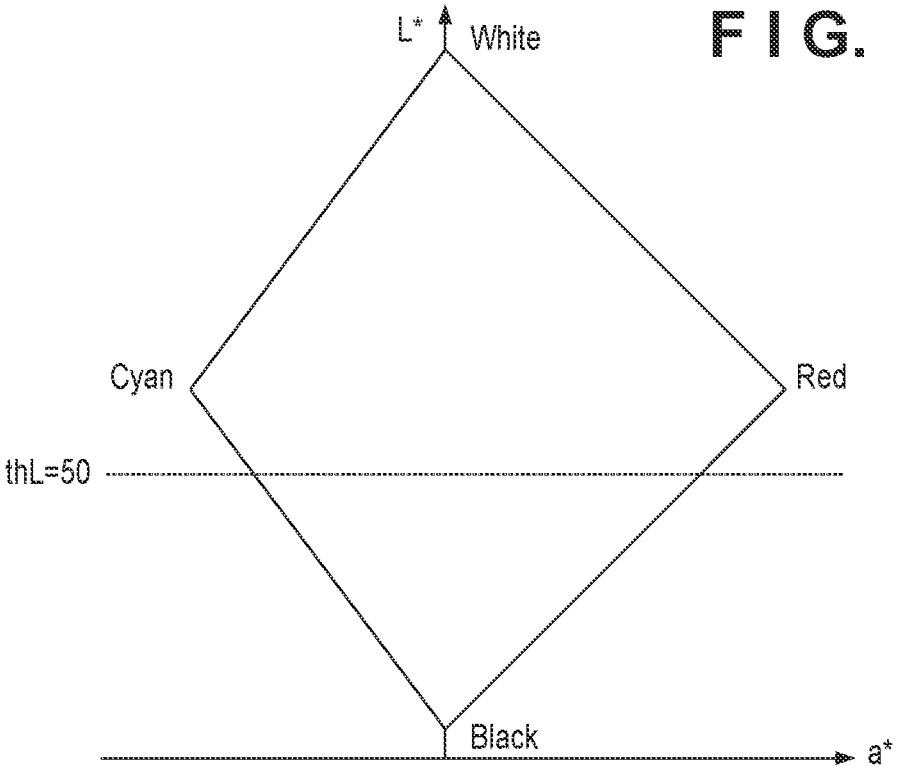

In addition, if the color difference between the color of the streak and red is greater than the threshold value th in step S31, the color determination unit 57 determines whether a color difference between the color of the streak and a monochrome (yellow, magenta, cyan, or black) is less than or equal to the threshold value th (step S33). FIG. 32A and FIG. 32B illustrate a reference value indicated by red, and reference values respectively indicated by yellow, magenta, cyan, and black, in the L*a*b* color system. Y, M, C, and K and red may be referred to as reference colors. These reference values are represented by L*a*b* values. The color difference is a Euclidean distance between the L*a*b* value of the streak image and a reference value. For a color difference ΔEab, a calculation equation of CIE 1994 or 2000 defined by the International Commission on Illumination (CIE) may be used, for example. The color determination unit 57 obtains a color difference for each reference value, and determines whether the color difference is less than or equal to a threshold value. If the color of the streak image is close to any reference color, in other words, if the color difference is less than or equal to the threshold value, the color determination unit 57 determines that the color of the streak is the reference color with which the color difference is low.

For example, in an a*b* plane of the L:*a*b* three-dimensional space illustrated in FIG. 32A, the reference value for yellow is (88, −5, 90). A threshold value thY is a color difference threshold value. For example, the threshold value thY is 2. In other words, if the color of a streak image in the three-dimensional space is present within a circle that is centered on the reference value for yellow and whose radius is the threshold value thY, it is determined that the color of the streak image is yellow (step S34). Note that, for the processing of step S33, the color of a streak image is similarly compared with the other reference colors. In step S34, the closest monochrome is determined.

After the color of a streak image has been compared with all reference colors, the color determination unit 57 transitions the processing to step S35. The color determination unit 57 determines whether the color of a streak has been identified from out of yellow, magenta, cyan, black, and red (step S35). If the streak color has been identified, the color determination unit 57 ends the color determination processing. However, if the color of a streak has not been identified in step S35, the color determination unit 57 sets the color of the streak as color unclear (step S36), and ends the color determination processing.

By virtue of the fourth embodiment with this arrangement, because the diagnosis chart T is read by the image reader 2, an image sensor does not need to be provided for the photosensitive drums 11 or the intermediate transfer belt 31. In other words, a cost reduction for the image forming apparatus 1 is realized. In addition, it is possible to identify, based on the color of a streak image detected from the blank region W, a replacement part from out of a cleaning mechanism that includes the belt cleaner 35 provided on the intermediate transfer belt 31, and the drum cleaner 15 provided for each the photosensitive drum 11. For example, if a color difference between the color of a streak image and yellow (a first color) is less than or equal to a threshold value, the replacement part identifying unit 58 identifies the drum cleaner 15 (a first removal member), which removes developer that is residual on the yellow photosensitive member (a first photosensitive member), as a replacement part. In addition, for example, if a color difference between the color of a streak image and magenta (a second color) is less than or equal to a threshold value, the replacement part identifying unit 58 identifies the drum cleaner 15 (a second removal member), which removes developer that is residual on the magenta photosensitive member (a second photosensitive member), as a replacement part. Furthermore, for example, if the color difference between the color of a streak image and red (a predetermined color) is less than or equal to a threshold value, the replacement part identifying unit 58 identifies the belt cleaner 35 (another removal member), which removes developer that is residual on the intermediate transfer belt 31, as a replacement part.

Fifth Embodiment

In the fourth embodiment, before the diagnosis chart T is created, toner is supplied to the drum cleaner 15 by the pattern images IY to IK, and toner is supplied to the belt cleaner 35 by the pattern image IX. By this, a streak image is made apparent on the diagnosis chart T, and one of the drum cleaners 15 and the belt cleaner 35 is identified as a replacement part.

However, in the fourth embodiment, when a plurality of drum cleaners 15 meet their time of replacement at the same time, it is possible for a streak image of a mixed color to occur and for the color of the streak image to match the color of the pattern image IX. For example, when the drum cleaner 15Y and the drum cleaner 15M are unable to sufficiently remove toner, the color of the streak image becomes red which is a mixed color of yellow and magenta. Accordingly, because the color of the streak image matches the color of the pattern image IX, the belt cleaner 35 would be mistakenly identified as a replacement part. Accordingly, in order to correctly identify a replacement part even if a plurality of drum cleaners 15 are meeting their time of replacement, the diagnosis chart of the fifth embodiment has respectively a blank portion W1 where a streak due to a fault of a drum cleaner 15 occurs, and a blank portion W2 where a streak due to a fault of the belt cleaner 35 occurs. Note that, in the fifth embodiment, description in common with that of the fourth embodiment is omitted. In the fifth embodiment, the diagnosis chart T, step S1, step S2, and step S5 are changed from those in the fourth embodiment.

<Diagnosis Chart>

Figure 33:
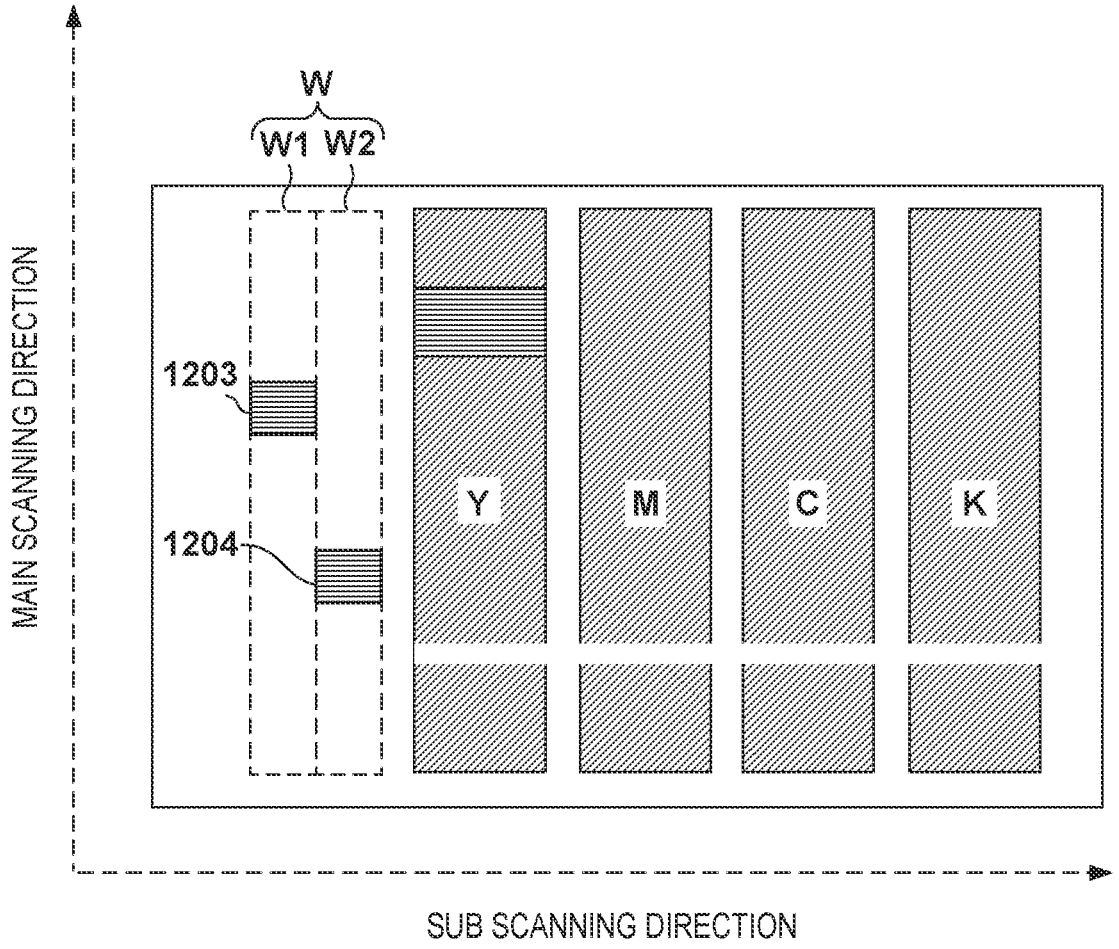
FIG. 33 is a view illustrating an example of printing a diagnosis chart.

FIG. 33 illustrates a diagnosis chart T used in the fifth embodiment. The blank region W has a first blank portion W1 and a second blank portion W2. In the fourth embodiment, the pattern images IY to IK, and IX are formed at timings so that a streak image due to a drum cleaner 15 and a streak image due to the belt cleaner 35 are transferred to the blank region W. In fifth embodiment, the pattern images IY to IK are formed at timings so that a streak image 1203 due to a drum cleaner 15 occurs in the first blank portion W1. In addition, the pattern image IX is formed at a timing so that a streak image 1204 due to the belt cleaner 35 occurs in the second blank portion W2. The extracting unit 53 extracts the first blank portion W1 from the read result of the diagnosis chart T in order to extract the streak image 1203 due to a drum cleaner 15. The extracting unit 53 extracts the second blank portion W2 from the read result of the diagnosis chart T in order to extract the streak image 1204 due to the belt cleaner 35.

[Identification of Replacement Part]

In step S1, the image diagnosis circuit 110 forms the pattern image IX for supplying toner to the belt cleaner 35 on the intermediate transfer belt 31. The chart forming unit 51 controls two or more image forming units 10 out of the four image forming units 10Y through 10K to form a mixed color toner image on the intermediate transfer belt 31. The pattern image IX is formed on the intermediate transfer belt 31 at a timing before a timing for forming the second blank portion W2 for the diagnosis chart T on the intermediate transfer belt 31, by the amount of time tp1 needed for one rotation of the intermediate transfer belt 31. If a red pattern image IX is formed, the second blank portion W2 will be formed on the photosensitive drum 11Y at a timing after an amount of time required for the intermediate transfer belt 31 to rotate once has elapsed from a timing when a yellow toner image was formed on the photosensitive drum 11Y. The second blank portion W2 is formed on the photosensitive drum 11M at a timing when a period for one rotation of the intermediate transfer belt 31 has elapsed from a timing when a magenta toner image was formed on the photosensitive drum 11M. Note that the second blank portion W2 on the photosensitive drum 11Y and the second blank portion W2 on the photosensitive drum 11M are aligned and transferred onto the intermediate transfer belt 31.

In step S2, the image diagnosis circuit 110 forms pattern images for supplying toner to the drum cleaners 15 on the photosensitive drums 11. The chart forming unit 51 controls each of the four image forming units 10Y through 10K to form the monochromatic pattern images IY through IK on the photosensitive drums 11Y through 11K. The chart forming unit 51 forms the pattern images IY to IK on the photosensitive drums 11 at timings that are the amount of time tp2 before timings for forming a blank region, corresponding to the first blank portion W1 on the diagnosis chart T, on the photosensitive drums 11. In other words, the first blank portion W1 is formed on a photosensitive drum 11 at a timing when a period for one rotation of the photosensitive drum 11 has elapsed from a timing when a pattern image was formed on the photosensitive drum 11.

In step S5, the image diagnosis circuit 110 extracts a specific area from the read result of the diagnosis chart T. From a read result of the diagnosis chart T, the extracting unit 53 extracts read data corresponding to the first blank portion W1, read data corresponding to the second blank portion W2, and read data respectively corresponding to the band images Y through K.

In step S6, the streak detection unit 54 of the image diagnosis circuit 110 uses the read data corresponding to each region that is an extraction result to detect a streak image. In other words, the streak detection unit 54 separately detects a streak image for the read data corresponding to the first blank portion W1, and the read data corresponding to the second blank portion W2.

Step S12 in FIG. 30A is changed as follows. In step S12, the streak determination unit 56 determines, based on the feature amounts, whether a streak image has occurred in at least one of the first blank portion W1 and the second blank portion W2. If a streak image is not present in both of the first blank portion W1 and the second blank portion W2, the streak determination unit 56 transitions the processing to step S13. If a streak image has occurred in at least one of the first blank portion W1 and the second blank portion W2, the streak determination unit 56 transitions the processing to step S16.

[Color Determination]

Figure 34:
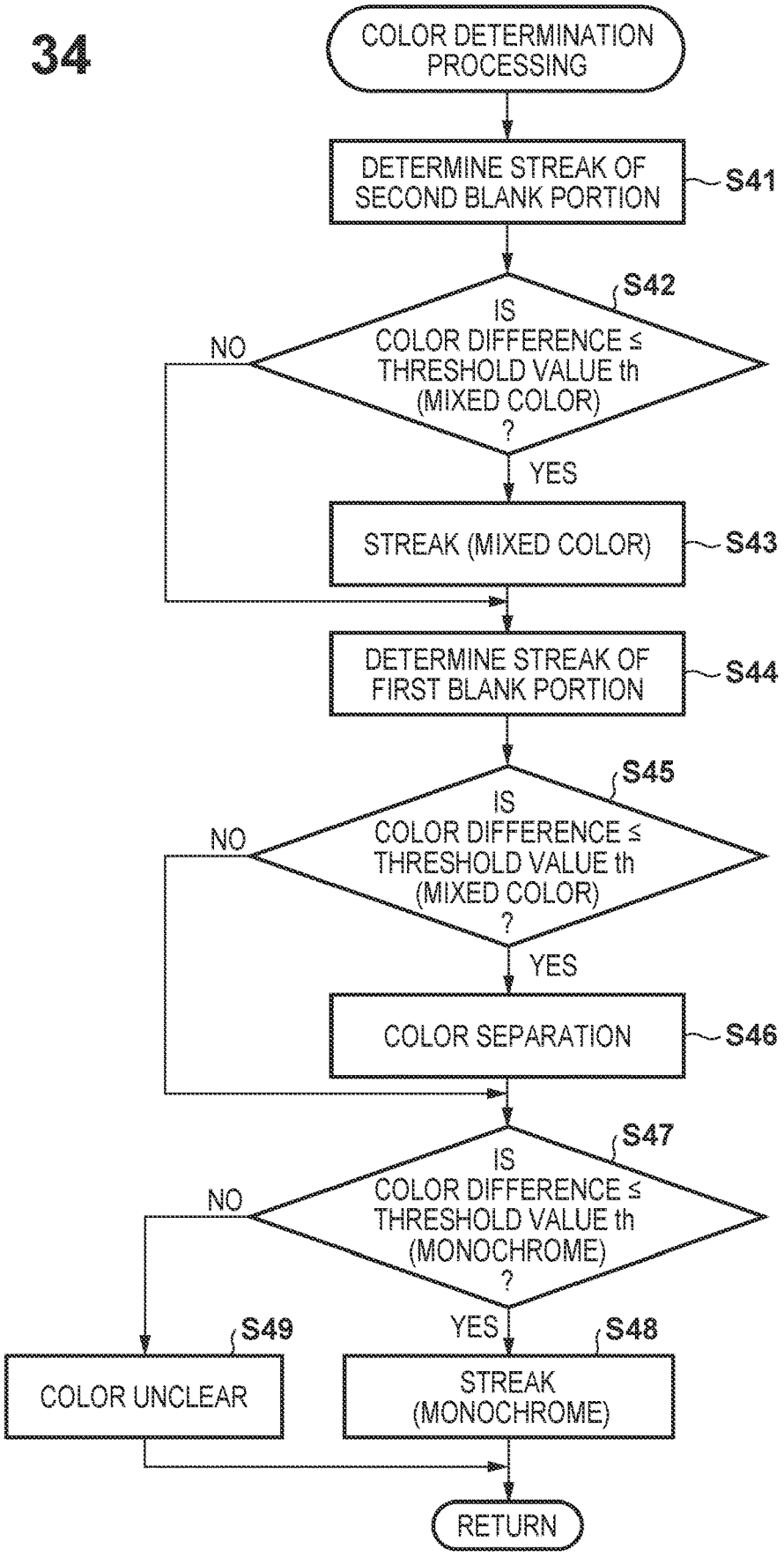
FIG. 34 is a flowchart illustrating color determination processing.

FIG. 34 illustrates detail of color determination processing according to the fifth embodiment. Firstly, the color determination unit 57 determines whether a streak image is present in the second blank portion W2 (step S41). If a streak image is present in the second blank portion W2 in step S41, the color determination unit 57 determines whether a color difference between the color of the streak and red is less than or equal to a threshold value th (step S42). If the color difference between the color of the streak and red is less than or equal to the threshold value th in step S42, the color determination unit 57 determines that the color of the streak is a mixed color (red) (step S43). In order to determine the color of all streaks, the color determination unit 57 transitions the processing to step S44.

Meanwhile, if the color difference between the color of the streak and red is greater than the threshold value th in step S42, the color determination unit 57 causes the processing to transition to step S44 without determining a mixed color streak. The color determination unit 57 determines whether a streak image is present in the second blank portion W2 (step S44).

Meanwhile, if the color difference between the color of the streak and red is greater than the threshold value th in step S42, the color determination unit 57 causes the processing to transition to step S44 without determining a mixed color streak. The color determination unit 57 determines the color of a streak image present in the first blank portion W1 (step S45). If the color difference between the color of the streak of the first blank portion W1 and red is less than or equal to the threshold value th in step S45, the color determination unit 57 performs a color separation on the color of the streak (step S46), and then causes the processing to transition to step S47. Here, a red streak is separated into yellow and magenta. Note that, if the color difference is greater than the threshold value th, the processing is caused to transition to step S47 without a color separation being performed. The processing of step S47 and step S48 is similar to that of step S33 and step S34. Accordingly, detailed description is omitted here. In addition, if the color difference between the color of the streak and any reference color is not less than the threshold value in step S47, the color determination unit 57 sets the color of the streak as unclear, and ends the color determination processing.

In this way, if a plurality of monochromes are identified as the colors of the streak image, in step S17, the replacement part identifying unit 58 identifies the drum cleaners 15 respectively corresponding to the plurality of monochromes as replacement parts. If cyan and yellow are identified, the drum cleaner 15C and the drum cleaner 15Y are identified as replacement parts. If yellow and magenta are identified, the drum cleaner 15Y and the drum cleaner 15M are identified as replacement parts. If cyan and magenta are identified, the drum cleaner 15C and the drum cleaner 15M are identified as replacement parts.

By virtue of the fifth embodiment, it is possible to distinguish between a case where a plurality of drum cleaners 15 are identified as replacement parts, and a case where the intermediate transfer belt 31 is identified as a replacement part. The effect of the fourth embodiment is also achieved in the fifth embodiment. In this way, the blank region W may include a first region (for example, the first blank portion W1) corresponding to a first toner image, and a second region (the second blank portion W2) corresponding to a second toner image. The feature amount obtainment unit 55 extracts a feature amount, which is to be compared with a first feature amount, from the read result of the first region formed on the diagnosis chart T. The feature amount obtainment unit 55 extracts a feature amount, which is to be compared with a second feature amount, from the read result of the second region formed on the diagnosis chart T.

Sixth Embodiment

In step S4 of the first and the fifth embodiments, the diagnosis chart T is read by the image reader 2. A read result of the image reader 2 is influenced by noise or an MTF (Modulation Transfer Function) of the image reader 2. This may cause edges of a streak image that occurs in the diagnosis chart T to blur. In particular, a streak image with a narrow width is strongly influenced in this way. For example, a streak signal value that configures a feature amount may become a value that is brighter than actual brightness. This may reduce the accuracy of the color determination processing.

Accordingly, a plurality of differing threshold values are employed as threshold values for a color determination in the sixth embodiment. By this, the accuracy of the color determination increases. Furthermore, identification accuracy of a replacement part is decided in accordance with which threshold value out of the plurality of threshold values the color determination was made. Accordingly, a user or a service person should be able to more accurately recognize the reliability of a replacement part. In the sixth embodiment, description of portions in common with those in the first or the fifth embodiment is omitted.

[Color Determination]

Figure 35A:
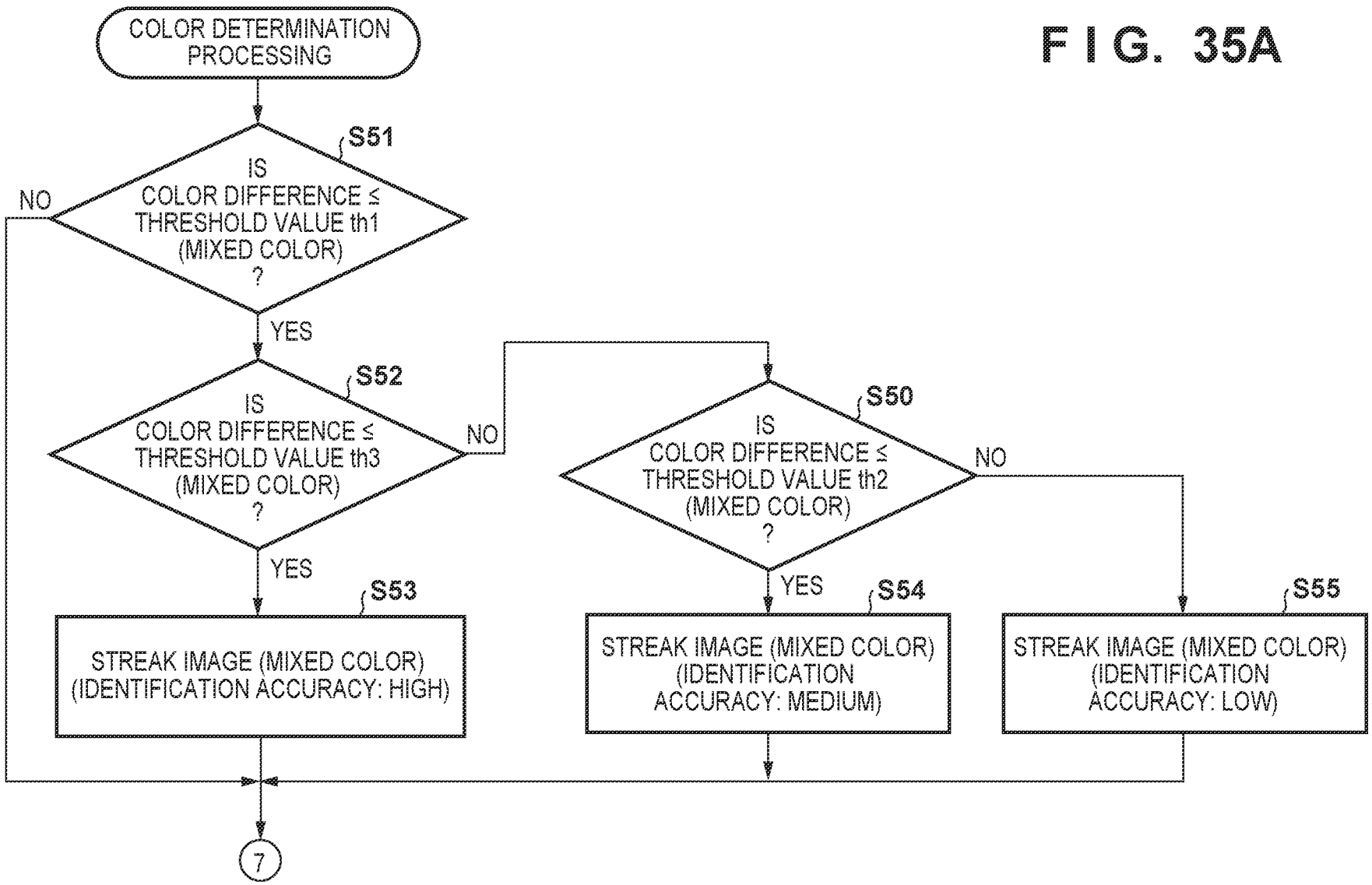
FIGS. 35A and 35B are flowcharts illustrating color determination processing.
Figure 35B:
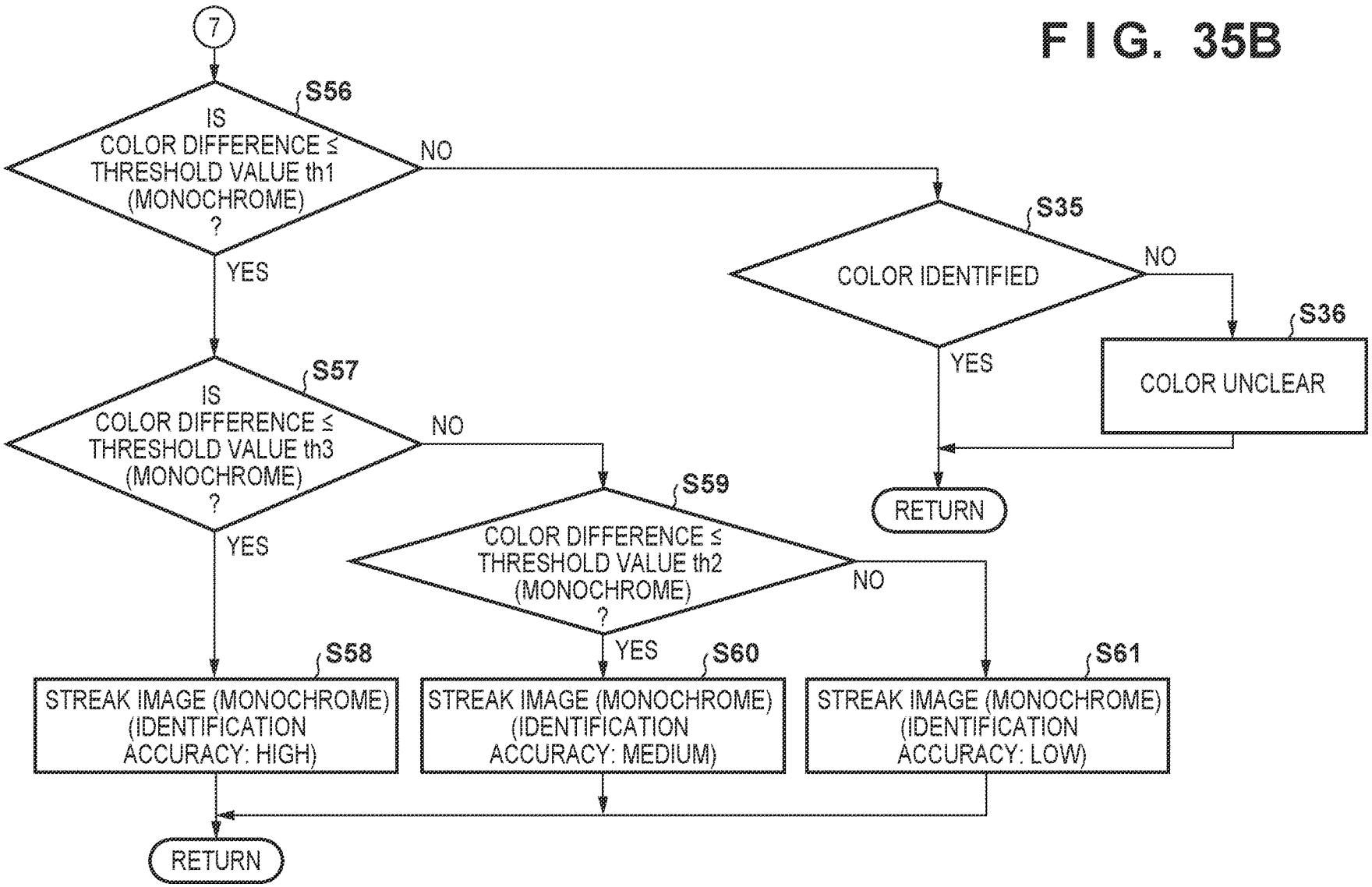

FIGS. 35A and 35B illustrate detail of color determination processing according to the sixth embodiment. In FIGS. 35A and 35B, the same reference signs are added to steps in common with FIG. 31. In step S51, the color determination unit 57 determines whether the color difference between the color of a streak and a mixed color (red) is less than or equal to a threshold value th1.

Figure 36:
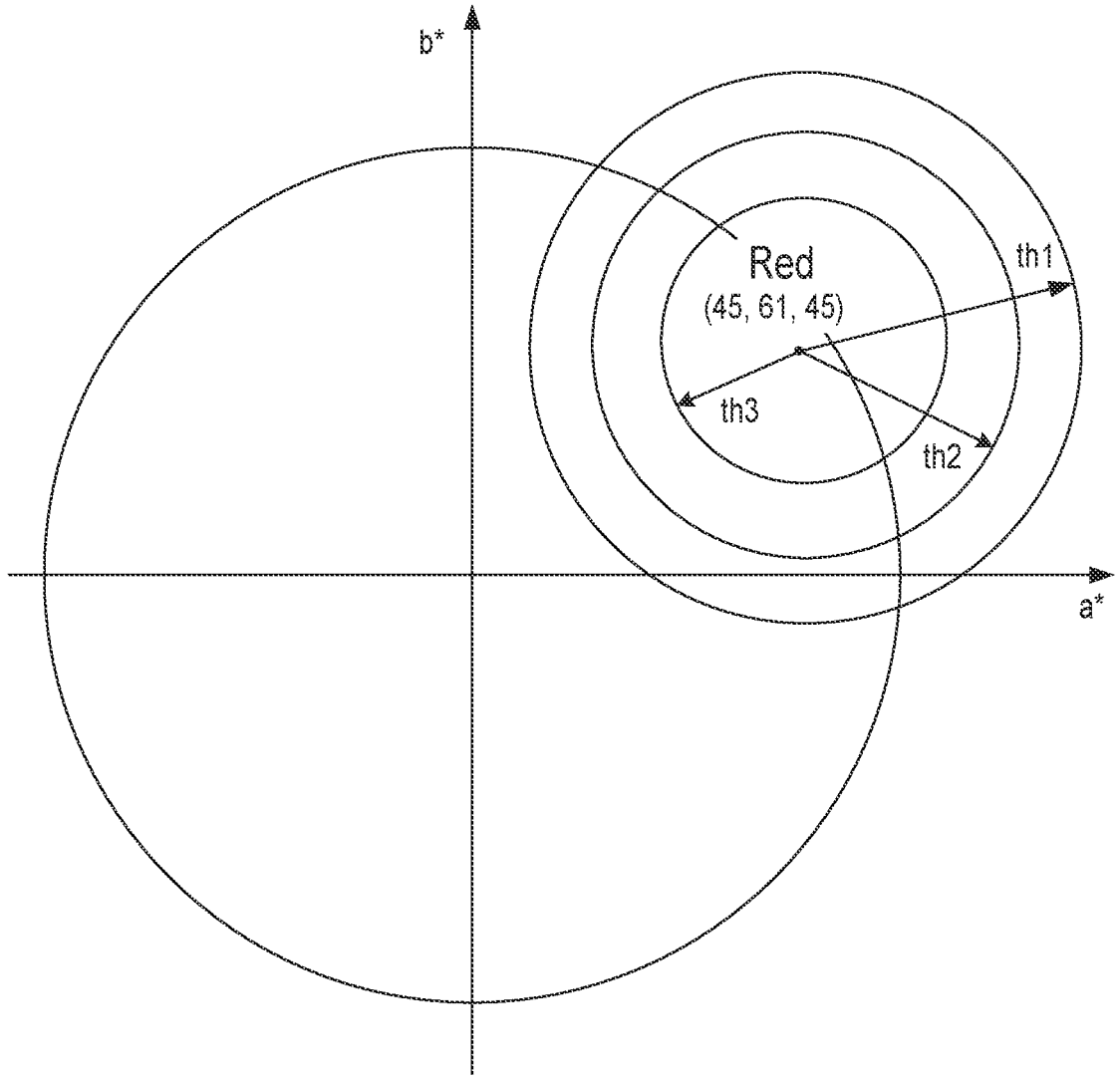
FIG. 36 is a view illustrating examples of threshold values and reference values for a color determination.

FIG. 36 illustrates a first threshold value th1, a second threshold value th2, and a third threshold value th3 which are set for a reference value for red. Three threshold values are similarly provided for each of Y, M, C, and K. The first threshold value th1 is larger than the second threshold value th2, and the second threshold value th2 is larger than the third threshold value th3. For example, if the color of a streak image is present inside the circle whose radius is the third threshold value th3, identification accuracy is relatively high. If the color of a streak image is present between the circle whose radius is the second threshold value th2 and the circle whose radius is the first threshold value th1, identification accuracy is relatively low. If the color difference is greater than the first threshold value th1, the color determination unit 57 transitions the processing to step S56. In contrast, if the color difference is less than or equal to the first threshold value th1, the color determination unit 57 transitions the processing to step S52.

In step S52, the color determination unit 57 determines whether the color difference obtained from the streak image is less than or equal to the third threshold value th3. If the color difference is less than or equal to the third threshold value th3, the color determination unit 57 transitions the processing to step S53.

In step S53, the color determination unit 57 determines that the color of the streak image is a mixed color (red). In other words, a reference color which is the mixed color for which the color difference is less than or equal to the third threshold value th3 is determined to be the color of the streak image. Furthermore, the color determination unit 57 determines the identification accuracy as a "high" level.

When it is determined in step S52 that the color difference is greater than the third threshold value th3, the color determination unit 57 transitions the processing to step S50. In step S50, the color determination unit 57 determines whether the color difference obtained from the streak image is less than or equal to the second threshold value th2. If the color difference is less than or equal to the second threshold value th2, the color determination unit 57 transitions the processing to step S54. If the color difference is greater than the second threshold value th2, the color determination unit 57 transitions the processing to step S55.

In step S54, the color determination unit 57 determines that the color of the streak image is a mixed color (red). In other words, the reference color which is a mixed color (red), for which the color difference exceeded the third threshold value th3 and is less than or equal to the second threshold value th2, is determined as the color of the streak image. Furthermore, the color determination unit 57 determines the identification accuracy as a "medium" level.

In step S55, the color determination unit 57 determines that the color of the streak image is a mixed color (red). In other words, the reference color which is a mixed color (red), for which the color difference exceeded the second threshold value th2 and is less than or equal to the first threshold value th1, is determined as the color of the streak image. Furthermore, the color determination unit 57 determines the identification accuracy as a "low" level.

If the color difference between the color of the streak and red is greater than the threshold value th1, the color determination unit 57 determines whether a color difference between the color of the streak and a monochrome (yellow, magenta, cyan, or black) is less than or equal to the threshold value th1 (step S56). Note that the color determination unit 57 identifies the color of the streak as the closest monochrome out of yellow, magenta, cyan, and black, and calculates a color difference between the color of the streak and the identified monochrome. If the color difference is greater than the threshold value th1, the color determination unit 57 transitions the processing to step S35. In contrast, if the color difference is less than or equal to the threshold value th1, the color determination unit 57 transitions the processing to step S57.

In step S57, the color determination unit 57 determines whether the color difference obtained from the streak image is less than or equal to the third threshold value th3. If the color difference is less than or equal to the third threshold value th3, the color determination unit 57 transitions the processing to step S58.

In step S58, the color determination unit 57 determines that the color of the streak image is a monochrome. In other words, a reference color which is a monochrome for which the color difference is less than or equal to the third threshold value th3 is determined to be the color of the streak image. Furthermore, the color determination unit 57 determines the identification accuracy as a "high" level.

When it is determined in step S56 that the color difference is greater than the third threshold value th3, the color determination unit 57 transitions the processing to step S59. In step S59, the color determination unit 57 determines whether the color difference obtained from the streak image is less than or equal to the second threshold value th2. If the color difference is less than or equal to the second threshold value th2, the color determination unit 57 transitions the processing to step S60. If the color difference is greater than the second threshold value th2, the color determination unit 57 transitions the processing to step S61.

In step S60, the color determination unit 57 determines that the color of the streak image is a monochrome. In other words, the reference color which is a monochrome, for which the color difference exceeded the third threshold value th3 and is less than or equal to the second threshold value th2, is determined as the color of the streak image. Furthermore, the color determination unit 57 determines the identification accuracy as a "medium" level.

In step S61, the color determination unit 57 determines that the color of the streak image is a monochrome. In other words, the reference color which is a monochrome, for which the color difference exceeded the second threshold value th2 and is less than or equal to the first threshold value th1, is determined as the color of the streak image. Furthermore, the color determination unit 57 determines the identification accuracy as a "low" level.

By virtue of the sixth embodiment, a plurality of threshold values are provided as threshold values for a color determination. For example, by using a large threshold value as one of the plurality of threshold values, a determination of the color of a streak image is possible even if the streak image is bright. Furthermore, identification accuracy is decided in accordance with which threshold value out of the plurality of threshold values the color determination was made. Accordingly, a user or a service person can ascertain the reliability of the identification of a replacement part. In this way, the color determination unit 57 functions as a deciding unit for deciding an indication (for example, identification accuracy) which indicates the reliability of a replacement part in accordance with a distance (for example, a color difference). The display apparatus 61 or the display 113 are an example of an output unit for outputting information indicating the replacement part and information indicating the indication. In addition, a plurality of replacement parts, and information relating to a possibility (for example, identification accuracy) of being identified as a replacement part that is in accordance with the plurality of replacement parts may be displayed on the display 113.

As described with relation to step S36, if the color of a streak image appearing in the diagnosis chart T is unclear, the replacement part identifying unit 58 may determine a first removal member, a second removal member, a third removal member, a fourth removal member, and another removal member as fault locations. A case where the color is unclear is when a color difference between the streak image and a first color is greater than a first threshold value, a color difference between the streak image and a second color is greater than a second threshold value, a color difference between the streak image and a third color is greater than a third threshold value, a color difference between the streak image and a fourth color is greater than a fourth threshold value, and a color difference between the streak image and a predetermined color is greater than a fifth threshold value. Note that the predetermined color is a color that is different to all of the first color through the fourth color (developer colors), and is a mixed color, for example.

Seventh Embodiment

The seventh embodiment is a higher level technical concept that is derived from the first through sixth embodiments. The photosensitive drum 11 and the intermediate transfer belt 31 are examples of a rotary member. In particular, the photosensitive drums 11 are examples of a photosensitive member that is driven and rotates. The intermediate transfer belt 31 is an example of an image carrier. Each station for Y, M, C, and Bk is an example of an image forming unit for forming a toner image. In other words, a station is an example of an image forming unit for forming an image using developer on an image carrier or a photosensitive member. The registration roller pair 26 is an example of a conveying unit for conveying a sheet. The primary transfer device 17 or the secondary transfer device 27 is an example of a transfer unit for transferring a toner image formed on a rotary member to a predetermined member (for example, the intermediate transfer belt 31 or a sheet P). In particular, the secondary transfer nip portion N2 is an example of a transfer portion at which an image formed on an image carrier is transferred to a sheet. The drum cleaner 15 or the belt cleaner 35 is an example of a cleaning unit for cleaning toner that remains on a rotary member without being transferred to a predetermined member. The belt cleaner 35 is an example of a removal member for removing developer that is residual on an image carrier without being transferred from the image carrier to a sheet at the transfer portion. The CPU 60 is an example of a controller for controlling an image forming unit and a transfer unit. As described using FIG. 3 and the like, the CPU 60 controls the image forming unit at an n-th rotation of the rotary member to form a toner image on a predetermined region of the rotary member, and causes the cleaning unit to clean the toner image. Furthermore, the CPU 60 controls the image forming unit at a n+1-th rotation of the rotary member to form a test chart (for example, the test chart 701) for identifying a replacement part by not forming a toner image at the predetermined region of the rotary member. In other words, the CPU 60 is a controller for executing processing for creating a test chart that is used to detect a fault location of the image forming apparatus. If this processing is executed, the CPU 60 causes a pattern image to be formed by the image forming unit, and causes the image carrier to rotate so that the pattern image passes through the transfer portion to be removed by the removal member. Furthermore, the CPU 60 controls the conveying unit so that a time period when a region on the image carrier that includes a position to which a pattern image has been transferred passes through the transfer portion overlaps with a time period in which a sheet passes through the transfer portion. In this way, by forming a toner image in advance on the rotary member before forming the test chart, and causing the cleaning unit to clean the toner image, it becomes easier to make an image defect due to the cleaning unit be apparent on the test chart. In other words, a toner image formed in the predetermined region of the rotary member at the n-th rotation is a toner image for causing an image defect to be apparent.

As illustrated by FIGS. 16A to 16D, the image forming unit forms a detection region (for example, the blank portions WD and WT) for a streak-shaped image on a test chart by not forming a toner image at a n+1-th rotation to the predetermined region where a toner image was formed on the rotary member at an n-th rotation. The CPU 60 forms a blank portion WD at a timing after a photosensitive drum 11 has rotated once from a timing when a patch PD for causing a vertical streak to be apparent was formed. In other words, a time difference between a formation start time of the patch PD and a formation start time of the blank portion WD is an amount of time required for one rotation of the photosensitive drum 11. The patch PD is formed at a time before the formation start time of the blank portion WD by the amount of time required for one rotation of the photosensitive drum 11.

Similarly, the CPU 60 forms a blank portion WT at a timing after the intermediate transfer belt 31 has rotated once from a timing when a patch PT for causing a vertical streak to be apparent was formed. In other words, a time difference between a formation start time of the patch PT and a formation start time of the blank portion WT is an amount of time required for one rotation of the intermediate transfer belt 31. The patch PT is formed at a time before the formation start time of the blank portion WT by the amount of time required for one rotation of the intermediate transfer belt 31.

The diagnostic unit 67 of the CPU 60 is an example of an identifying unit for identifying a replacement part based on a result of detecting a streak-shaped image that occurs in a detection region in a test chart. The test chart 701 may be read by the image reader 2 and used by the diagnostic unit 67, and a human may visually observe the test chart 701 to identify a replacement part.

As described in the first embodiment, the diagnostic unit 67 may identify a replacement part based on the color of a streak-shaped image that occurs in a detection region in the test chart 701. As described in the second and third embodiments, the diagnostic unit 67 may identify a replacement part based on an occurrence position of a streak-shaped image that occurs in a test chart. As described using FIG. 3, the length of a toner image (for example, the patches PD and PT) in the rotation direction of the rotary member may essentially match the length of a detection region (for example, the blank portions WD and WT) in the rotation direction of the rotary member.

As illustrated by FIG. 22B, the length of the detection region in the rotation direction of the rotary member may be longer than the length of the toner image in the rotation direction of the rotary member. By this, the diagnostic unit 67 can appropriately identify a replacement part even if a difference in streak length or a delay of a streak has occurred.

The test chart 703 may have a first non-exposure image which is a toner image formed by the application of a first charging potential and without the application of exposure. The test chart 704 may have a second non-exposure image which is a toner image formed by the application of a second charging potential different to the first charging potential and without the application of exposure.

A toner image formed on an image carrier at an n-th rotation of the image carrier is a monochromatic toner image, but a toner image formed on the intermediate transfer member at an m-th rotation of the intermediate transfer member may be a toner image that mixes a plurality of toner colors. By this, it should be easier for the diagnostic unit 67 to identify which of the drum cleaners 15 and the belt cleaner 35 has a problem.

The transfer control unit 70 may set a primary transfer condition for when a toner image formed on a predetermined region of an image carrier passes through the nip portion between the image carrier and the primary transfer unit (the primary transfer nip portion N1) at an n-th rotation of the image carrier to a condition by which the toner image will be less likely to adhere to an intermediate transfer member. By this, it should become easier to supply, to a drum cleaner 15, toner for causing a vertical streak to be apparent. In addition, it should be less likely for the intermediate transfer belt 31 to be dirtied. The transfer control unit 70 may set a primary transfer condition for when the predetermined region of an image carrier passes through the nip portion between the image carrier and the primary transfer unit (the primary transfer nip portion N1) at an n+1-th rotation of the image carrier to a condition by which toner that was not completely cleaned by the first cleaning unit from out of a toner image formed at the predetermined region will be more likely to be transferred to an intermediate transfer member. By this, it should be easier for a streak to be apparent on the test chart.

The transfer control unit 70 may set a secondary transfer condition for when a toner image formed on a predetermined region of an intermediate transfer member passes through the nip portion between the intermediate transfer member and the secondary transfer unit (the secondary transfer nip portion N2) at an m-th rotation of the intermediate transfer member to a condition by which the toner image will be less likely to adhere to the secondary transfer unit. By this, it should become easier to supply to the belt cleaner 35 with toner for causing a vertical streak to be apparent. In addition, it should be less likely for the secondary transfer device 27 to be dirtied. The transfer control unit 70 may set a secondary transfer condition for when the predetermined region of the intermediate transfer member passes through the nip portion between the intermediate transfer member and the secondary transfer unit (the secondary transfer nip portion N2) at an m+1-th rotation of the intermediate transfer member to a condition by which it will be easier for toner, which could not be completely cleaned by the second cleaning unit from out of the toner image formed at the predetermined region, to be transferred to a sheet that is to be a test chart. By this, it should be easier for a streak to be apparent on the test chart.

The diagnostic unit 67 is an example of a detecting unit for detecting a fault location of the image forming apparatus based on read data relating to a test chart obtained from a reading apparatus. The diagnostic unit 67 detects a streak-shaped image from a test chart based on the read data, and detects a fault location of the image forming apparatus based on a result of detecting the streak-shaped image. The diagnostic unit 67 detects a fault of a removal member if a streak-shaped image is detected from the test chart based on the read data. The CPU 60 controls the transfer portion based on the first transfer condition when the pattern image passes through the transfer portion. The CPU 60 controls the transfer portion to the second transfer condition which is different the first transfer condition when a region of the pattern image passes through the transfer portion again. The secondary transfer power supply 72 is an example of a supply unit for supplying a transfer voltage to the transfer portion. When the pattern image passes through the transfer portion, the CPU 60 controls supply of a first transfer voltage from the supply unit to the transfer portion so that developer of the image carrier is not transferred to the sheet. When the region of the pattern image passes through the transfer portion again, the CPU 60 controls supply of a second transfer voltage from the supply unit to the transfer portion so that developer of the image carrier is transferred to the sheet.

The primary transfer nip portion N1 is an example of a primary transfer nip portion where an image formed on a photosensitive member is transferred to a transfer member. The drum cleaner 15 is an example of a removal member for removing developer that is residual on a photosensitive member without being transferred from the photosensitive member to a transfer member at the primary transfer nip portion. The secondary transfer nip portion N2 is an example of a secondary transfer nip portion where an image that has been transferred to a transfer member is transferred to a sheet. The CPU 60 executes processing for creating a test chart that is used to detect a fault location of the image forming apparatus. When this processing is executed, the CPU 60 causes a pattern image to be formed by the image forming unit, controls the primary transfer nip portion to the first transfer condition, and causes the photosensitive member to rotate so that the pattern image passes through the primary transfer nip portion and is removed by the removal member. In a time period in which a first region of a photosensitive member that includes a position where a pattern image is formed passes through the primary transfer nip portion again, the CPU 60 controls the primary transfer nip portion to a second transfer condition that differs from the first transfer condition. Furthermore, the CPU 60 controls the conveying unit so that a time period in which a second region of the transfer member that was in contact with the first region of the photosensitive member at the primary transfer nip portion passes through the secondary transfer nip portion overlaps with a time period in which a sheet passes through the secondary transfer nip portion.

The diagnostic unit 67 is an example of a detecting unit for detecting a fault location of the image forming apparatus based on read data relating to a test chart obtained from a reading apparatus. The diagnostic unit 67 detects a streak-shaped image from a test chart based on the read data, and detects a fault location of the image forming apparatus based on a result of detecting the streak-shaped image. The diagnostic unit 67 is characterized by detecting a fault of a removal member if a streak-shaped image is detected from the test chart based on the read data. The primary transfer power supply 71 is an example of a supply unit for supplying a transfer voltage to the primary transfer nip portion. The CPU 60 controls supply of the first transfer voltage to the primary transfer nip portion from the supply unit based on the first transfer condition. Furthermore, the CPU 60 controls supply of the second transfer voltage from the supply unit to the primary transfer nip portion based on the second transfer condition so that an amount of transferred developer increases to be more than for the first transfer voltage. Moreover, the CPU 60, in a detection mode for detecting a part of the image forming apparatus causing a streak which is a straight line, controls the image forming unit to form a pattern image on the image carrier, controls the transfer unit so that the pattern image passes through a transfer position on which the toner image is transferred by the transfer unit from the image carrier to the sheet without transferring the pattern image to the sheet, controls the cleaner to remove the pattern image on the image carrier, and controls the transfer unit to transfer a residual streak from the image carrier to the sheet. The residual streak occurs from the pattern image by causing an error of the cleaner. The CPU 60 may control the transfer unit to transfer the residual streak from the image carrier to the sheet based on a predetermined transfer condition. The residual streak does not occur in a case where the error of the cleaner is not the cause. The CPU 60 controls, in the detection mode, the reader to read the sheet to which the residual streak has been transferred. The CPU 60 controls, in the detection mode, the reader to read the sheet to which the residual steak has been transferred, and detects the part of the image forming apparatus causing the residual streak based on a read result of the sheet. A display may display a screen for notifying of the part of the image forming apparatus causing the streak. The CPU 60 controls, in the detection mode, the image forming unit to form a test chart for detecting the part of the image forming apparatus on the image carrier, and controls the transfer unit to transfer the test chart from the image carrier to the sheet. The CPU 60 controls, in the detection mode, the image forming unit to form a test chart for detecting the part of the image forming apparatus on the image carrier, and controls the transfer unit to transfer the test chart from the image carrier to another sheet.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-Ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-074041, filed Apr. 6, 2018, and Japanese Patent Application No. 2018-078624 filed Apr. 16, 2018, which are hereby incorporated by reference herein in their entirety.

What is claimed is:

1. An image forming apparatus comprising:

an image forming unit configured to form a toner image on an image carrier using toner, wherein the image carrier rotates;

a transfer unit configured to transfer the toner image from the image carrier to a sheet;

a cleaner configured to remove, from the image carrier, residual toner that passed through a transfer position where the toner image is transferred by the transfer unit; and a controller, in a detection mode for detecting a part of the image forming apparatus that causes a streak included in the toner image formed by the image forming apparatus, configured to:

control the image forming unit to form a pattern image on the image carrier;

control the transfer unit so that the pattern image passes through the transfer position; and control the transfer unit to transfer a cleaner streak on a sheet, the cleaner streak occurring due to abnormality of the cleaner such that the cleaner cannot completely remove the pattern image, wherein the cleaner streak does not occur in a case of no abnormality of the cleaner.

2. The image forming apparatus according to claim 1, wherein the image forming unit has a photosensitive member, and the image forming unit forms an electrostatic latent image on the photosensitive member, develops the electrostatic latent image using the toner, and transfers the toner image on the photosensitive member to the image carrier.

3. The image forming apparatus according to claim 1, wherein the controller controls the transfer unit to transfer the cleaner streak from the image carrier to the sheet based on a predetermined transfer condition, and the predetermined transfer condition differs from a transfer condition of which the transfer unit transfers the toner image to the sheet.

4. The image forming apparatus according to claim 1, further comprising a conveyance roller configured to convey the sheet, wherein the controller controls the conveyance roller to transfer the cleaner streak to the sheet.

5. The image forming apparatus according to claim 1, wherein the controller controls, in the detection mode, the image forming unit to form a test chart on the image carrier, and controls the transfer unit to transfer the test chart from the image carrier to the sheet to which the cleaner streak is transferred.

6. The image forming apparatus according to claim 5, further comprising a reader configured to read an original, wherein the image forming unit forms the toner image based on read data, relating to the original, that is outputted by the reader, and the controller controls, in the detection mode, the reader to read the sheet to which the test chart has been transferred.

7. The image forming apparatus according to claim 5, further comprising a reader configured to read an original, wherein the image forming unit forms the toner image based on read data, relating to the original, that is outputted by the reader, and the controller controls, in the detection mode, the reader to read the sheet to which the test chart has been transferred, and detects the part of the image forming apparatus based on a read result of the sheet.

8. The image forming apparatus according to claim 7, further comprising a display configured to display a screen for notifying of the part of the image forming apparatus.

9. The image forming apparatus according to claim 1, wherein the controller controls, in the detection mode, the image forming unit to form a test chart on the image carrier, and controls the transfer unit to transfer the test chart from the image carrier to another sheet.

10. The image forming apparatus according to claim 1, wherein the controller controls the image forming unit to form a test chart such that the test chart is transferred to the sheet in conjunction with the cleaner streak.

11. The image forming apparatus according to claim 10, further comprising a reader configured to read an original, wherein the image forming unit forms the toner image based on read data, relating to the original, that is outputted by the reader, and the controller controls, in the detection mode, the reader to read the sheet to which the test chart has been transferred.

12. The image forming apparatus according to claim 10, further comprising a reader configured to read an original, wherein the image forming unit forms the toner image based on read data, relating to the original, that is outputted by the reader, and the controller controls, in the detection mode, the reader to read the sheet to which the test chart has been transferred, and detects the part of the image forming apparatus based on a read result of the sheet.

13. The image forming apparatus according to claim 12, further comprising a display configured to display a screen for notifying of the part of the image forming apparatus.

* * * * *